US008068027B2

(12) United States Patent
Auerbach et al.

(10) Patent No.: US 8,068,027 B2
(45) Date of Patent: Nov. 29, 2011

(54) MONITORABLE LOCKING ASSEMBLIES

(75) Inventors: Micha Auerbach, Maccabin (IL); Joseph Shekel, Tel Aviv (IL); Alon Zelzion, Holon (IL); Eli Golan, Ramat Hasahron (IL); Noach Eizen, Rishon Le Zion (IL); Ronny Cohen, Zoran (IL); Eli Levy, Nir Zvi (IL)

(73) Assignee: HI-G-TEK Ltd., Or-Yehuda (IL)

( * ) Notice: Subject to any disclaimer, the term of this patent is extended or adjusted under 35 U.S.C. 154(b) by 1057 days.

(21) Appl. No.: 10/593,553

(22) PCT Filed: Mar. 30, 2005

(86) PCT No.: PCT/IL2005/000357

§ 371 (c)(1),
(2), (4) Date: Aug. 8, 2007

(87) PCT Pub. No.: WO2005/094172

PCT Pub. Date: Oct. 13, 2005

(65) Prior Publication Data

US 2008/0036596 A1 Feb. 14, 2008

Related U.S. Application Data

(60) Provisional application No. 60/557,976, filed on Mar. 30, 2004, provisional application No. 60/562,750, filed on Apr. 15, 2004, provisional application No. 60/574,424, filed on May 25, 2004, provisional application No. 60/624,263, filed on Nov. 2, 2004.

(51) Int. Cl.
*E05B 45/06* (2006.01)

(52) U.S. Cl. ..... 340/542; 340/539.13; 340/539.1; 340/539.11; 340/539.15; 340/539.32

(58) Field of Classification Search ..... 340/539.13, 340/573.1, 539.1, 539.11, 539.15, 539.32, 340/825.36, 825.49
See application file for complete search history.

(56) References Cited

U.S. PATENT DOCUMENTS

| | | | |
|---|---|---|---|
| 3,453,892 | A | 7/1969 | Hudson |
| 3,544,988 | A | 12/1970 | Astheimer |
| 3,642,036 | A | 2/1972 | Ginsburgh et al. |
| 3,713,133 | A | 1/1973 | Nathans |
| 3,714,644 | A | 1/1973 | Hellstrom |
| 3,785,261 | A | 1/1974 | Ganteaume |
| 3,814,148 | A | 6/1974 | Wastl |
| 3,913,010 | A | 10/1975 | Scarpino |
| 3,914,996 | A | 10/1975 | Davis et al. |
| 4,000,488 | A | 12/1976 | Ephraim |
| 4,101,876 | A | 7/1978 | Lurkis et al. |
| 4,109,686 | A | 8/1978 | Phillips |
| 4,218,674 | A | 8/1980 | Brosow et al. |
| 4,233,595 | A | 11/1980 | Landkammer |
| 4,263,945 | A | 4/1981 | Van Ness |

(Continued)

OTHER PUBLICATIONS

U.S. Appl. No. 60/557,976.

(Continued)

*Primary Examiner* — Daryl Pope
(74) *Attorney, Agent, or Firm* — Abelman, Frayne & Schwab

(57) ABSTRACT

A key-operated remotely monitorable locking assembly including a key-operated lock including a lock body including a key operated locking assembly and a tamper monitorable lockable assembly which is selectably locked to the lock body by operation of the mechanical key operated locking assembly and a wireless communication circuit located in a least one of the lock body and the lockable assembly for providing a remotely monitorable indication of tampering with the lockable assembly.

42 Claims, 44 Drawing Sheets

U.S. PATENT DOCUMENTS

| | | | |
|---|---|---|---|
| 4,469,149 | A | 9/1984 | Walkey et al. |
| 4,488,370 | A | 12/1984 | Lemelson |
| 4,541,191 | A | 9/1985 | Morris et al. |
| 4,620,182 | A | 10/1986 | Keifer |
| 4,656,463 | A | 4/1987 | Anders et al. |
| 4,677,982 | A | 7/1987 | LLinas et al. |
| 4,688,244 | A | 8/1987 | Hannon et al. |
| 4,748,668 | A | 5/1988 | Shamir et al. |
| 4,750,197 | A | 6/1988 | Denekamp et al. |
| 4,766,419 | A | 8/1988 | Hayward |
| 4,782,784 | A | 11/1988 | Little |
| 4,827,395 | A | 5/1989 | Anders et al. |
| 4,832,050 | A | 5/1989 | DiLullo |
| 4,846,233 | A | 7/1989 | Fokens |
| 4,854,328 | A | 8/1989 | Pollack |
| 4,864,282 | A | 9/1989 | Toeg |
| 4,920,334 | A | 4/1990 | DeVolpi |
| 4,934,419 | A | 6/1990 | Lamont et al. |
| 4,952,913 | A | 8/1990 | Pauley et al. |
| 5,021,768 | A | 6/1991 | Kishida et al. |
| 5,033,217 | A | 7/1991 | Brennan |
| 5,056,837 | A | 10/1991 | Fuehrer |
| 5,068,643 | A | 11/1991 | Yashina |
| 5,072,213 | A | 12/1991 | Close |
| 5,097,253 | A | 3/1992 | Eschbach et al. |
| 5,099,228 | A | 3/1992 | Israel et al. |
| 5,105,190 | A | 4/1992 | Kip et al. |
| 5,119,104 | A | 6/1992 | Heller |
| 5,127,687 | A | 7/1992 | Guiler |
| 5,153,584 | A | 10/1992 | Engira |
| 5,156,198 | A | 10/1992 | Hall |
| 5,166,929 | A | 11/1992 | Lo |
| 5,169,188 | A | 12/1992 | Kupperman et al. |
| 5,189,396 | A | 2/1993 | Stobbe |
| 5,189,935 | A | 3/1993 | Rosemann |
| 5,191,314 | A | 3/1993 | Ackerman et al. |
| 5,204,819 | A | 4/1993 | Ryan |
| 5,237,307 | A | 8/1993 | Gritton |
| 5,244,017 | A | 9/1993 | Hartman et al. |
| 5,249,612 | A | 10/1993 | Parks et al. |
| 5,252,962 | A | 10/1993 | Urbas et al. |
| 5,266,925 | A | 11/1993 | Vercellotti et al. |
| 5,270,681 | A | 12/1993 | Jack |
| 5,276,431 | A | 1/1994 | Piccoli et al. |
| 5,291,680 | A | 3/1994 | Schabdach et al. |
| 5,316,057 | A | 5/1994 | Hasselmann |
| 5,359,522 | A | 10/1994 | Ryan |
| 5,392,025 | A | 2/1995 | Figh et al. |
| 5,396,227 | A | 3/1995 | Carroll et al. |
| 5,406,263 | A | 4/1995 | Tuttle |
| 5,406,730 | A | 4/1995 | Sayre |
| 5,408,212 | A | 4/1995 | Meyers et al. |
| 5,408,213 | A | 4/1995 | Ungarsohn |
| 5,410,301 | A | 4/1995 | Dawson et al. |
| 5,416,486 | A | 5/1995 | Koert et al. |
| 5,421,177 | A | 6/1995 | Sieber et al. |
| 5,422,627 | A | 6/1995 | Tap et al. |
| 5,434,572 | A | 7/1995 | Smith |
| 5,437,117 | A | 8/1995 | Mackey, III |
| 5,447,344 | A | 9/1995 | Hayward |
| 5,448,638 | A | 9/1995 | Johnson et al. |
| 5,471,212 | A | 11/1995 | Sharpe et al. |
| 5,475,367 | A | 12/1995 | Prevost |
| 5,481,262 | A | 1/1996 | Urbas et al. |
| 5,512,879 | A | 4/1996 | Stokes |
| 5,534,847 | A | 7/1996 | McGregor |
| 5,537,105 | A | 7/1996 | Marsh et al. |
| 5,537,771 | A | 7/1996 | Martin |
| 5,565,858 | A | 10/1996 | Guthrie |
| 5,566,486 | A | 10/1996 | Brinkley |
| 5,570,080 | A | 10/1996 | Inoue et al. |
| 5,574,977 | A | 11/1996 | Joseph et al. |
| 5,587,702 | A | 12/1996 | Chadfield |
| 5,594,738 | A | 1/1997 | Crisler et al. |
| 5,596,501 | A | 1/1997 | Comer et al. |
| 5,605,182 | A | 2/1997 | Oberrecht et al. |
| 5,612,675 | A | 3/1997 | Jennings et al. |
| 5,615,247 | A | 3/1997 | Mills |
| 5,615,249 | A | 3/1997 | Solondz |
| 5,630,209 | A | 5/1997 | Wizgall et al. |
| 5,642,355 | A | 6/1997 | Smith |
| 5,644,295 | A | 7/1997 | Connolly et al. |
| 5,646,592 | A | 7/1997 | Tuttle |
| 5,650,778 | A | 7/1997 | Urbas et al. |
| 5,656,996 | A | 8/1997 | Houser |
| 5,677,674 | A | 10/1997 | Wolf |
| 5,686,902 | A | 11/1997 | Reis et al. |
| 5,691,980 | A | 11/1997 | Welles, II et al. |
| 5,700,088 | A | 12/1997 | Piacente et al. |
| 5,715,623 | A | 2/1998 | Mackey, III |
| 5,721,531 | A | 2/1998 | Garver et al. |
| 5,722,469 | A | 3/1998 | Tuminaro |
| 5,727,608 | A | 3/1998 | Nusbaumer et al. |
| 5,749,533 | A | 5/1998 | Daniels |
| 5,751,221 | A | 5/1998 | Stanfield et al. |
| 5,751,256 | A | 5/1998 | McDonough et al. |
| 5,751,570 | A | 5/1998 | Stobe et al. |
| 5,754,108 | A | 5/1998 | Ungarsohn |
| 5,767,772 | A | 6/1998 | Lemaire et al. |
| 5,767,792 | A | 6/1998 | Urbas et al. |
| 5,786,759 | A | 7/1998 | Ling |
| 5,821,870 | A | 10/1998 | Jackson, Jr. |
| 5,831,531 | A | 11/1998 | Tuttle |
| 5,836,002 | A | 11/1998 | Morstein et al. |
| 5,842,977 | A | 12/1998 | Lesho et al. |
| 5,857,501 | A | 1/1999 | Kelerich et al. |
| 5,861,807 | A | 1/1999 | Leyden et al. |
| 5,890,520 | A | 4/1999 | Johnson, Jr. |
| 5,892,441 | A | 4/1999 | Woolley et al. |
| 5,906,228 | A | 5/1999 | Keller |
| 5,910,944 | A | 6/1999 | Callicotte et al. |
| 5,912,623 | A | 6/1999 | Pierson |
| 5,913,180 | A | 6/1999 | Ryan |
| 5,917,405 | A | 6/1999 | Joao |
| 5,917,414 | A | 6/1999 | Oppelt et al. |
| 5,923,572 | A | 7/1999 | Pollock |
| 5,936,525 | A | 8/1999 | Leyden et al. |
| 5,940,006 | A | 8/1999 | MacLellan et al. |
| 5,944,069 | A | 8/1999 | Nusbaumer et al. |
| 5,969,691 | A | 10/1999 | Myers |
| 6,023,218 | A | 2/2000 | Tremblay |
| 6,054,935 | A | 4/2000 | Urbas et al. |
| 6,055,426 | A | 4/2000 | Beasley |
| 6,069,563 | A | 5/2000 | Kadner et al. |
| 6,078,258 | A | 6/2000 | Auerbach et al. |
| 6,154,139 | A | 11/2000 | Heller |
| 6,166,627 | A | 12/2000 | Reeley |
| 6,216,003 | B1 | 4/2001 | Hamajima et al. |
| 6,243,005 | B1 | 6/2001 | Haimovitch et al. |
| 6,256,493 | B1 | 7/2001 | Dorenbosch et al. |
| 6,265,978 | B1 | 7/2001 | Atlas |
| 6,288,629 | B1 | 9/2001 | Cofino et al. |
| 6,300,903 | B1 | 10/2001 | Richards et al. |
| 6,339,397 | B1 | 1/2002 | Baker |
| 6,366,779 | B1 | 4/2002 | Bender et al. |
| 6,369,710 | B1 | 4/2002 | Poticny et al. |
| 6,384,729 | B1 | 5/2002 | Plotkin |
| 6,394,150 | B1 | 5/2002 | Haimovich et al. |
| 6,420,971 | B1 | 7/2002 | Leck et al. |
| 6,421,540 | B1 | 7/2002 | Gilhousen et al. |
| 6,433,690 | B2 | 8/2002 | Petelenz et al. |
| 6,441,742 | B1 | 8/2002 | Lovely et al. |
| 6,441,747 | B1 | 8/2002 | Khair et al. |
| 6,466,558 | B1 | 10/2002 | Ling |
| 6,507,567 | B1 | 1/2003 | Willars |
| 6,540,674 | B2 | 4/2003 | Zadrozny et al. |
| 6,590,886 | B1 | 7/2003 | Easton et al. |
| 6,593,845 | B1 | 7/2003 | Friedman et al. |
| 6,629,776 | B2 | 10/2003 | Bell et al. |
| 6,646,555 | B1 | 11/2003 | Forester et al. |
| 6,667,725 | B1 | 12/2003 | Simons et al. |

| | | | |
|---|---|---|---|
| 6,744,366 | B2 | 6/2004 | How |
| 6,753,775 | B2 | 6/2004 | Auerbach et al. |
| 6,778,083 | B2 | 8/2004 | Auerbach et al. |
| 6,919,803 | B2 | 7/2005 | Breed |
| 6,927,688 | B2 | 8/2005 | Tice |
| 6,972,682 | B2 | 12/2005 | Lareau et al. |
| 2003/0164763 | A1 | 9/2003 | Hisano et al. |
| 2004/0066328 | A1 | 4/2004 | Galley et al. |
| 2006/0103524 | A1 | 5/2006 | Auerbach et al. |

OTHER PUBLICATIONS

U.S. Appl. No. 60/583,973.
U.S. Appl. No. 60/562,750.
U.S. Appl. No. 60/574,424.

112
116
110
112
116
120
110
115
106
122
108
120
106
114
115
100
118
102
106
118
104
121
120

FIG. 32A
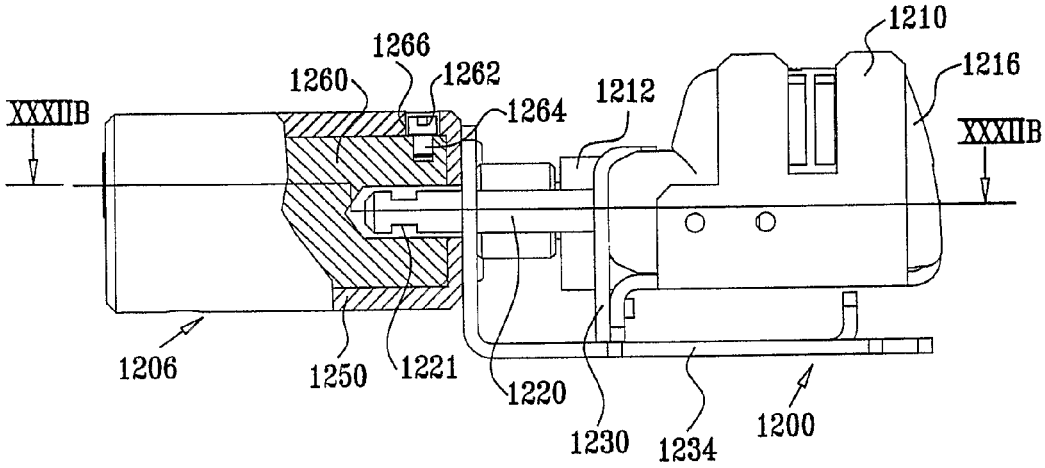
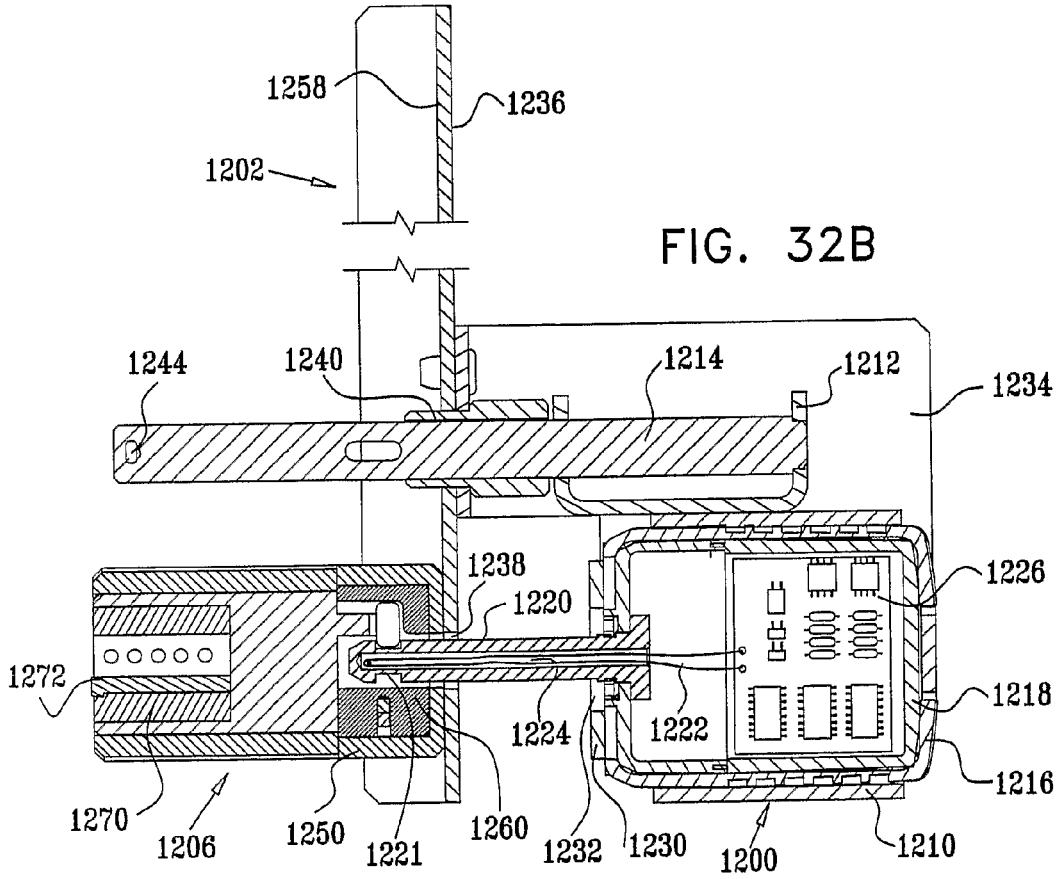
FIG. 32B

MONITORABLE LOCKING ASSEMBLIES

REFERENCE TO RELATED APPLICATIONS

Reference is made to U.S. Provisional Patent Application 60/557,976, filed Mar. 30, 2004 entitled "ELECTRONIC PADLOCK", to U.S. Provisional Patent Application 60/562,750, filed Apr. 15, 2004 entitled "SAFEGLOW-WIRELESS MONITORING SYSTEM FOR FLUID TANKERS", to U.S. Provisional Patent Application 60/574,424, filed May 25, 2004 entitled "HI-G-PARK—WIRELESS CAR & STORED ITEMS IDENTIFICATION SYSTEM" and to U.S. Provisional Patent Application 60/624,263, filed Nov. 2, 2004 entitled "REMOTELY MONITORABLE ELECTRONIC LOCKING DEVICE", the disclosures of which are hereby incorporated by reference and priority of which is hereby claimed pursuant to 37 CFR 1.78(a) (4) and (5)(i).

FIELD OF THE INVENTION

The present invention relates to improved locking assemblies generally.

BACKGROUND OF THE INVENTION

The following U.S. patents are believed to represent the current state of the art:

| | | | | | | |
|---|---|---|---|---|---|---|
| 3,453,892; | 3,544,988; | 3,642,036; | 3,713,133; | 3,714,644; | 3,785,261; | 3,814,148; |
| 3,913,010; | 3,914,996; | 4,000,488; | 4,101,876; | 4,109,686; | 4,218,674; | 4,233,595; |
| 4,263,945; | 4,469,149; | 4,488,370; | 4,541,191; | 4,620,182; | 4,656,463; | 4,748,668; |
| 4,750,197; | 4,766,419; | 4,827,395; | 4,846,233; | 4,920,334; | 4,934,419; | 4,952,913; |
| 5,033,217; | 5,056,837; | 5,068,643; | 5,072,213; | 5,097,253; | 5,099,228; | 5,119,104; |
| 5,127,687; | 5,156,198; | 5,166,929; | 5,169,188; | 5,189,396; | 5,189,935; | 5,191,314; |
| 5,204,819; | 5,237,307; | 5,244,017; | 5,249,612; | 5,266,925; | 5,270,681; | 5,276,431; |
| 5,291,680; | 5,316,057; | 5,359,522; | 5,396,227; | 5,406,263; | 5,406,730; | 5,408,212; |
| 5,408,213; | 5,416,486; | 5,421,177; | 5,422,627; | 5,434,572; | 5,437,117; | 5,447,344; |
| 5,448,638; | 5,471,212; | 5,475,367; | 5,512,879; | 5,525,992; | 5,534,847; | 5,537,105; |
| 5,537,771; | 5,565,858; | 5,566,486; | 5,570,080; | 5,574,977; | 5,587,702; | 5,594,738; |
| 5,596,501; | 5,605,182; | 5,612,675; | 5,615,247; | 5,615,249; | 5,630,209; | 5,642,355; |
| 5,644,295; | 5,646,592; | 5,656,996; | 5,677,674; | 5,686,902; | 5,691,980; | 5,700,088; |
| 5,715,623; | 5,721,531; | 5,722,469; | 5,727,608; | 5,749,533; | 5,751,221; | 5,751,256; |
| 5,751,570; | 5,754,108; | 5,767,772; | 5,786,759; | 5,821,870; | 5,836,002; | 5,857,501; |
| 5,861,807; | 5,890,520; | 5,906,228; | 5,910,944; | 5,912,623; | 5,913,180; | 5,917,405; |
| 5,923,572; | 5,936,525; | 5,940,006; | 5,944,069; | 5,969,691; | 6,055,426; | 6,069,563; |
| 6,154,139; | 6,166,627; | 6,216,003; | 6,256,493; | 6,288,629; | 6,300,903; | 6,366,779; |
| 6,369,710; | 6,394,150; | 6,420,971; | 6,420,971; | 6,421,540; | 6,466,558; | 6,507,567; |
| 6,590,886 and 6,593,845. | | | | | | |

SUMMARY OF THE INVENTION

The present invention seeks to provide improved locking assemblies generally. There is thus provided in accordance with a preferred embodiment of the present invention a key-operated remotely monitorable locking assembly including a key-operated lock including a lock body including a key operated locking assembly and a tamper monitorable lockable assembly which is selectably locked to the lock body by operation of the mechanical key operated locking assembly and a wireless communication circuit located in at least one of the lock body and the lockable assembly for providing a remotely monitorable indication of tampering with the lockable assembly.

Preferably, the wireless communication circuit is also operative for providing a remotely monitorable indication of at least one of locking and unlocking the lockable assembly to the lock body. Alternatively or additionally, the wireless communication circuit is also operative for providing a remotely monitorable indication of at least one of presence and absence of the lockable assembly within the lock body.

Preferably, the tamper monitorable lockable assembly includes a flexible sealing wire assembly. Additionally or alternatively, the key operated locking assembly is operated by at least one of a mechanical key, an electronic key and a combined mechanical-electronic key. Alternatively or additionally, the tamper monitorable lockable assembly includes at least one conductor disposed about a retaining element, the conductor being monitored by the wireless communication circuit.

Preferably, the key operated remotely monitorable locking assembly also includes at least one monitorable element disposed within the lock body and at least one detector operative to monitor the presence of the monitorable element at a predetermined location within the lock body. Additionally, the monitorable element includes a magnet. Alternatively or additionally, the detector includes a reed switch. Alternatively, the detector includes an RFID sensor.

Preferably, the tamper monitorable lockable assembly is entirely removable from the lock body. Alternatively, the tamper monitorable lockable assembly is tethered at one side thereof to the lock body.

Preferably, the wireless communication circuit is operative provide a wireless indication if the tamper monitorable lockable assembly is unlocked from the lock body prior to receipt of wireless authorization by the wireless communication circuit.

Preferably, the key-operated remotely monitorable locking assembly also includes a key insertion sensor operative to sense whether a key is operatively inserted in the key operated locking assembly and the wireless communication circuit is also operative for providing a remotely monitorable indication of at least one of key insertion or the absence thereof.

There is also provided in accordance with another preferred embodiment of the present invention a monitorable shipping container assembly including a shipping container body, a remotely monitorable locking assembly including a lock including a lock body and a tamper monitorable lockable assembly which is selectably locked to the lock body and a wireless communication circuit located in at least one of the lock body and the lockable assembly for providing a remotely monitorable indication of tampering with the lockable assembly and a support on the exterior of the shipping container body for removably supporting the locking assembly onto the shipping container body and a support sensor for sensing when the locking assembly is located on the support, the wireless communication circuit also being operative for providing a remotely monitorable indication responsive to an output of the sensor indicating whether the locking assembly is located on the support.

Preferably, the wireless communication circuit is also operative for providing a remotely monitorable indication of at least one of locking and unlocking the lockable assembly to the lock body. Additionally or alternatively, the remotely monitorable locking assembly is a key operated locking assembly.

Preferably, the remotely monitorable locking assembly also includes a key insertion sensor operative to sense whether a key is operatively inserted in the locking assembly and wherein the wireless communication circuit is also operative for providing a remotely monitorable indication of at least one of key insertion or the absence thereof. Alternatively or additionally, the tamper monitorable lockable assembly includes a flexible sealing wire assembly. Alternatively, the tamper monitorable lockable assembly includes a shackle assembly.

Preferably, the key operated locking assembly is operated by at least one of a mechanical key, an electronic key and a combined mechanical-electronic key. Additionally or alternatively, the tamper monitorable lockable assembly includes at least one conductor disposed about a retaining element, the conductor being monitorable by the wireless communication circuit.

Preferably, the remotely monitorable locking assembly also includes at least one monitorable element disposed within the lock body and at least one detector operative to monitor the presence of the monitorable element at a predetermined location within the lock body. Additionally, the monitorable element includes a magnet. Additionally or alternatively, the detector includes a reed switch. Alternatively, the detector includes an RFID sensor.

Preferably, the support sensor includes a magnet sensor. Alternatively, the support sensor includes an RFID sensor. Alternatively, the support sensor includes a reed switch.

There is further provided in accordance with yet another preferred embodiment of the present invention a remotely monitorable closure assembly including a closure assembly arranged for mounting on a first closure element and including a closure body, a closure pin fixedly mounted onto the closure body and a wireless communication circuit located in the closure body for providing a remotely monitorable indication of tampering with the closure assembly and a closure pin receiver arranged for mounting on a second closure element cooperative with the first closure element, the closure pin receiver having at least a pin securing operative orientation and a pin releasing operative orientation.

Preferably, the remotely monitorable closure assembly also includes a key-operated lock associated with the closure pin receiver and being operative for selectably locking the closure pin receiver in the pin securing operative orientation. Additionally or alternatively, the first and second closure elements are first and second doors which may be secured in a closed mutual orientation by the closure assembly. Alternatively, the first and second closure elements are hatch portions of a tanker which may be secured in a closed mutual orientation by the closure assembly. Alternatively, the first and second closure elements are output valve access elements of a tanker which may be secured in a closed mutual orientation by the closure assembly.

Preferably, the remotely monitorable closure assembly also includes a mounting element fixed to the first closure element and wherein the closure body is mounted onto the mounting element. Additionally, the closure pin includes at least one conductor forming an electrical circuit, the electrical circuit being operative to provide indication of tampering to with the closure assembly to the wireless communication circuit.

Preferably, the closure pin receiver also includes at least one monitorable element operative to provide the wireless communication circuit with sensed information for monitoring the presence of closure pin at a predetermined location within the closure pin receiver. Additionally, the monitorable element includes at least one magnet.

Preferably, the wireless communication circuit is also operative for providing a remotely monitorable indication of at least one of the pin securing operative orientation and the pin releasing operative orientation. Additionally, shifting of the closure pin receiver between the pin securing operative orientation and the pin releasing operative orientation is governed by a spring loaded retaining assembly. Alternatively, shifting of the closure pin receiver between the pin securing operative orientation and the pin releasing operative orientation is governed by a rotation of a mechanical key disposed within the closure pin receiver.

Preferably, the remotely monitorable closure assembly also includes at least one pin receiver retaining element operative to retain a movable portion of the closure pin receiver within a remainder of the closure pin receiver.

There is even further provided in accordance with still another preferred embodiment of the present invention a remote visual identification system including a controller and a plurality of wirelessly addressable displaceable visual indicators, each including a mounting element, a selectably displaceable visual indicator mounted onto the mounting element, an individually addressable visual indicator displacement assembly operative to selectably displace the visual indicator and a wireless communicator associated with the displacement assembly and operative to receive operational signals from the controller.

Preferably, the displacement assembly includes a motor control circuit, a motor controlled by the motor controlled circuit and a transmission controlled by the motor and being operative to position the visual indicator. Additionally or alternatively, the visual indicator is selectably displaceable between an inoperative orientation and a visually indicating orientation by the motor and the transmission.

BRIEF DESCRIPTION OF THE DRAWINGS

The present invention will be understood and appreciated more fully from the following detailed description, taken in conjunction with the drawings in which:

FIGS. 32A and 32B are, respectively, a side view planar illustration and a sectional illustration of the key operated monitorable valve locking assembly of FIGS. 30-31B in a locked orientation, the sectional illustration being taken along section lines XXXIIB-XXIIB in FIG. 32A;

DETAILED DESCRIPTION OF PREFERRED EMBODIMENTS

Figure 1:
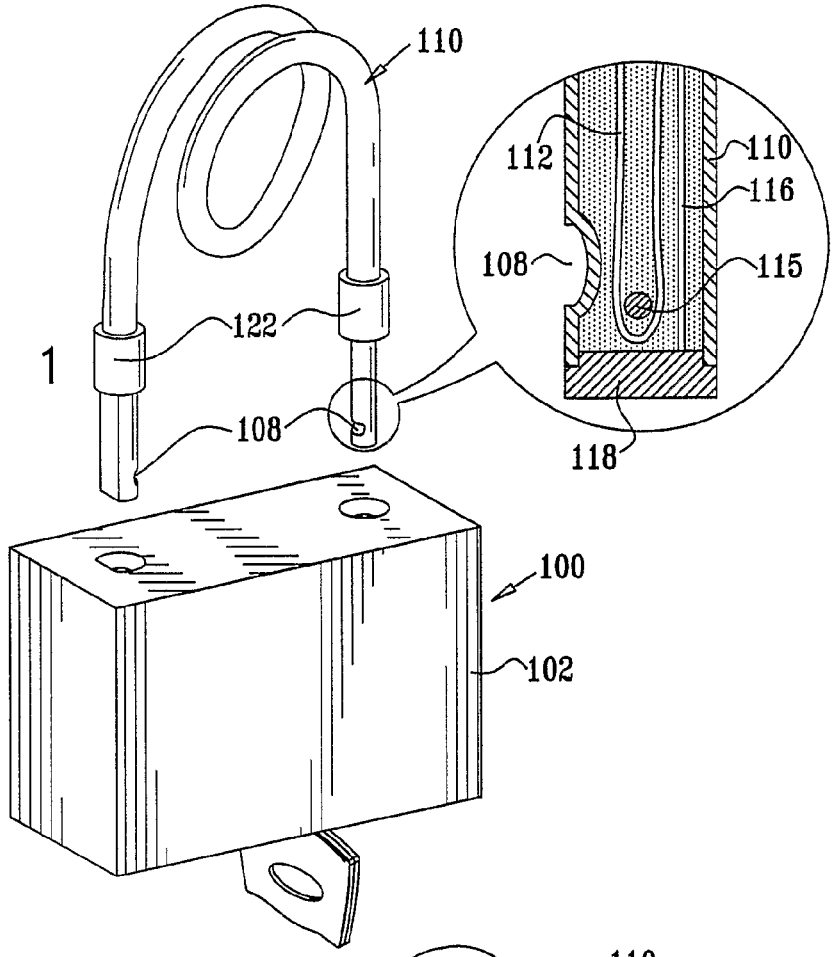
FIG. 1 is a simplified pictorial illustration of a key operated monitored locking assembly constructed and operative in accordance with a preferred embodiment of the present invention in an open orientation.
Figure 2:
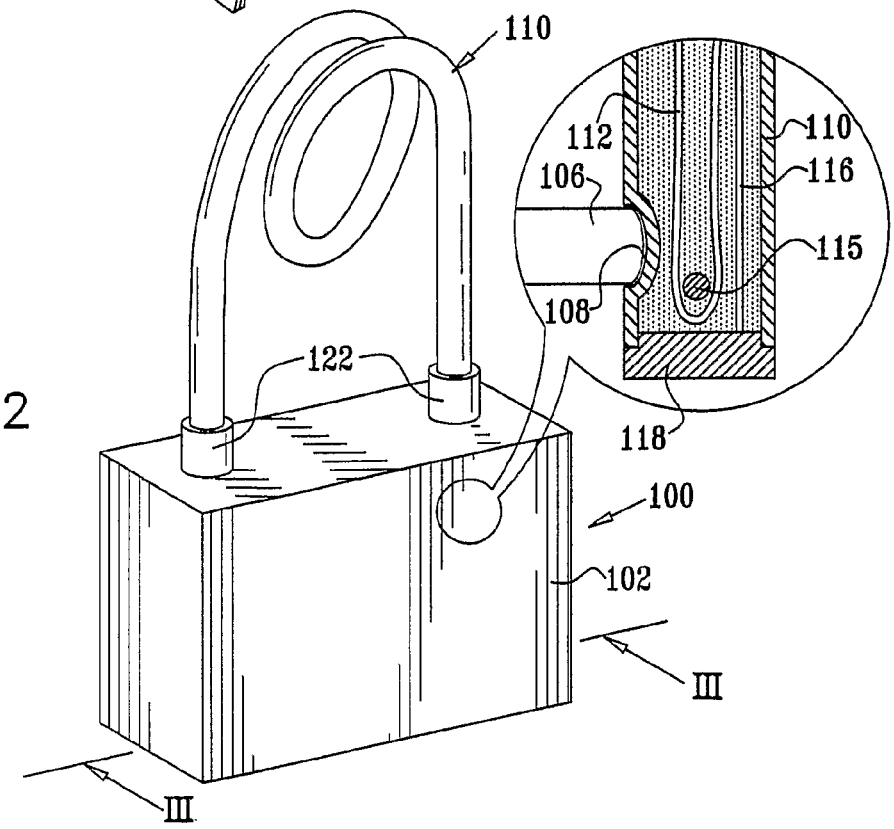
FIG. 2 is a simplified pictorial illustration of the key operated monitored locking assembly of FIG. 1 in a closed orientation.
Figure 3:
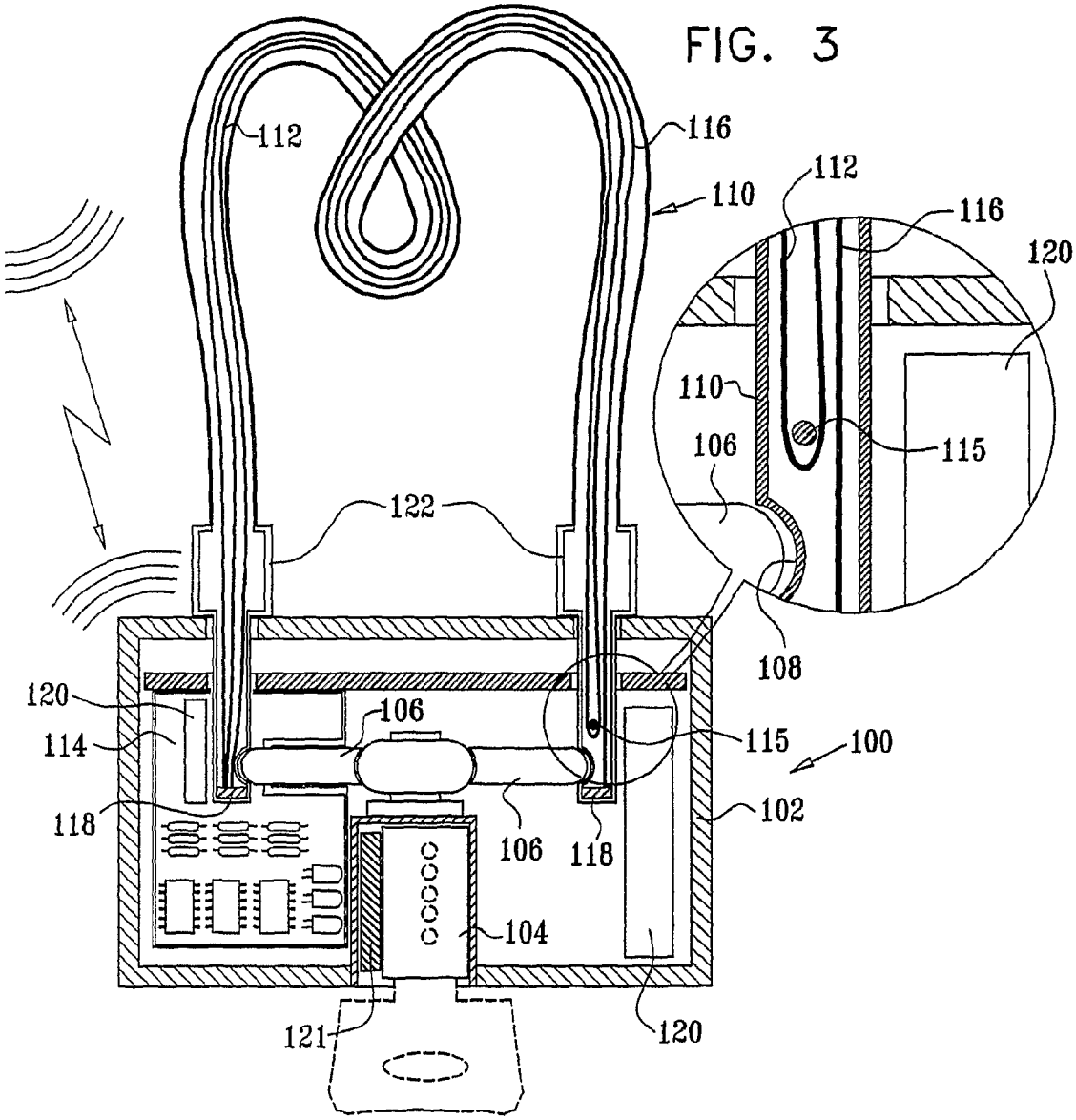
FIG. 3 is a sectional illustration taken along section lines III-III in FIG. 2.

Reference is now made to FIGS. 1-3, which illustrate a key operated monitored locking assembly constructed and operative in accordance with a preferred embodiment of the present invention. As seen in FIGS. 1-3, a key-operated lock 100, such as a conventional, key-operated padlock, includes a housing 102, which is preferably reinforced, and a key-operated cylinder 104 disposed therewithin. Cylinder 104 selectably positions locking elements 106, which selectably lockingly engage detents 108 formed in sides of a preferably flexible, doubly-monitorable sealing wire assembly 110, for locking the sealing wire assembly 110 with respect to the lock 100. The cylinder 104 may be operated by a mechanical key, an electronic key or a key which employs both mechanical and electronic components. Doubly-monitorable sealing wire assembly 110 preferably includes a first conductor 112, preferably arranged in a loop extending therealong and forming an electrical circuit whose integrity is monitorable by electrical circuitry 114 disposed within the key-operated lock 100, such that cutting or otherwise breaking the sealing wire assembly 110 produces an indication of tampering. The looped end of conductor 112 is preferably disposed about a retaining element 115, such that in a case of tampering, when conductor 112 is exposed it cannot be removed from doubly-monitorable sealing wire assembly 110 without being cut, producing an indication of tampering.

Preferably, doubly-monitorable sealing wire assembly 110 also includes a second conductor 116, which may or may not be arranged in a loop and define an electrical circuit, and additionally or alternatively one or more magnets or other monitorable elements 118, whose presence at a predetermined location with respect to one or more detectors 120 located within the housing 102 can be monitored. Monitoring of displacement of conductor 116 and/or elements 118 from the predetermined location thereof can provide an indication of authorized or unauthorized opening of the lock, as well as of closing thereof. An additional indication of authorized or unauthorized opening of the lock is preferably provided by a sensor 121 which is mounted adjacent cylinder 104.

Preferably electrical circuitry 114 also includes wireless communication circuitry which is operative to provide an indication of the locked/unlocked, and tamper status of the monitored locking assembly to a remote monitoring station (not shown).

In the embodiment of FIGS. 1-3, the sealing wire assembly 110 is designed to be entirely removable from the key-operated lock 100 and includes collar portions 122, spaced from detents 108 by predetermined distances to ensure correct placement of the detents 108 within the lock 100, when the sealing wire assembly 110 is to be locked in the lock 100. Preferably, below collar portions 122 one side of the sealing wire assembly 110 has a different shape than the other side of the sealing wire, to prevent incorrect insertion of sealing wire assembly 110 into housing 102.

Figure 4:
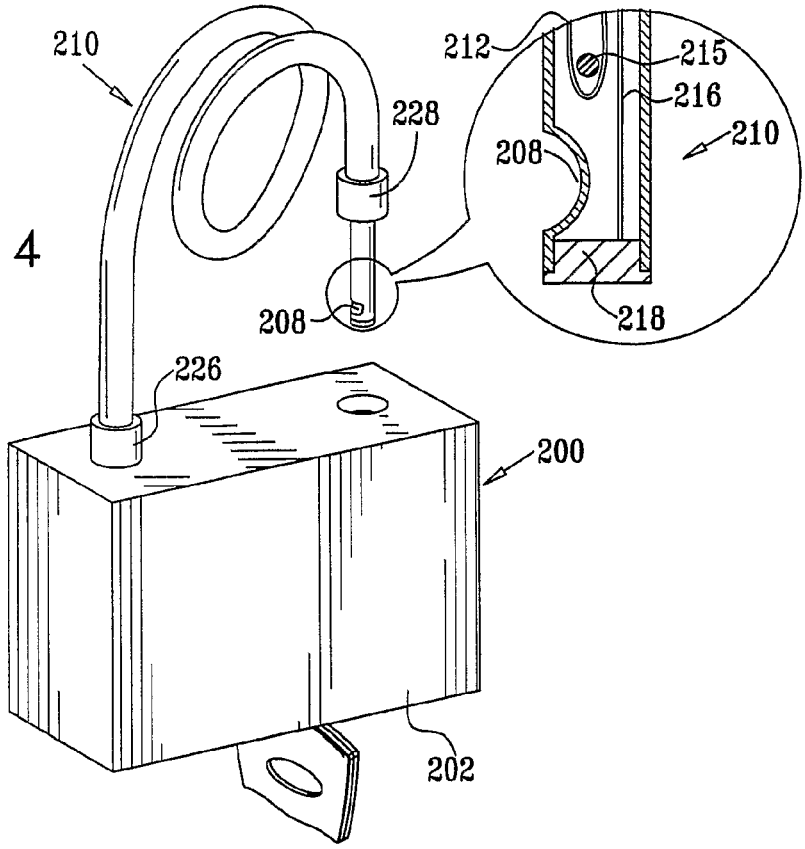
FIG. 4 is a simplified pictorial illustration of a key operated monitored locking assembly constructed and operative in accordance with another preferred embodiment of the present invention in an open orientation.
Figure 5:
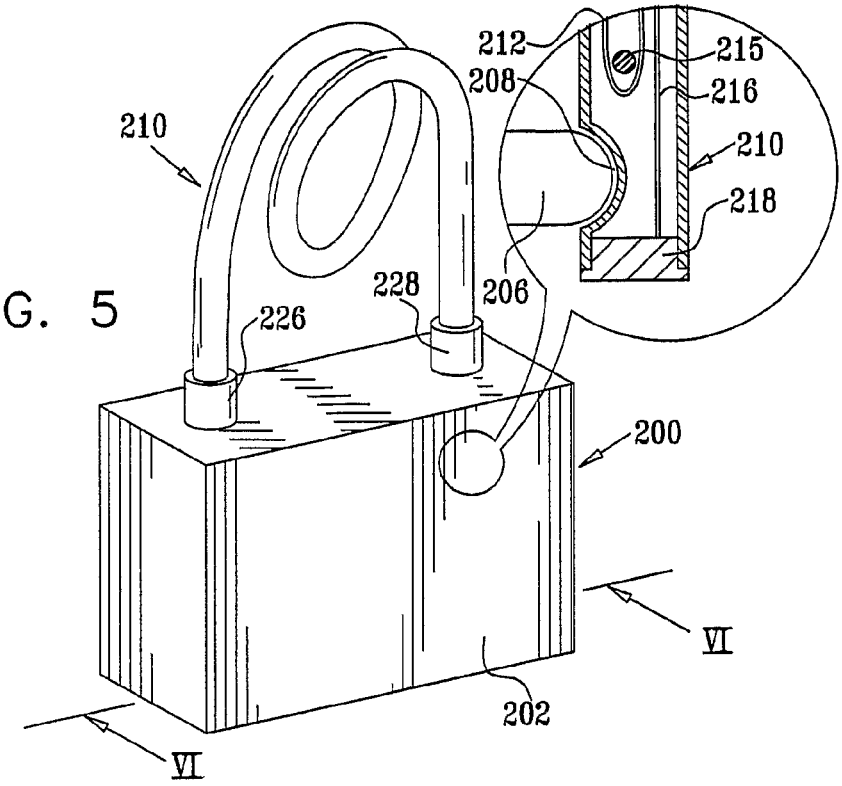
FIG. 5 is a simplified pictorial illustration of the key operated monitored locking assembly of FIG. 4 in a closed orientation.
Figure 6:
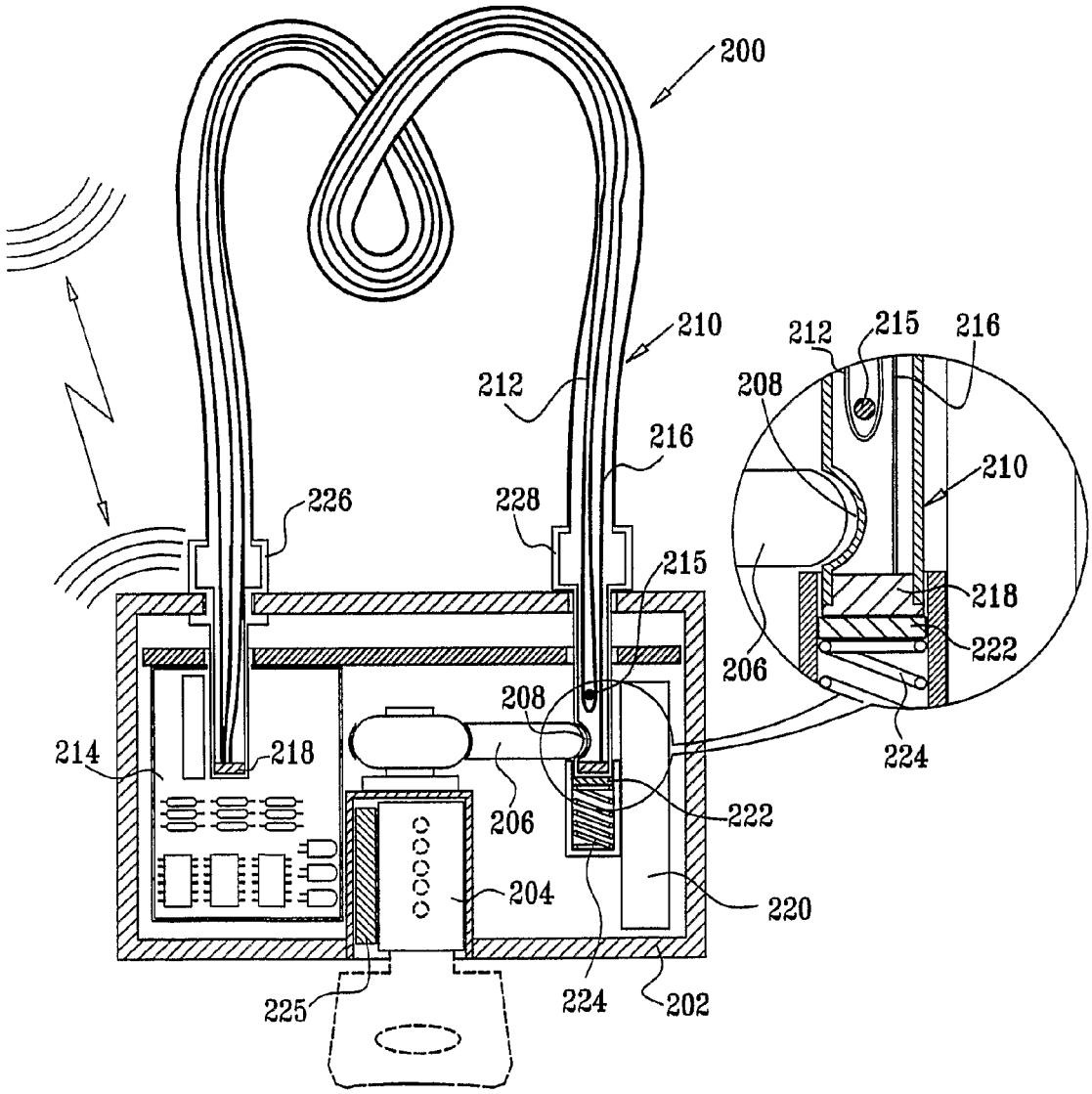
FIG. 6 is a sectional illustration taken along section lines VI-VI in FIG. 5.

Reference is now made to FIGS. 4-6, which illustrate a key operated monitored locking assembly constructed and operative in accordance with another preferred embodiment of the present invention. As seen in FIGS. 4-6, a key-operated lock 200, such as a conventional, key-operated padlock, includes a housing 202, which is preferably reinforced, and a key-operated cylinder 204 disposed therewithin. Cylinder 204 selectably positions a locking element 206, which selectably lockingly engages a detent 208 formed in one side of a preferably flexible, doubly-monitorable sealing wire assembly 210, for locking the sealing wire assembly 210 with respect to the lock 200. The cylinder 204 may be operated by a mechanical key, an electronic key or a key which employs both mechanical and electronic components.

Doubly-monitorable sealing wire assembly 210 preferably includes a first conductor 212, preferably arranged in a loop extending therealong and forming an electrical circuit whose integrity is monitorable by electrical circuitry 214 disposed within the key-operated lock 200, such that cutting or otherwise breaking the sealing wire assembly 210 produces an indication of tampering. The looped end of conductor 212 is preferably disposed about a retaining element 215, such that in a case of tampering, when conductor 212 is exposed it cannot be removed from doubly-monitorable sealing wire assembly 210 without being cut, producing an indication of tampering.

Preferably, doubly-monitorable sealing wire assembly 210 also includes a second conductor 216, which may or may not be arranged in a loop and define an electrical circuit, and additionally or alternatively one or more magnets or other monitorable elements 218, whose presence at a predetermined location with respect to a detector 220 located within the housing 202 can be monitored. Monitoring of magnet 218 is provided by a second magnet 222, which is preferably disposed on a spring element 224 below monitorable element 218. Spring element 224 is operative to ensure magnetic contact between magnet 218 and magnet 222 while the locking assembly 200 is locked.

Monitoring of displacement of conductor 216 from the predetermined location thereof and/or detachment of magnet 218 from magnet 222 can provide an indication of authorized or unauthorized opening of the lock, as well as of closing thereof. An additional indication of authorized or unauthorized opening of the lock is preferably provided by a sensor 225 which is mounted adjacent cylinder 204.

Preferably electrical circuitry 214 also includes wireless communication circuitry which is operative to provide an indication of the locked/unlocked, and tamper status of the monitored locking assembly to a remote monitoring station (not shown).

In the embodiment of FIGS. 4-6, the sealing wire assembly 210 is designed to be tethered at one end to the key-operated lock 200 and includes a collar portion 226 which engages housing 202 and defines a tether, and a second collar portion 228 which is similar to collar portions 122 (FIGS. 1-3). Collar portion 228 is spaced from detent 208 by a predetermined distance to ensure correct placement of the detent 208 within the lock 200, when the sealing wire assembly 210 is to be locked in the lock 200.

Figure 7:
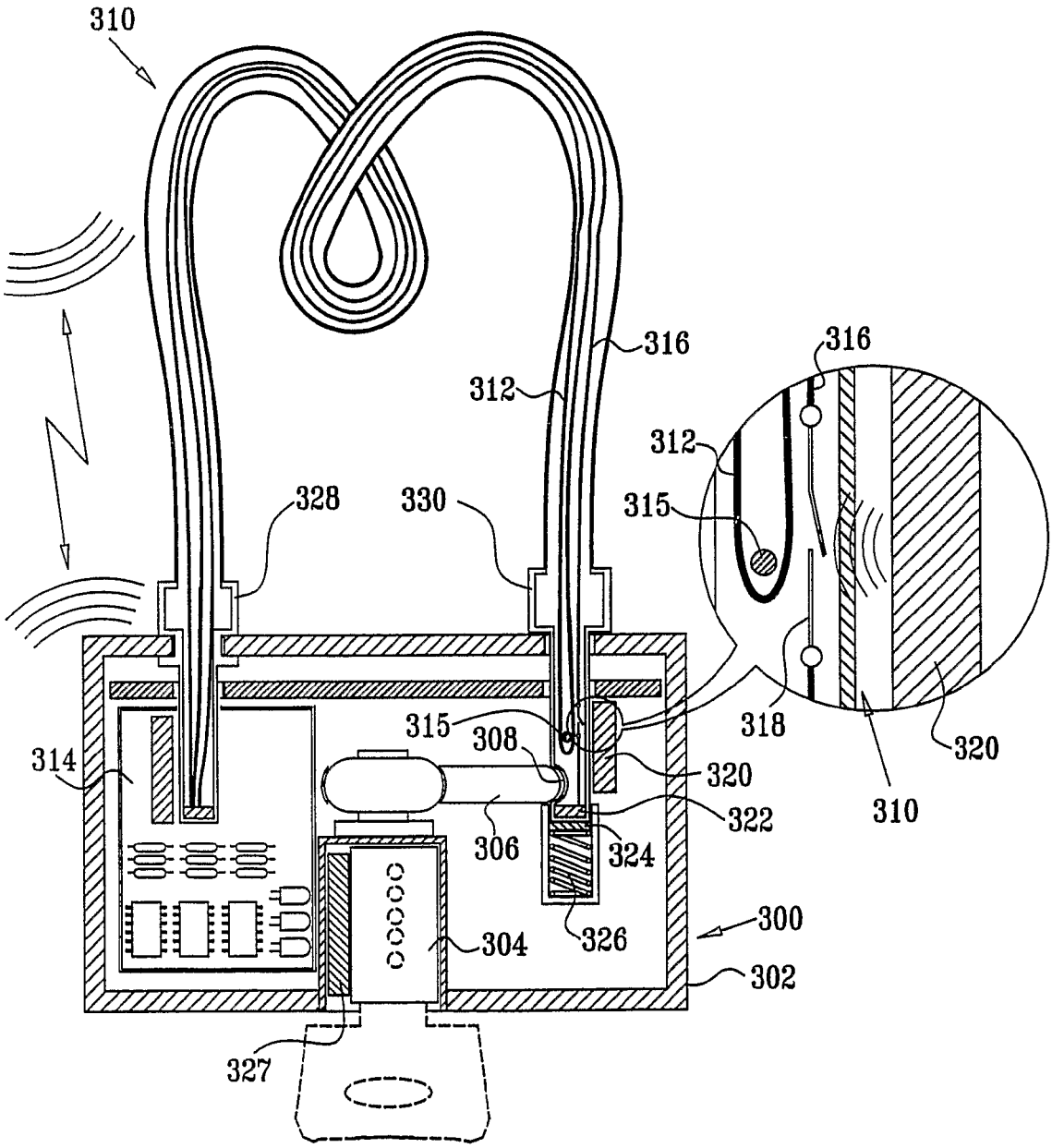
FIG. 7 is a sectional illustration of a key operated monitored locking assembly constructed and operative in accordance with yet another preferred embodiment of the present invention.

Reference is now made to FIG. 7, which illustrates a key operated monitored locking assembly constructed and operative in accordance with yet another preferred embodiment of the present invention. Similarly to the embodiment shown in FIGS. 4-6, a key-operated lock 300, such as a conventional, key-operated padlock, includes a housing 302, which is preferably reinforced, and a key-operated cylinder 304 disposed therewithin. Cylinder 304 selectably positions a locking element 306, which selectably lockingly engages a detent 308 formed in one side of a preferably flexible, doubly-monitorable sealing wire assembly 310 for locking the sealing wire assembly 310 with respect to the lock 300. The cylinder 304 may be operated by a mechanical key, an electronic key or a key which employs both mechanical and electronic components.

Doubly-monitorable sealing wire assembly 310 preferably includes a first conductor 312, preferably arranged in a loop extending therealong and forming an electrical circuit whose integrity is monitorable by electrical circuitry 314 disposed within the key-operated lock 300, such that cutting or otherwise breaking the sealing wire assembly 310 produces an indication of tampering. The looped end of conductor 312 is preferably disposed about a retaining element 315, such that in a case of tampering, when conductor 312 is exposed it cannot be removed from doubly-monitorable sealing wire assembly 310 without being cut, producing an indication of tampering.

Preferably, doubly-monitorable sealing wire assembly 310 also includes a second conductor 316, which may or may not be arranged in a loop and define an electrical circuit in series with a reed switch 318, whose presence at a predetermined location with respect to a magnet 320 located within the housing 302 can be monitored. Monitoring of displacement of conductor 316 and reed switch 318 from the predetermined location thereof can provide an indication of authorized or unauthorized opening of the lock, as well as of closing thereof.

An additional indication of authorized or unauthorized opening of the lock as well as closing thereof is preferably provided by a magnet 322 disposed at a predetermined location at the end of conductor 316, whose presence at a predetermined location with respect to a second magnet 324 can be monitored. Second magnet 324 is preferably disposed on a spring element 326 below magnet 322. Spring element 326 is operative to ensure magnetic contact between magnet 322 and magnet 324 while the locking assembly 300 is locked. A further indication of authorized or unauthorized opening of the lock is preferably provided by a sensor 327 which is mounted adjacent cylinder 304.

Preferably electrical circuitry 314 also includes wireless communication circuitry which is operative to provide an indication of the locked/unlocked, and tamper status of the monitored locking assembly to a remote monitoring station (not shown).

In the embodiment of FIG. 7, the sealing wire assembly 310 is designed to be tethered at one end to the key-operated lock 300 and includes a collar portion 328 which engages housing 302 and defines a tether and a second collar portion 330, which is similar to collar portions 122 (FIGS. 1-3). Collar portion 330 is spaced from detent 308 by a predetermined distance to ensure correct placement of the detent 308 within the lock 300, when the sealing wire assembly 310 is to be locked in the lock 300.

Figure 8:
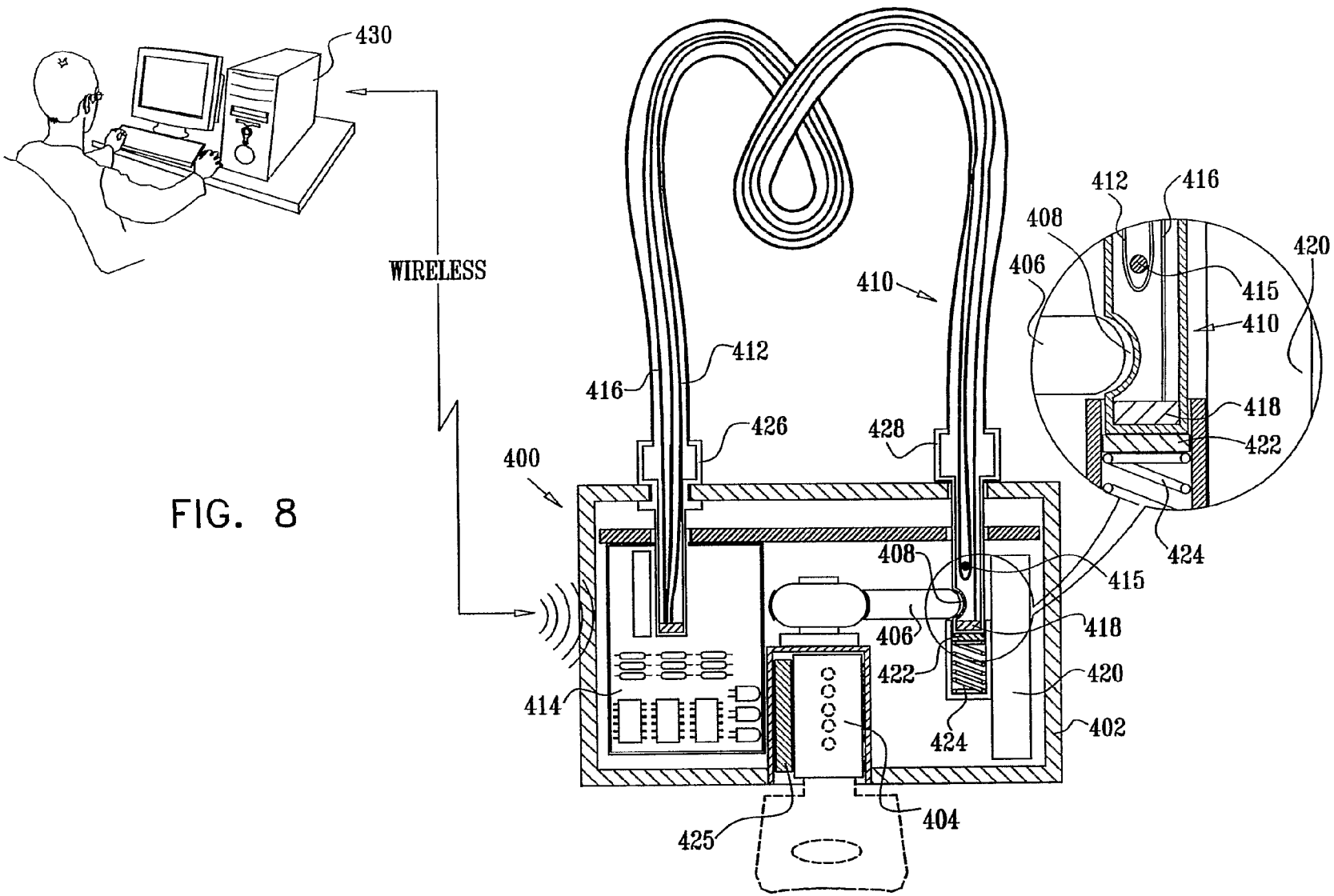
FIG. 8 is a simplified pictorial illustration of a key operated monitored locking assembly constructed and operative in accordance with still another preferred embodiment of the present invention.

Reference is now made to FIG. 8, which illustrates a key operated monitored locking assembly constructed and operative in accordance with still another preferred embodiment of the present invention. Similarly to the embodiment shown in FIGS. 4-6, a key-operated lock 400, such as a conventional, key-operated padlock, includes a housing 402, which is preferably reinforced, and a key-operated cylinder 404 disposed therewithin. Cylinder 404 selectably positions a single locking element 406, which selectably lockingly engages a detent 408 formed in one side of a preferably flexible, doubly-monitorable sealing wire assembly 410 for locking the sealing wire assembly 410 with respect to the lock 400. The cylinder 404 may be operated by a mechanical key, an electronic key or a key which employs both mechanical and electronic components.

Doubly-monitorable sealing wire assembly 410 preferably includes a first conductor 412, preferably arranged in a loop extending therealong and forming an electrical circuit whose integrity is monitorable by electrical circuitry 414 disposed within the key-operated lock 400, such that cutting or otherwise breaking the sealing wire assembly 410 produces an indication of tampering. The looped end of conductor 412 is preferably disposed about a retaining element 415, such that in a case of tampering, when conductor 412 is exposed it cannot be removed from doubly-monitorable sealing wire assembly 410 without being cut, producing an indication of tampering.

Preferably, doubly-monitorable sealing wire assembly 410 also includes a second conductor 416, which may or may not be arranged in a loop and define an electrical circuit, and additionally or alternatively one or more magnets or other monitorable elements 418, whose presence at a predetermined location with respect to a detector 420 located within the housing 402 can be monitored. Monitoring of magnet 418 is provided by a second magnet 422, which is preferably disposed on a spring element 424 below magnet 418. Spring element 424 is operative to ensure magnetic contact between magnet 418 and magnet 422 while the locking assembly 400 is locked. An additional indication of authorized or unauthorized opening of the lock is preferably provided by a sensor 425 which is mounted adjacent cylinder 404.

Preferably electrical circuitry 414 also includes wireless communication circuitry which is operative to provide an indication of the locked/unlocked, and tamper status of the monitored locking assembly to a remote monitoring station (not shown).

In the embodiment of FIG. 8, the sealing wire assembly 410 is designed to be tethered at one end to the key-operated lock 400 and includes a collar portion 426 which engages housing 402 and defines a tether, and a second collar portion 428 which is similar to collar portions 122 (FIGS. 1-3). Collar portion 428 is spaced from detent 408 by a predetermined distance to ensure correct placement of the detent 408 within the lock 400, when the sealing wire assembly 410 is to be locked in the lock 400.

It is appreciated that in the embodiment of FIG. 8, a user may only open the sealing wire assembly 410 by operating the key after a wireless authorization communication is received by circuitry 414 from a remote computer 430.

Figure 9:
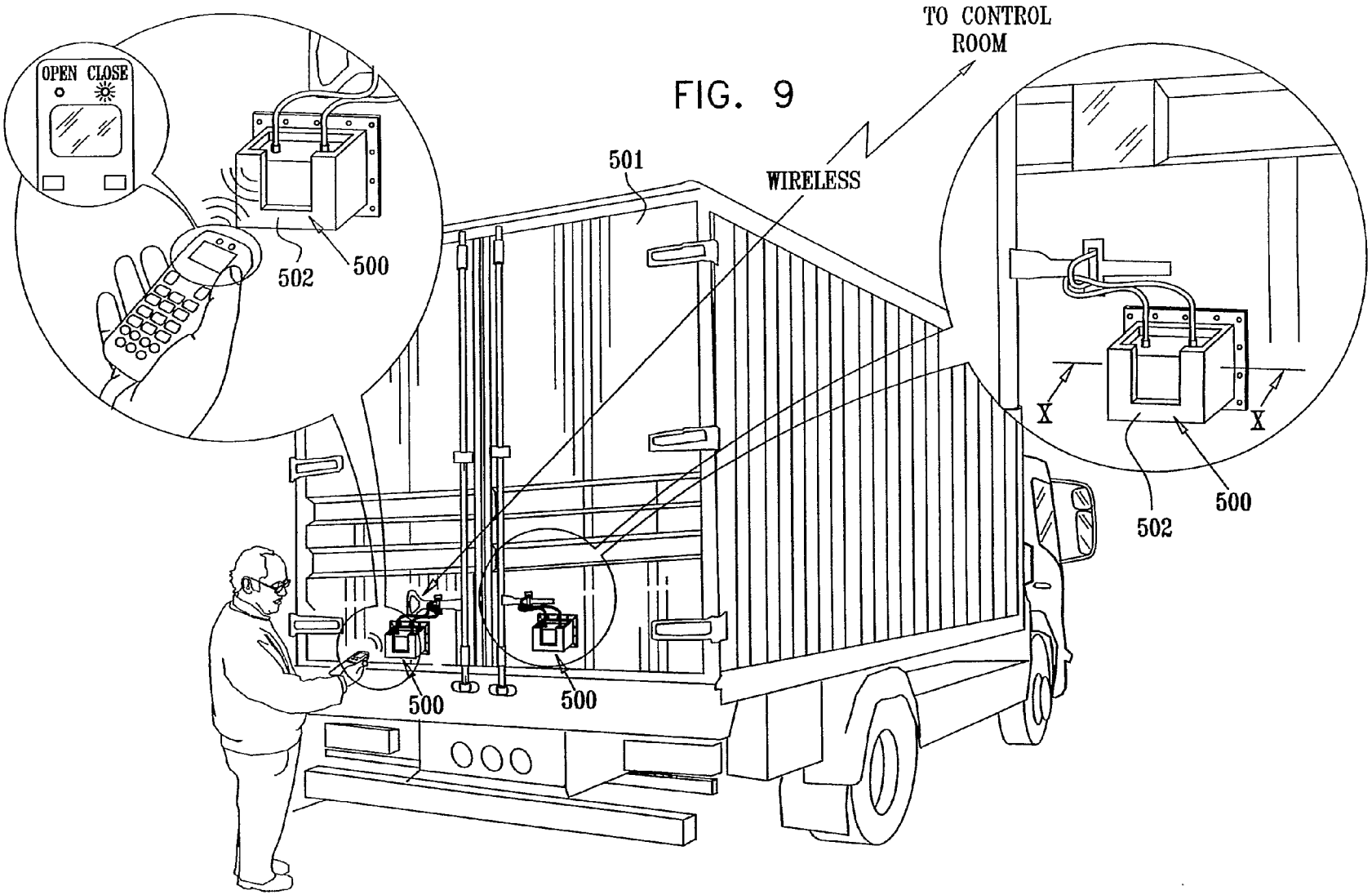
FIG. 9 is a simplified pictorial illustration of a shipping container equipped with a monitorable locking assembly in accordance with a preferred embodiment of the present invention.
Figure 10:
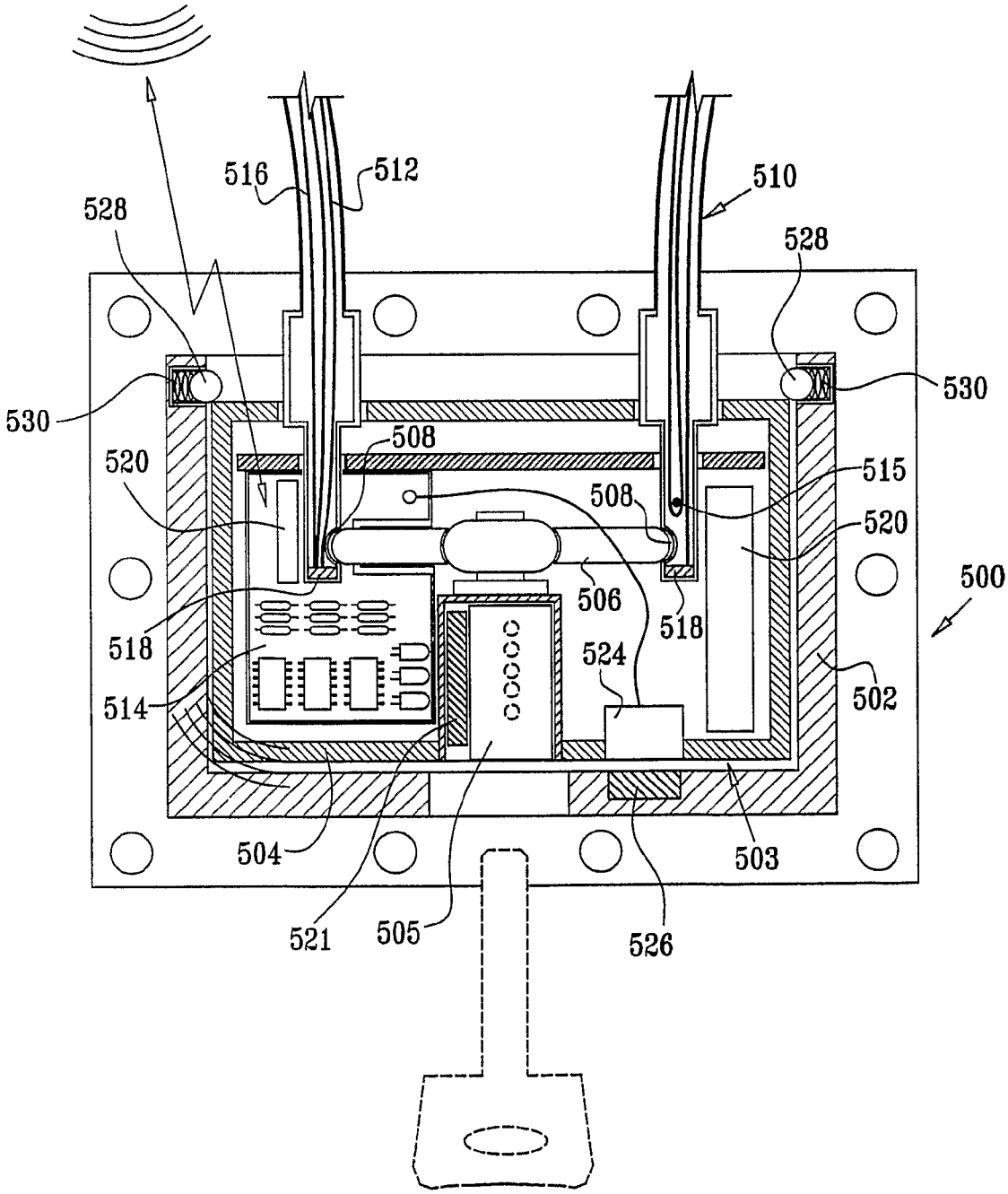
FIG. 10 is a sectional illustration of the monitorable locking assembly of FIG. 9, taken along section lines X-X in FIG. 9.

Reference is now made to FIGS. 9 and 10, which illustrate a shipping container equipped with a monitorable locking assembly in accordance with a preferred embodiment of the present invention. As seen in FIGS. 9 and 10, monitoring locking assemblies 500 are removably mounted on the outside of a shipping container 501 such that their sealing wires lock the doors of the containers. The locking assemblies 500 are preferably the doubly monitorable locking assemblies described hereinabove with reference to any of FIGS. 1-8, which communicate with remote monitoring installations, but preferably also include a locking assembly placement sensor which senses that the locking assembly 500 is properly placed in a holder 502 attached to the shipping container 501.

A preferred monitorable locking assembly is shown in FIG. 10 and comprises a key-operated lock 503, such as a conventional, key-operated padlock, which includes a housing 504, which is preferably reinforced, and a key-operated cylinder 505 disposed therewithin. Cylinder 505 selectably positions locking elements 506, which selectably lockingly engage detents 508 formed in sides of a doubly-monitorable sealing wire assembly 510 for locking the sealing wire assembly 510 with respect to the lock 503. The cylinder 505 may be operated by a mechanical key, an electronic key or a key which employs both mechanical and electronic components.

Doubly-monitorable sealing wire assembly 510 preferably includes a first conductor 512, preferably arranged in a loop extending therealong and forming an electrical circuit whose integrity is monitorable by electrical circuitry 514 disposed within the key-operated lock 503, such that cutting or otherwise breaking the sealing wire assembly 510 produces an indication of tampering. The looped end of conductor 512 is preferably disposed about a retaining element 515, such that in a case of tampering, when conductor 512 is exposed it cannot be removed from doubly-monitorable sealing wire assembly 510 without being cut, producing an indication of tampering.

Preferably, doubly-monitorable sealing wire assembly 510 also includes a second conductor 516, which may or may not be arranged in a loop and defines an electrical circuit, and additionally or alternatively one or more magnets or other monitorable elements 518, whose presence at a predetermined location with respect to at least one detector 520 located within the housing 504 can be monitored. Monitoring of displacement of conductor 516 and/or elements 518 from the predetermined location thereof can provide an indication of authorized or unauthorized opening of the lock, as well as of closing thereof. An additional indication of authorized or unauthorized opening of the lock is preferably provided by a sensor 521 which is mounted adjacent cylinder 505.

Preferably a locking assembly placement sensor 524 senses that the lock 503 is properly placed in holder 502 attached to the shipping container 501. Sensor 524 may be a magnet sensor, which senses the propinquity of a magnet 526, incorporated in holder 502, a reed switch incorporated in holder 502 which senses the propinquity of a magnet, an RFID sensor, a sensor which senses a protective communication code which is interactive with handshake or any other suitable sensor. Sensor 524 preferably provides an output to circuitry 514 which enables the location of the locking assembly in the holder 502 to be remotely monitored by transmission of the output of sensor 524 to a remote monitoring installation.

Lock 503 is maintained in place with respect to holder 502 by a pair of pins 528 which extend transversely from holder 502, and which are biased by a pair of springs 530. In a normal state, springs 530 bias pins 528 outwardly such that pins 528 pressurize housing 504 and maintain it in place. A user wanting to remove lock 503 from holder 502 can push pins 528 toward holder 502 against the biasing of springs 530, thus releasing the lock 503.

Figure 11A:
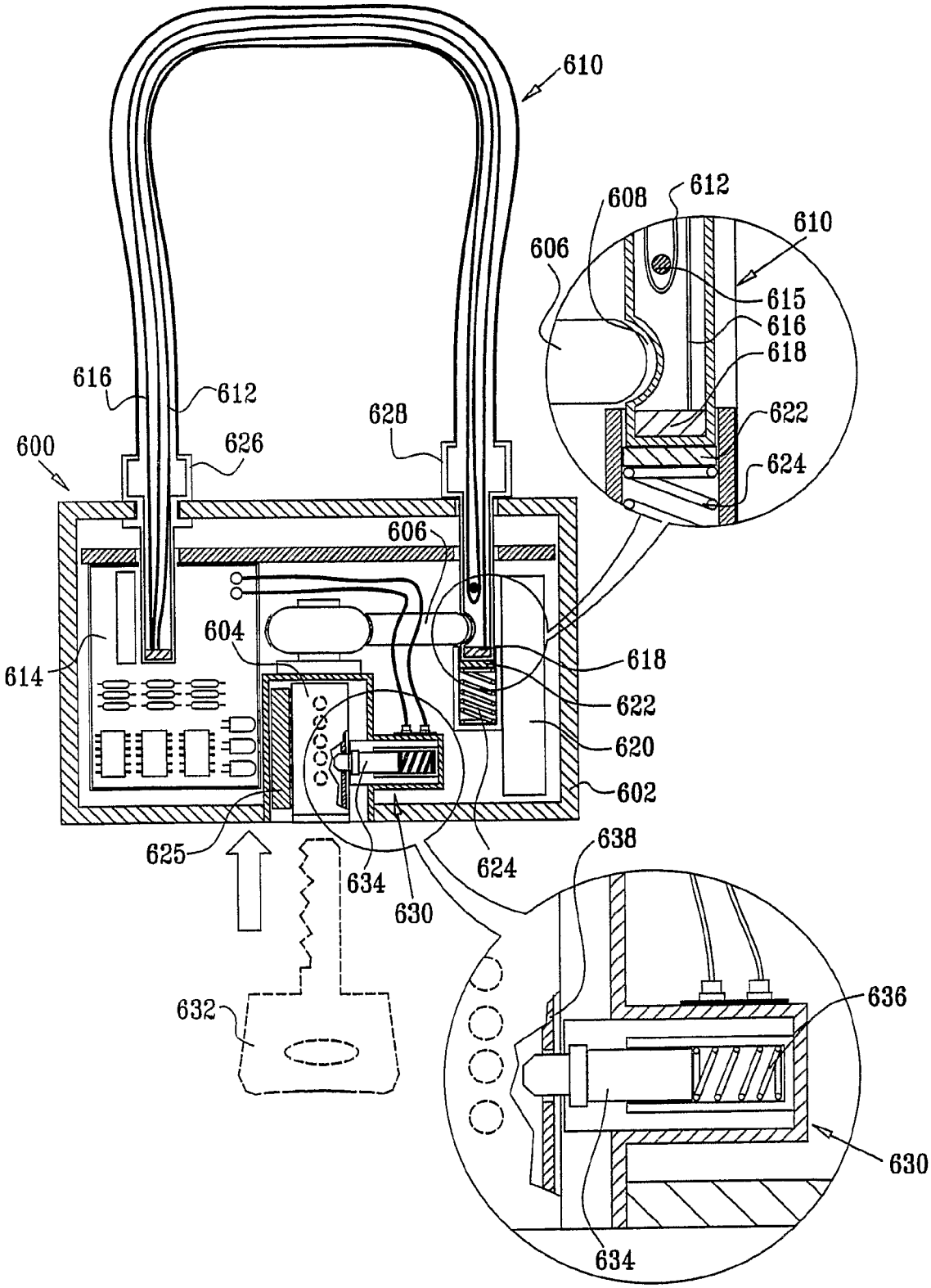
FIGS. 11A and 11B are sectional illustrations of a locking assembly of the type of any of FIGS. 1-10 and including a key insertion sensor.
Figure 11B:
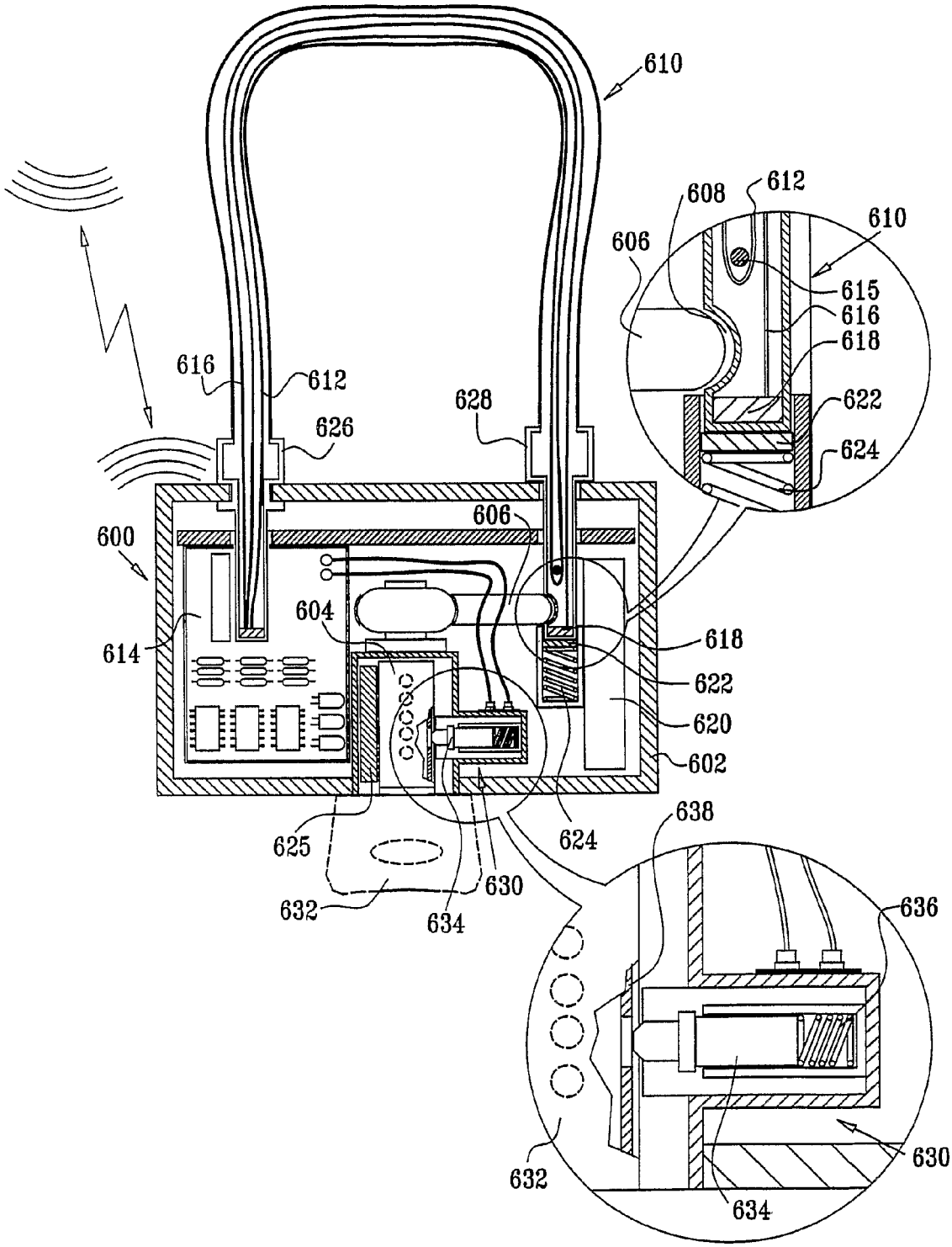

Reference is now made to FIGS. 11A and 11B, which illustrate a locking assembly of the type shown in any of FIGS. 1-10 which also incorporates a key insertion sensor which senses whether a key is inserted in a cylinder forming part of the locking assembly. As seen in FIGS. 11A and 11B, a key-operated lock 600, such as a conventional, key-operated padlock, includes a housing 602, which is preferably reinforced, and a key-operated cylinder 604 disposed therewithin. Cylinder 604 selectably positions a locking element 606 which selectably lockingly engages a detent 608 formed in one side of a doubly-monitorable sealing wire assembly 610 for locking the sealing wire assembly 610 with respect to the lock 600. The cylinder 604 may be operated by a mechanical key, an electronic key or a key which employs both mechanical and electronic components.

Doubly-monitorable sealing wire assembly 610 preferably includes a first conductor 612, preferably arranged in a loop extending therealong and forming an electrical circuit whose integrity is monitorable by electrical circuitry 614 disposed within the key-operated lock 600, such that cutting or otherwise breaking the sealing wire assembly 610 produces an indication of tampering. The looped end of conductor 612 is preferably disposed about a retaining element 615, such that in a case of tampering, when conductor 612 is exposed it cannot be removed from doubly-monitorable sealing wire assembly 610 without being cut, thus preventing the possibility of tampering which is not indicated.

Preferably, doubly-monitorable sealing wire assembly 610 also includes a second conductor 616, which may or may not be arranged in a loop and which defines an electrical circuit, and additionally or alternatively one or more magnets or other monitorable elements 618, whose presence at a predetermined location with respect to a detector 620 located within the housing 602 can be monitored. Monitoring of magnet 618 is provided by a second magnet 622, which is preferably disposed on a spring element 624 below magnet 618 which is operative to ensure magnetic contact between magnet 618 and magnet 622 while the locking assembly 600 is locked. Additional indication of authorized or unauthorized opening of the lock is preferably provided by a sensor 625 which is mounted adjacent cylinder 604.

Preferably electrical circuitry 614 also includes wireless communication circuitry which is operative to provide an indication of the locked/unlocked, and tamper status of the monitored locking assembly to a remote monitoring station (not shown).

In the embodiment of FIGS. 11A and 11B, the sealing wire assembly 610 is designed to be tethered at one end to the key-operated lock 600 and includes a collar portion 626 which engages housing 602 and defines a tether, and a second collar portion 628 which is similar to collar portions 122 (FIGS. 1-3). Collar portion 628 is spaced from detent 608 a by predetermined distance to ensure correct placement of the detent 608 within the lock 600, when the sealing wire assembly 610 is to be locked in the lock 600.

A key insertion sensor 630 senses whether a key 632 is inserted in cylinder 604. The key insertion sensor 630 typically includes a pin 634, which is biased by a spring 636 and whose position is sensed by any suitable conventional sensing element 638. The output of sensing element 638 is preferably supplied to circuitry 614, which also includes wireless communication circuitry which is operative to provide an indication of the locked/unlocked, key insertion and tamper status of the monitored locking assembly to a remote monitoring station (not shown).

FIG. 11A shows a state prior to key insertion in cylinder 604, while FIG. 11B shows insertion of key 632 in cylinder 604. It is appreciated that monitoring the state of key insertion may enable a remote monitoring installation to know whether removal of the locking assembly was authorized or not.

Figure 12:
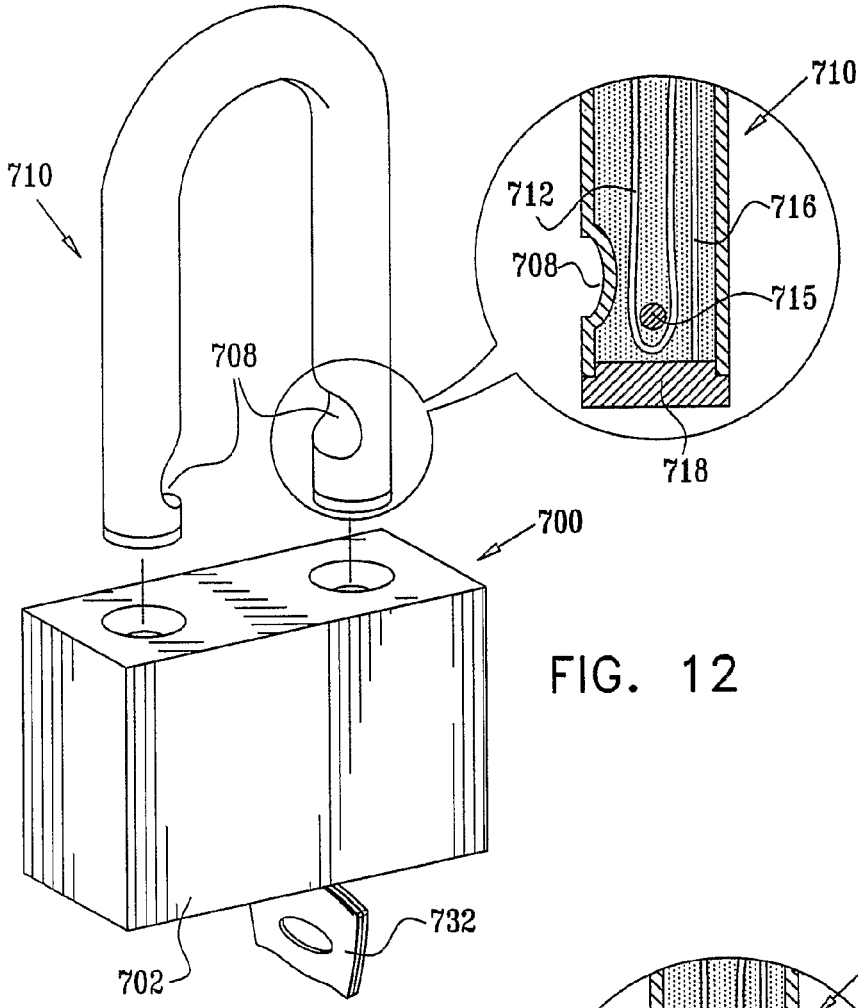
FIG. 12 is a simplified pictorial illustration of a remotely monitorable padlock constructed and operative in accordance with a preferred embodiment of the present invention in an open orientation.
Figure 13:
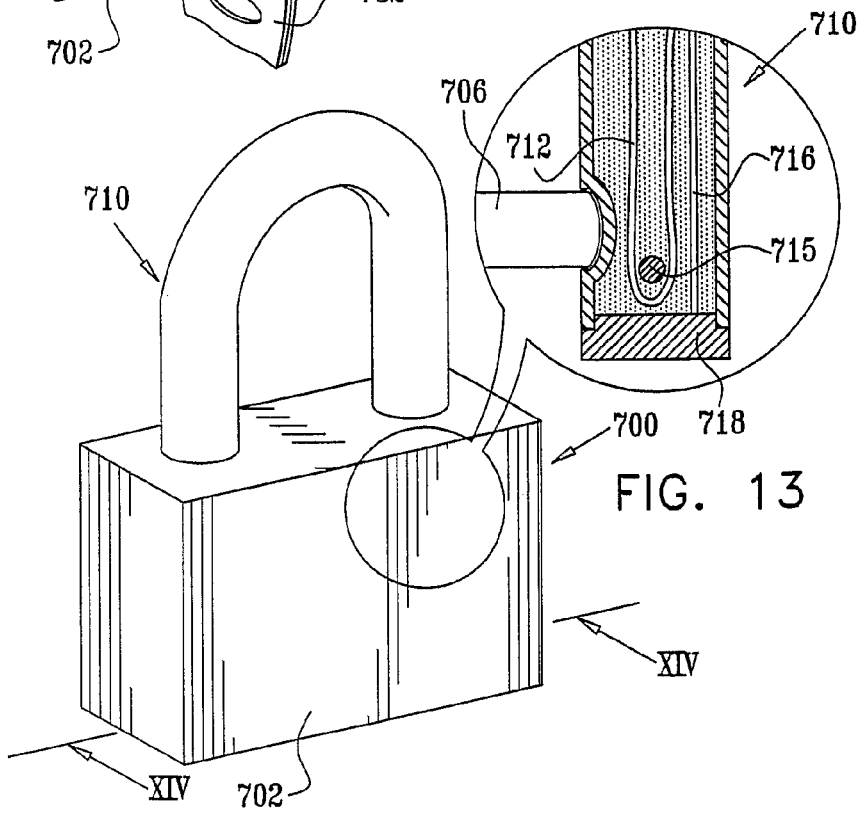
FIG. 13 is a simplified pictorial illustration of the remotely monitorable padlock of FIG. 12 in a closed orientation.
Figure 14:
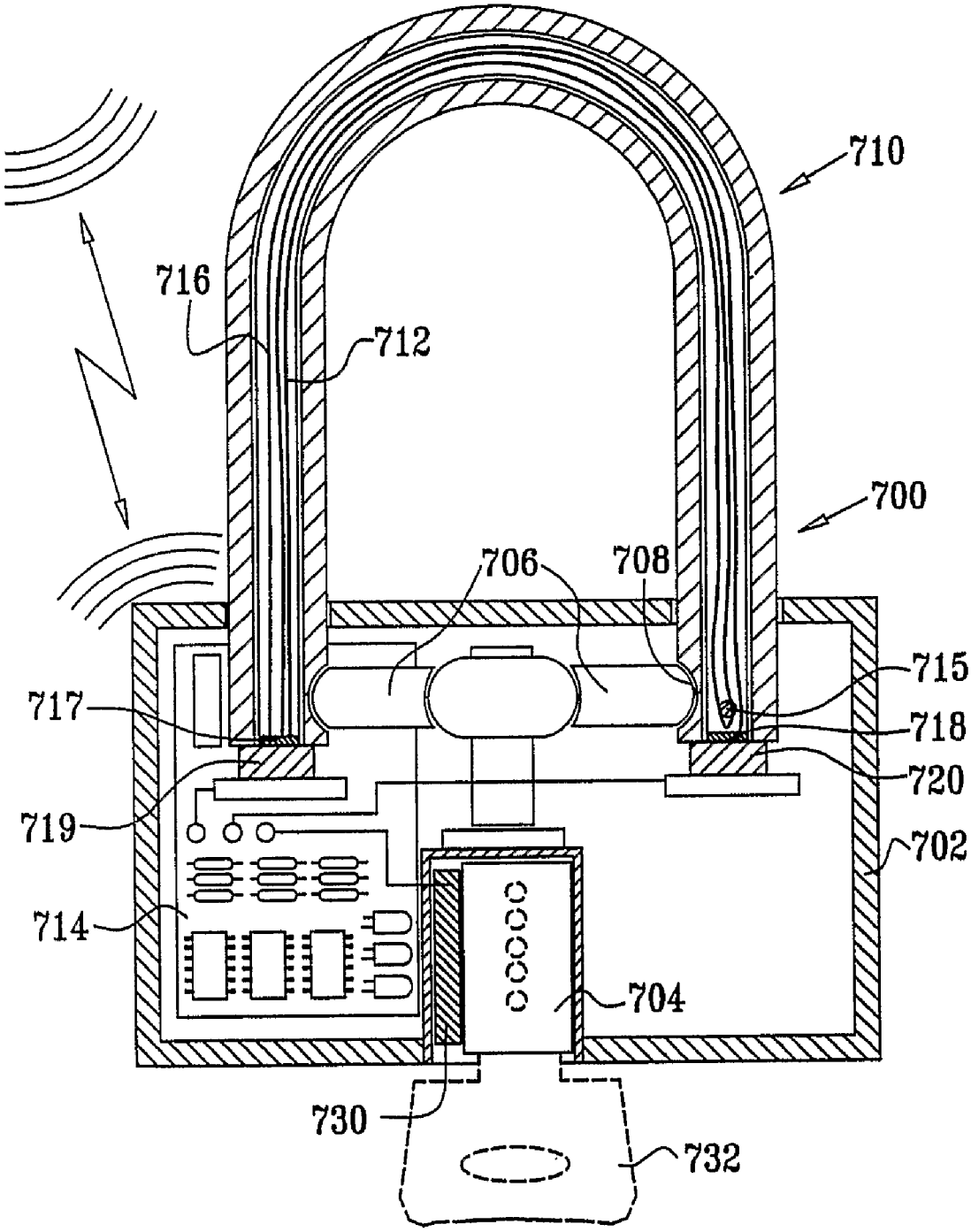
FIG. 14 is a sectional illustration taken along section lines XIV-XIV in FIG. 13.

Reference is now made to FIGS. 12, 13 and 14, which illustrate a remotely monitorable padlock constructed and operative in accordance with a preferred embodiment of the present invention. As seen in FIGS. 12-14, a key-operated lock 700, such as a conventional, key-operated padlock, includes a housing 702, which is preferably reinforced, and a key-operated cylinder 704 disposed therewithin. Cylinder 704 selectably positions locking elements 706 which selectably lockingly engage detents 708 formed in sides of a doubly-monitorable shackle assembly 710 for locking the shackle assembly 710 with respect to the lock 700. The cylinder 704 may be operated by a mechanical key, an electronic key or a key which employs both mechanical and electronic components.

Doubly-monitorable shackle assembly 710 preferably includes a first conductor 712, preferably arranged in a loop extending therealong and forming an electrical circuit whose integrity is monitorable by electrical circuitry 714 disposed within the key-operated lock 700, such that cutting or otherwise breaking the shackle assembly 710 produces an indication of tampering. The looped end of conductor 712 is preferably disposed about a retaining element 715, such that in a case of tampering, when conductor 712 is exposed it cannot be removed from doubly-monitorable sealing wire assembly 710 without being cut, thus preventing the possibility of tampering which is not indicated.

Preferably, doubly-monitorable shackle assembly 710 also includes a second conductor 716, which may or may not be arranged in a loop and define an electrical circuit, and additionally or alternatively one or more magnets or other monitorable elements 717 and 718, whose presence at a predetermined location with respect to detectors 719 and 720 located within the housing 702 can be monitored. Monitoring of displacement of conductor 716 and/or elements 717 and 718 from the predetermined location thereof can provide an indication of authorized or unauthorized opening of the lock, as well as of closing thereof.

A key insertion sensor 730 senses whether a key 732 is inserted in cylinder 704. The output of key insertion sensor 730 is preferably supplied to circuitry 714, which also includes wireless communication circuitry which is operative to provide an indication of the locked/unlocked, key insertion and tamper status of the monitored locking assembly to a remote monitoring station (not shown).

Figure 15:
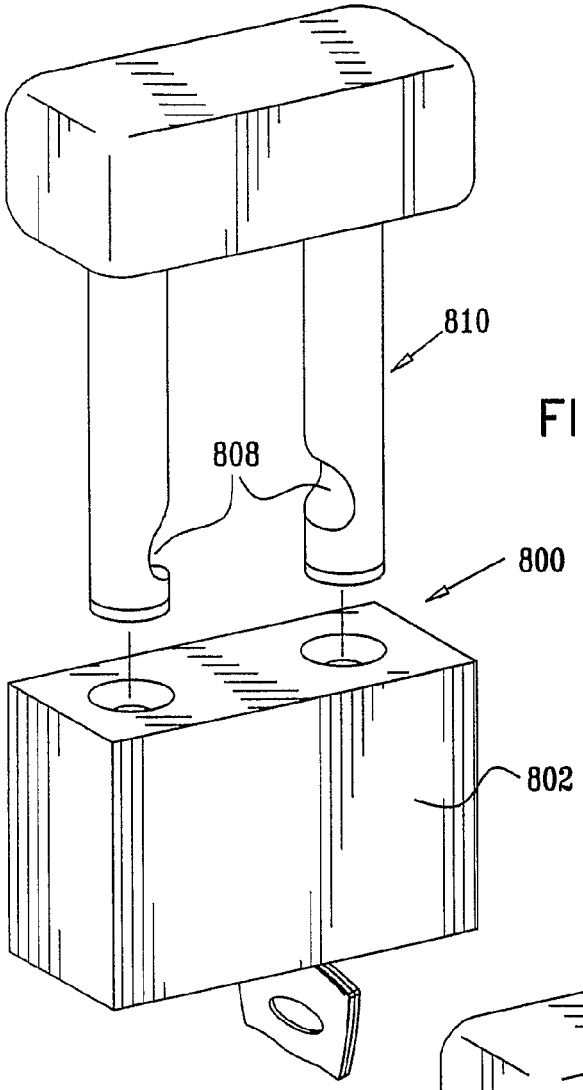
FIG. 15 is a simplified pictorial illustration of a remotely monitorable padlock constructed and operative in accordance with another preferred embodiment of the present invention in an open orientation.
Figure 16:
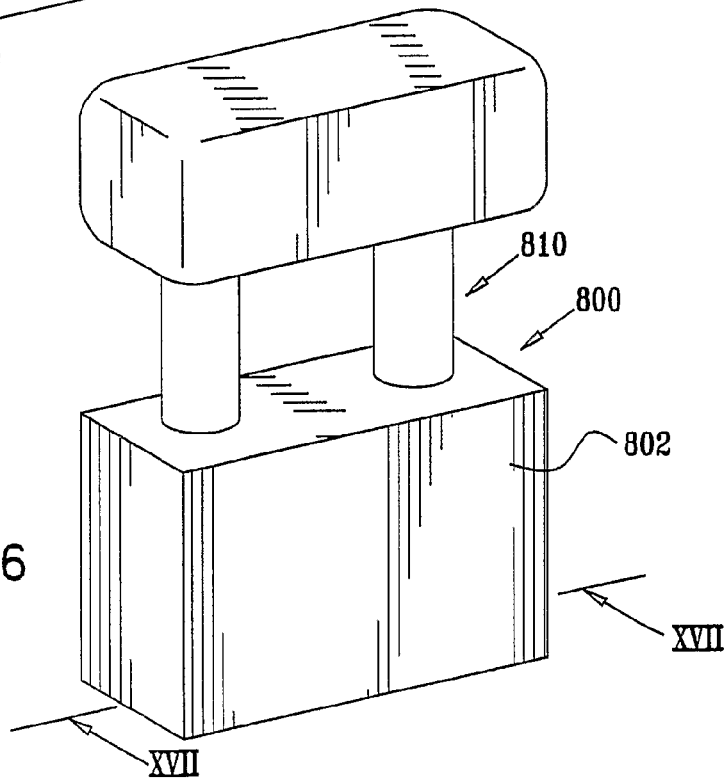
FIG. 16 is a simplified pictorial illustration of the remotely monitorable padlock of FIG. 15 in a closed orientation.
Figure 17:
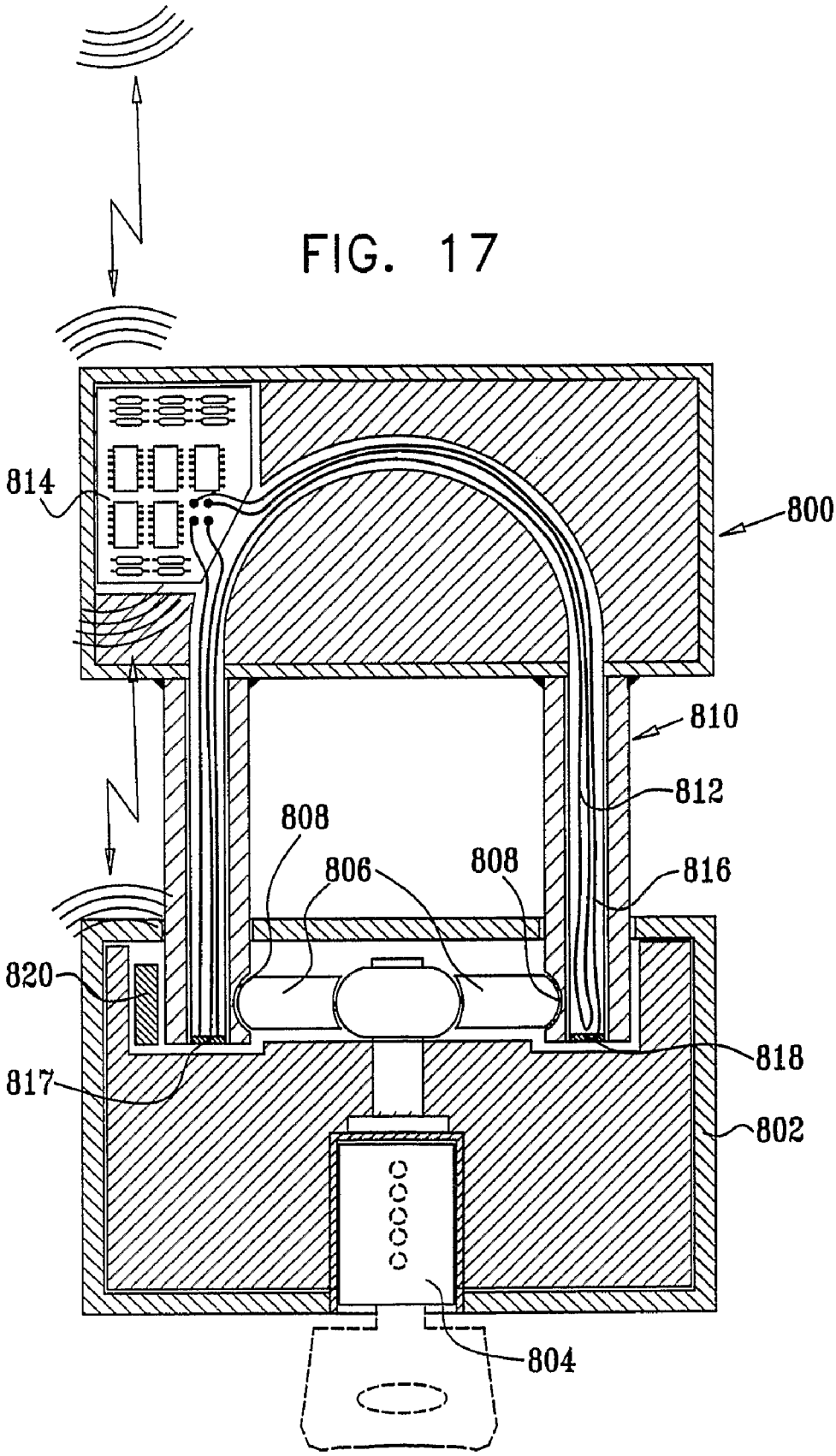
FIG. 17 is a sectional illustration taken along section lines XVII-XVII in FIG. 16.

Reference is now made to FIGS. 15, 16 and 17, which illustrate a remotely monitorable padlock constructed and operative in accordance with another preferred embodiment of the present invention. As seen in FIGS. 15-17, a key-operated lock 800, such as a conventional, key-operated padlock, includes a housing 802, which is preferably reinforced, and a key-operated cylinder 804 disposed therewithin. Cylinder 804 selectably positions locking elements 806 which selectably lockingly engage detents 808 formed in sides of a doubly-monitorable shackle 810 for locking the shackle assembly 810 with respect to the lock 800. The cylinder 804 may be operated by a mechanical key, an electronic key or a key which employs both mechanical and electronic components.

Doubly-monitorable shackle assembly 810 preferably includes a first conductor 812, preferably arranged in a loop extending therealong and forming an electrical circuit whose integrity is monitorable by electrical circuitry 814 disposed within the shackle assembly 810, such that cutting or otherwise breaking the shackle assembly 810 produces an indication of tampering. Preferably, doubly-monitorable shackle assembly 810 also includes a second conductor 816, which may or may not be arranged in a loop and define an electrical circuit, and additionally or alternatively one or more magnet sensors or other monitoring elements 817 and 818, whose presence at a predetermined location with respect to one or more magnets or similar propinquity indicating elements 820 located within the housing 802 can be monitored. Monitoring of displacement of conductor 816 and/or elements 817 and 818 from the predetermined location thereof can provide an indication of authorized or unauthorized opening of the lock, as well as of closing thereof. Typically, the monitored status of the locking assembly is wirelessly communicated from propinquity indicating elements 820 to circuitry 814.

Circuitry 814 preferably also includes wireless communication circuitry which is operative to provide an indication of the locked/unlocked and tamper status of the monitored locking assembly to a remote monitoring station (not shown).

Reference is now made to FIGS. 18-21B, which illustrate a monitorable locking assembly constructed and operative in accordance with a further embodiment of the present invention, used to protect various types of enclosures, such as, for example, tanker hatches and buildings.

Figure 18:
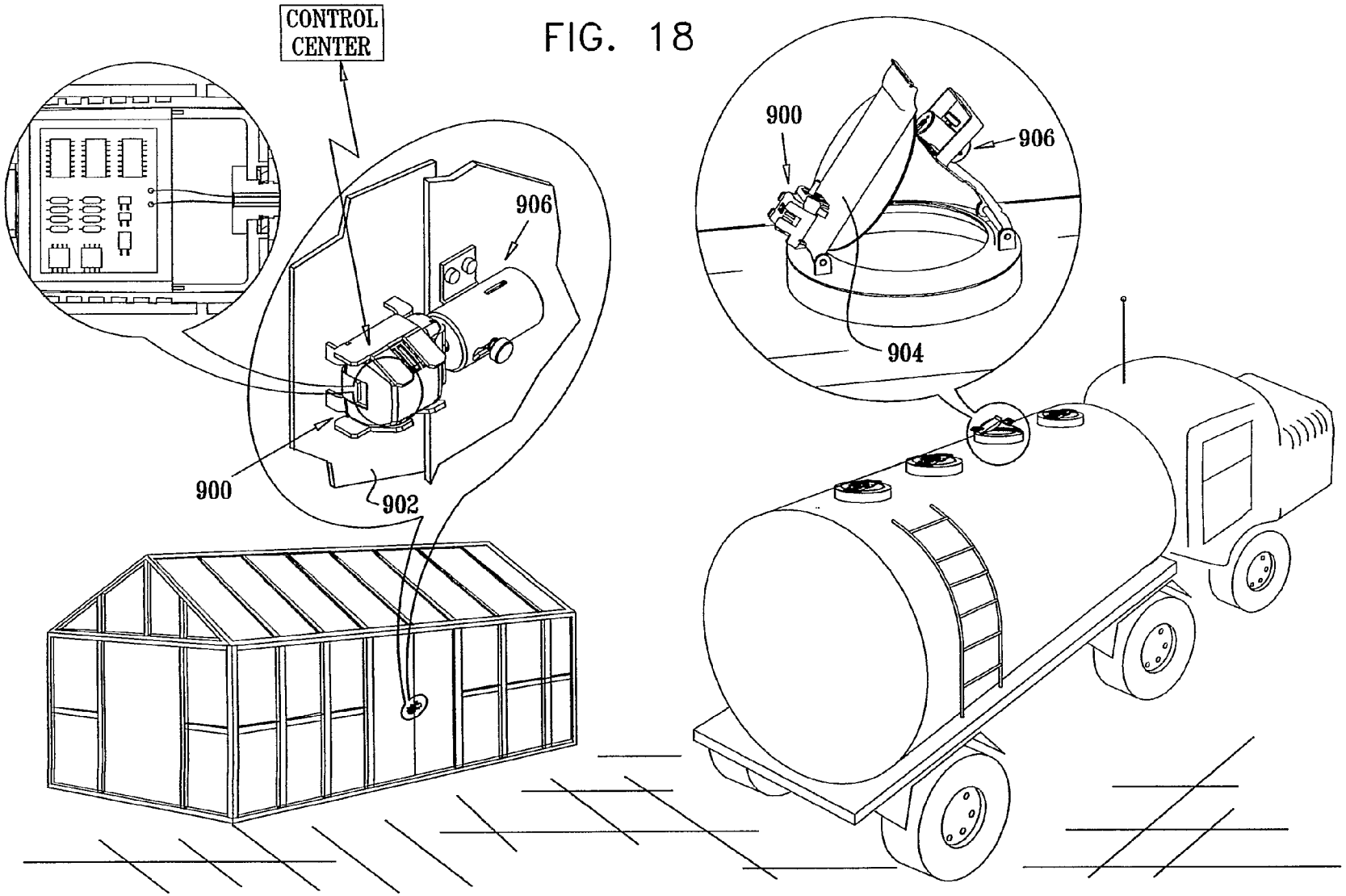
FIG. 18 is a simplified pictorial illustration of a monitorable locking assembly constructed and operative in accordance with a further embodiment of the present invention.
Figure 19A:
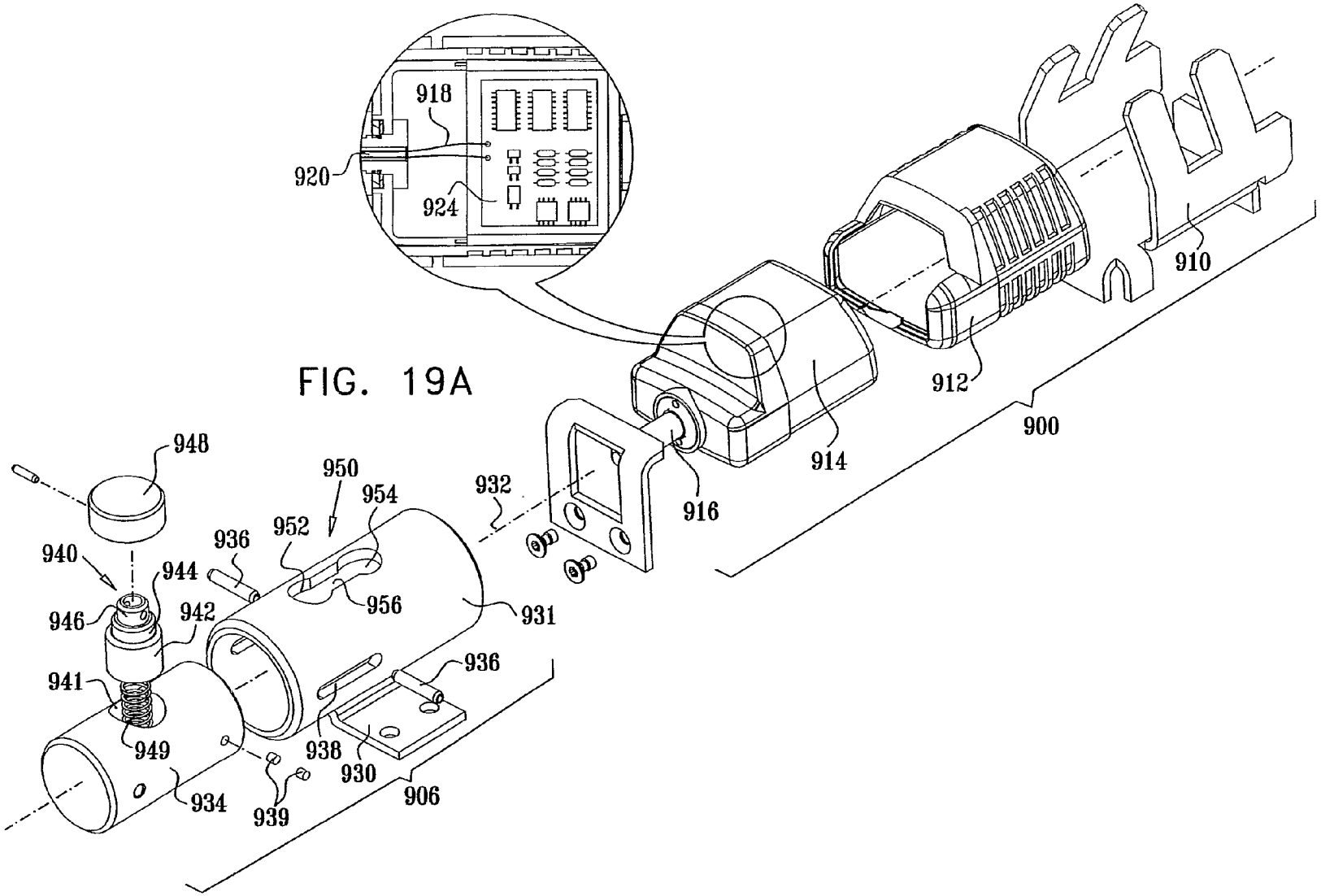
FIGS. 19A and 19B are respectively, an exploded view illustration and an assembled view pictorial illustration of the monitorable locking assembly of FIG. 18.
Figure 19B:
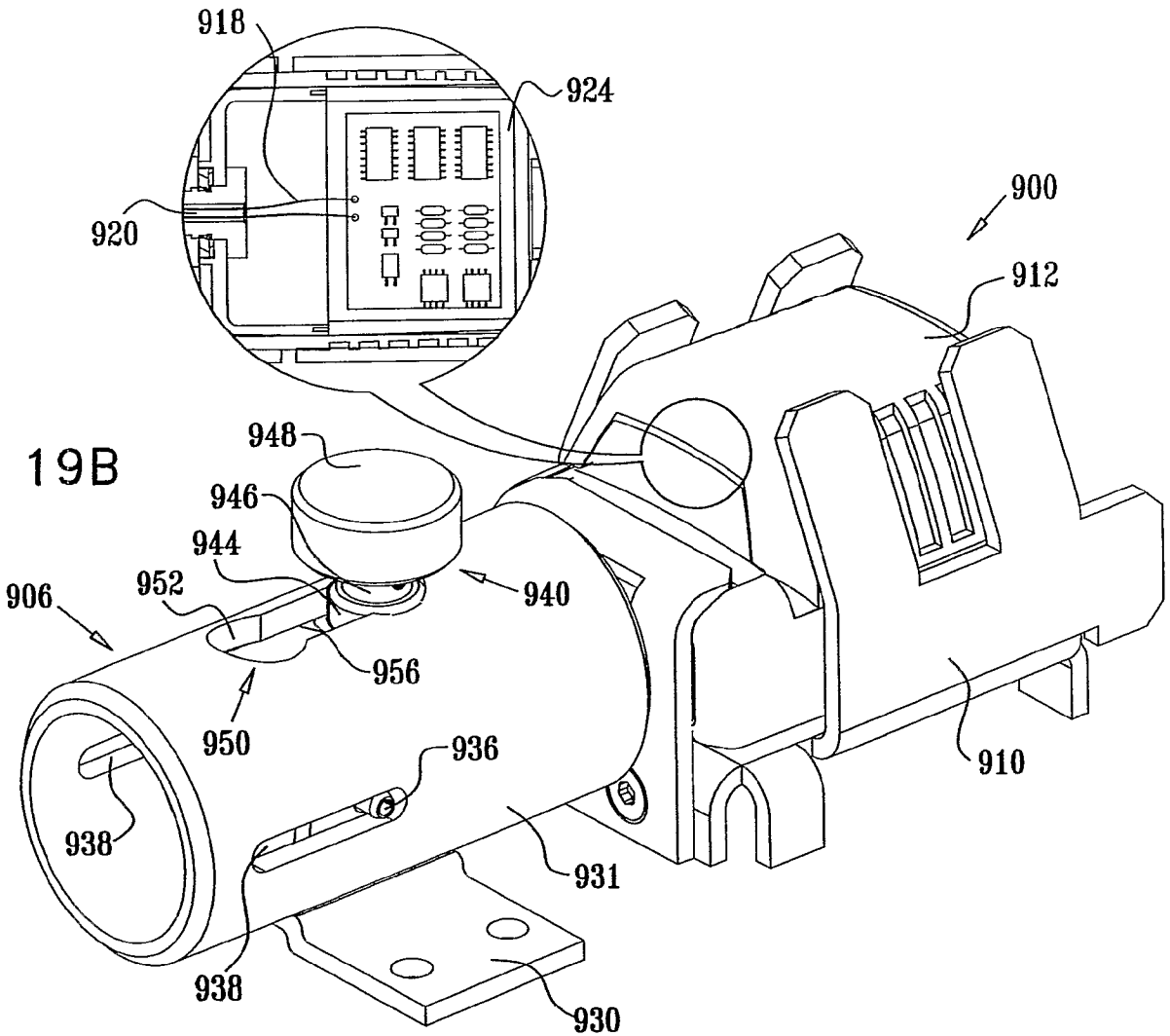

As seen in FIG. 18, the monitorable locking assembly preferably includes a monitorable pin assembly 900, which is typically mounted on a first enclosure element, such as a door 902 of an enclosure or a top locking flap 904 of a tanker hatch, and a selectably positionable socket assembly 906, which is typically mounted on a second enclosure element, which, when locked lies in generally co-planar, adjacent relationship with the first enclosure element.

Referring now to FIGS. 19A-21B, it is seen that the monitorable pin assembly 900 preferably comprises a mounting bracket 910 which is fixed to a first enclosure element and supports a pin assembly enclosure 912 in which is, in turn, disposed a pin assembly housing 914.

Mounted on pin assembly housing 914 is a pin 916 which preferably includes a first conductor 918, preferably arranged in a loop extending in a bore 920 disposed along pin 916 and forming an electrical circuit whose integrity is monitorable by electrical circuitry 924 disposed within the pin assembly housing 914, such that cutting or otherwise breaking the pin 916 produces an indication of tampering. Preferably, pin 916 or socket assembly 906 also includes a second conductor, which may or may not be arranged in a loop and define an electrical circuit.

Selectably positionable socket assembly 906 preferably comprises a mounting bracket 930, onto which is fixedly mounted a sleeve 931, which defines a longitudinal axis 932. A socket defining element 934 is slidably mounted in sleeve 931 for selectable positioning along axis 932 between extreme positions defined by engagement of pins 936, fixed to and extending transversely of socket defining element 934, and slots 938 formed in sleeve 931. The extreme positions are respectively a pin engagement position, as seen in FIGS. 20A and 20B, and a pin disengagement position, as seen in FIGS. 21A and 21B.

Preferably, one or more magnets 939 or other monitorable elements such as reed switches are disposed within a bore formed in socket defining element 934. Magnets 939 are operative to sense the presence of pin 916 at a predetermined location within the socket defining element 934, which presence can be monitored by circuitry 924. Monitoring of displacement of conductor 918 and/or pin 916 with respect to magnets 939 can provide an indication of authorized or unauthorized opening of the locking assembly, as well as of closing thereof.

Shifting of the socket defining element 934 from one position to another is governed by a manually operable, spring loaded retaining assembly 940, which is partially seated in a bore 941 formed in socket defining element 934. Retaining assembly 940 includes a pin 942 having cylindrical sections 944 and 946, a hand-actuable button top 948 and a spring 949. Section 946, which lies above section 944, has a smaller diameter than section 944. Pin 942 engages a slot 950 formed in sleeve 931, which has a pair of relatively large diameter areas 952 and 954, separated by relatively narrow elongate area 956. The spring 949 tends to urge section 944 into engagement with slot 950, while manual depression of button top 948 brings section 946 into engagement with slot 950, at which time socket defining element 934 is movable relative to monitorable pin assembly 900.

Figure 20A:
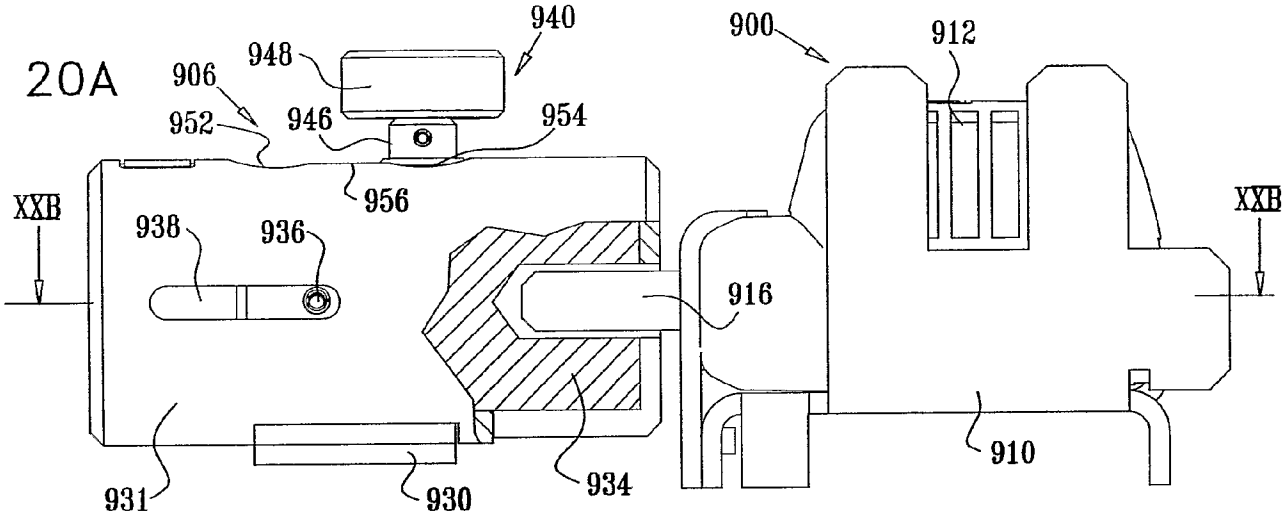
FIGS. 20A and 20B are, respectively, a side view planar illustration and a sectional illustration of the monitorable locking assembly of FIGS. 18-19B in a locked orientation, the sectional illustration being taken along section lines XXB-XXB in FIG. 20A.
Figure 20B:
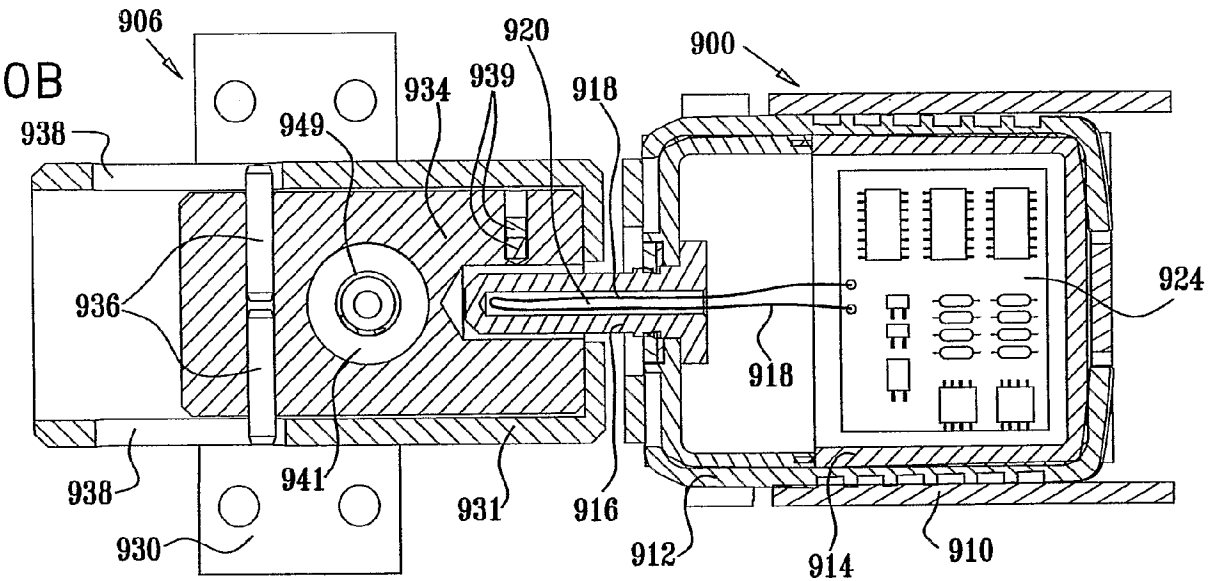
Figure 21A:
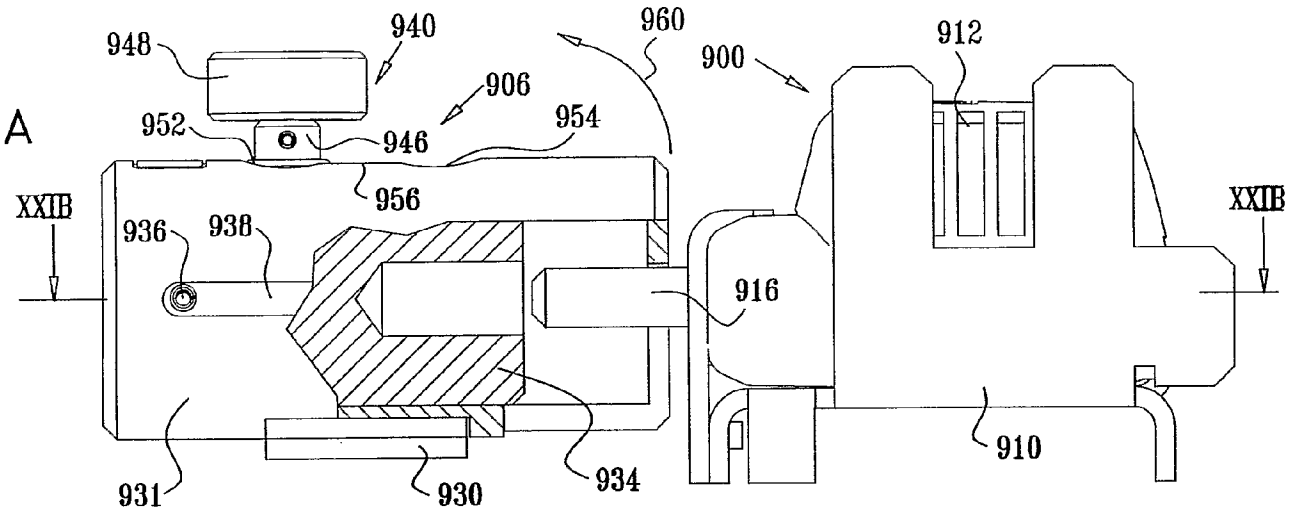
FIGS. 21A and 21B are, respectively, a side view planar illustration and a sectional illustration of the monitorable locking assembly of FIGS. 18-19B in an open orientation, the sectional illustration being taken along section lines XXIB-XXIB in FIG. 21A.
Figure 21B:
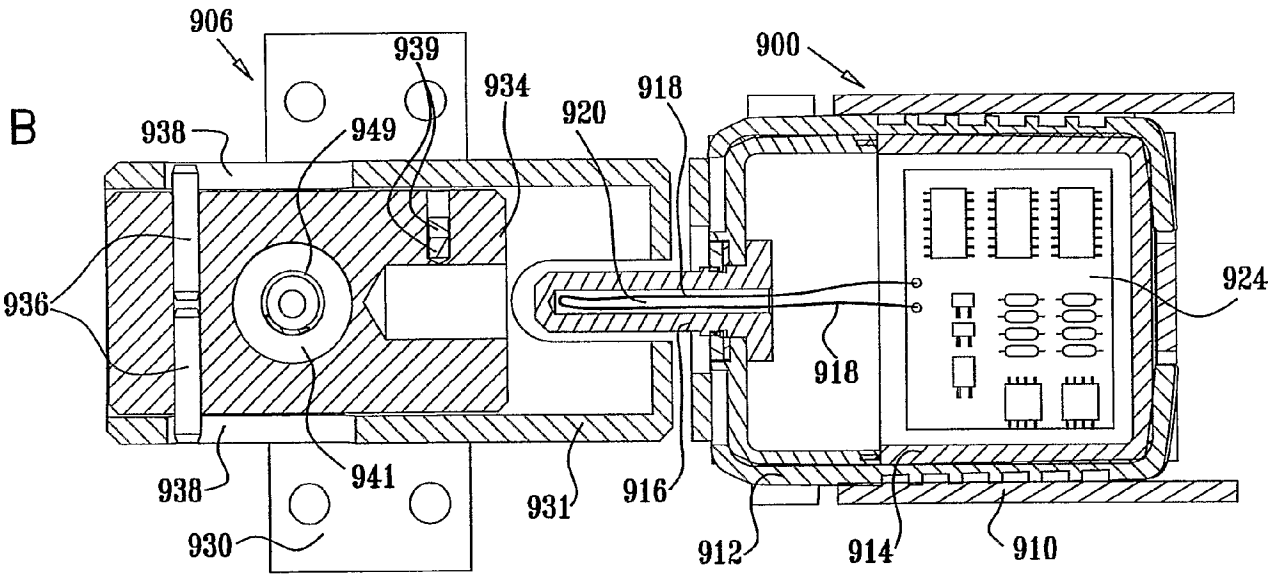

It may be thus appreciated that by suitable manual operation of retaining assembly 940, the socket defining element 934 may be shifted from a pin engagement position, as shown in FIGS. 20A and 20B, to a pin disengagement position, as shown in FIGS. 21A and 21B, at which position the lock assembly can be opened by relative movement of the selectably positionable socket assembly 906 in a direction indicated by arrow 960 in FIG. 21A.

Reference is now made to FIGS. 22-25B, which illustrate a monitorable key operated locking assembly constructed and operative in accordance with yet a further embodiment of the present invention, used to protect various types of enclosures, such as, for example, tanker hatches and buildings.

Figure 22:
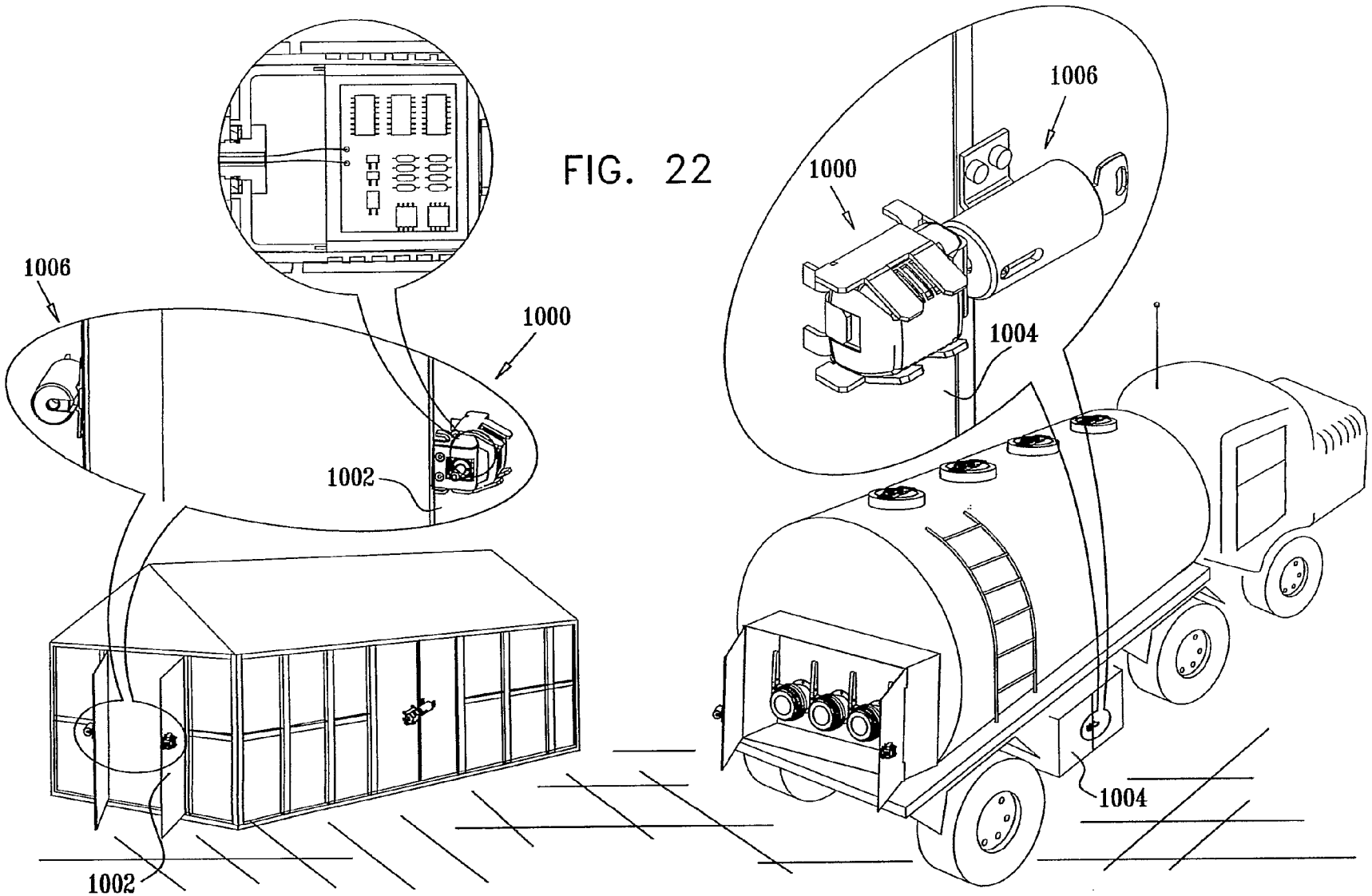
FIG. 22 is a simplified pictorial illustration of a key operated monitorable locking assembly constructed and operative in accordance with another preferred embodiment of the present invention.
Figure 23A:
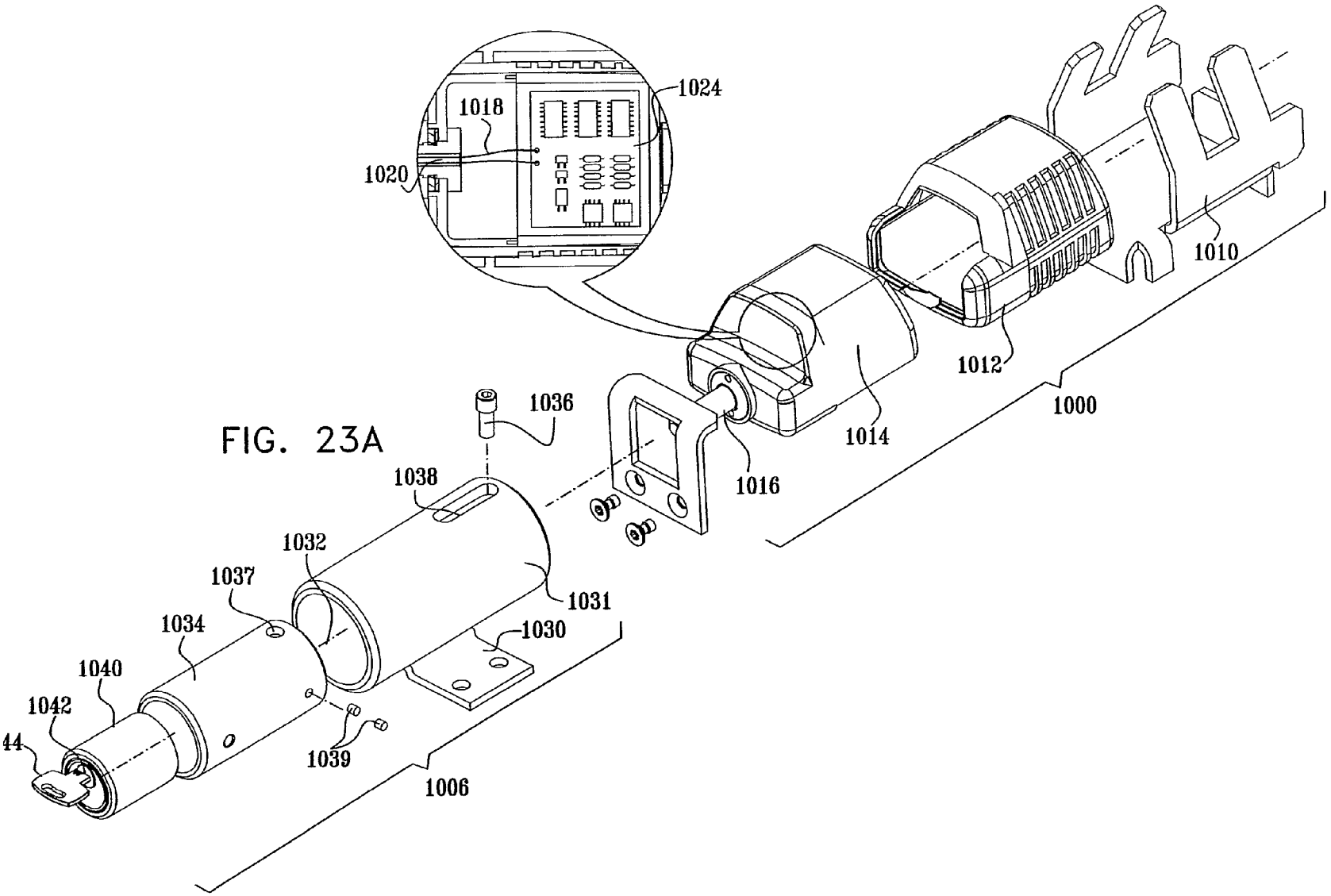
FIGS. 23A and 23B are respectively, an exploded view illustration and an assembled view pictorial illustration of the key operated monitorable locking assembly of FIG. 22.
Figure 23B:
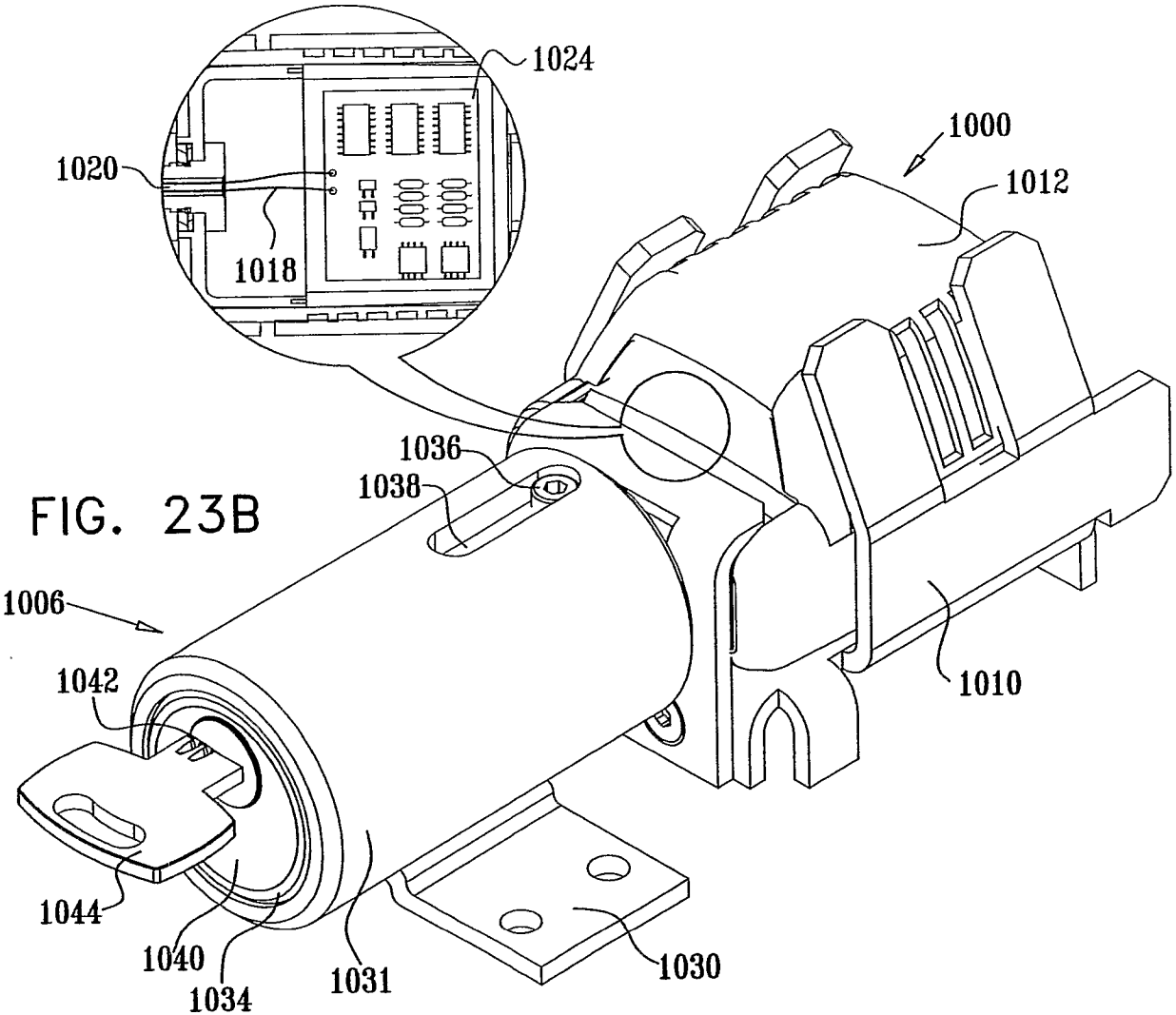

As seen in FIG. 22, the key operated monitorable locking assembly preferably includes a monitorable pin assembly 1000, which is typically mounted on a first enclosure element, such as a door 1002 of an enclosure or a side locking flap 1004 of a tanker door, and a socket assembly 1006, which is typically mounted on a second enclosure element, which, when locked lies in generally co-planar, adjacent relationship with the first enclosure element.

Referring now to FIGS. 23A-25B, it is seen that the monitorable pin assembly 1000 preferably comprises a mounting bracket 1010 which is fixed to a first enclosure element and supports a pin assembly enclosure 1012 in which is, in turn, disposed a pin assembly housing 1014.

Mounted on pin assembly housing 1014 is a pin 1016 which preferably includes a first conductor 1018, preferably arranged in a loop extending in a bore 1020 disposed along pin 1016 and forming an electrical circuit whose integrity is monitorable by electrical circuitry 1024 disposed within the pin assembly housing 1014, such that cutting or otherwise breaking the pin 1016 produces an indication of tampering. Preferably, pin 1016 or socket assembly 1006 also includes a second conductor, which may or may not be arranged in a loop and define an electrical circuit.

Figure 24A:
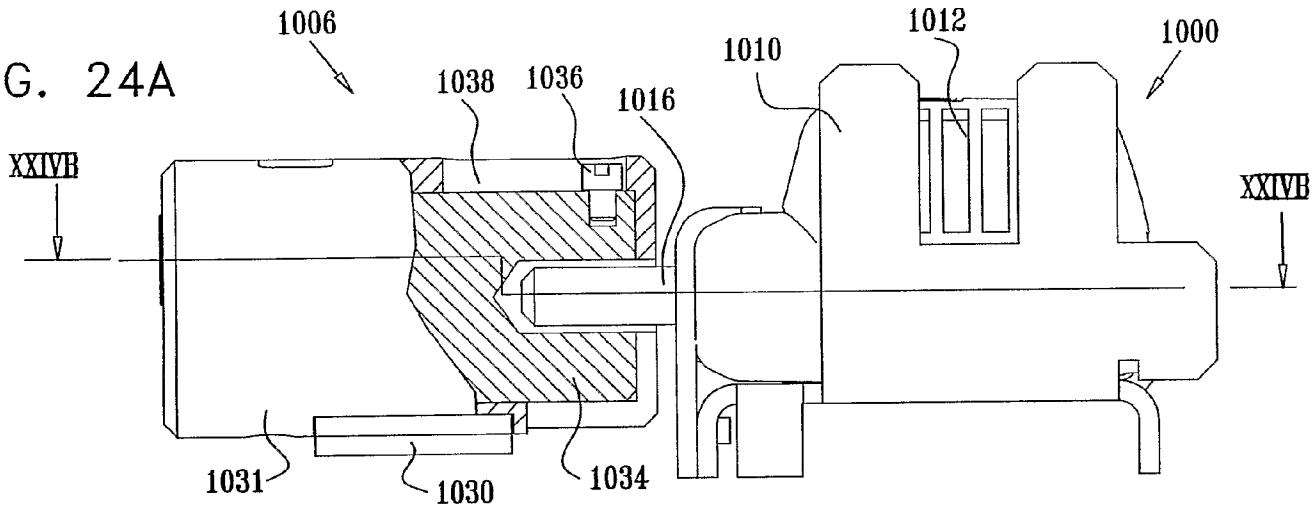
FIGS. 24A and 24B are, respectively, a side view planar illustration and a sectional illustration of the key operated monitorable locking assembly of FIGS. 22-23B in a locked orientation, the sectional illustration being taken along section lines XXIVB-XXIVB in FIG. 24A.
Figure 24B:
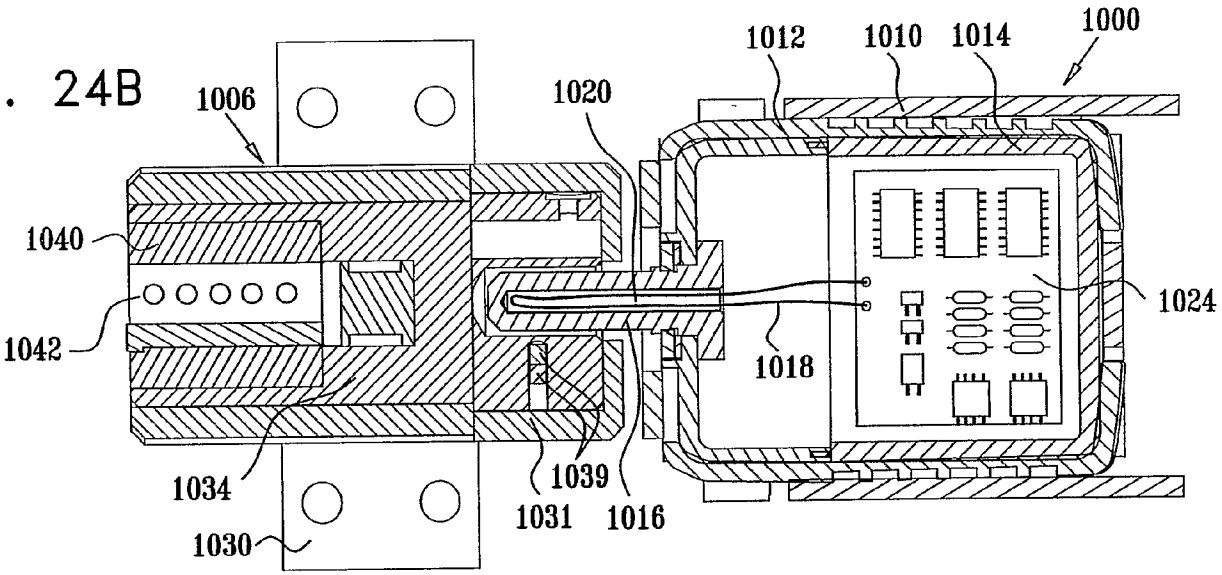
Figure 25A:
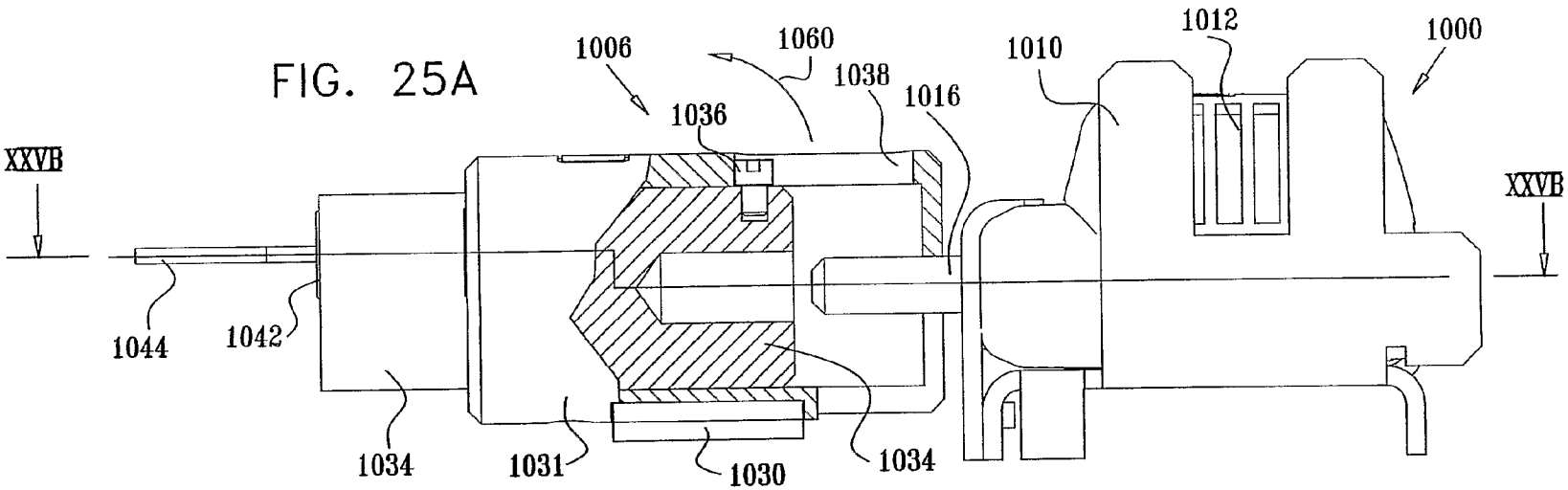
FIGS. 25A and 25B are, respectively, a side view planar illustration and a sectional illustration of the key operated monitorable locking assembly of FIGS. 22-23B in an open orientation, the sectional illustration being taken along section lines XXVB-XXVB in FIG. 25A.
Figure 25B:
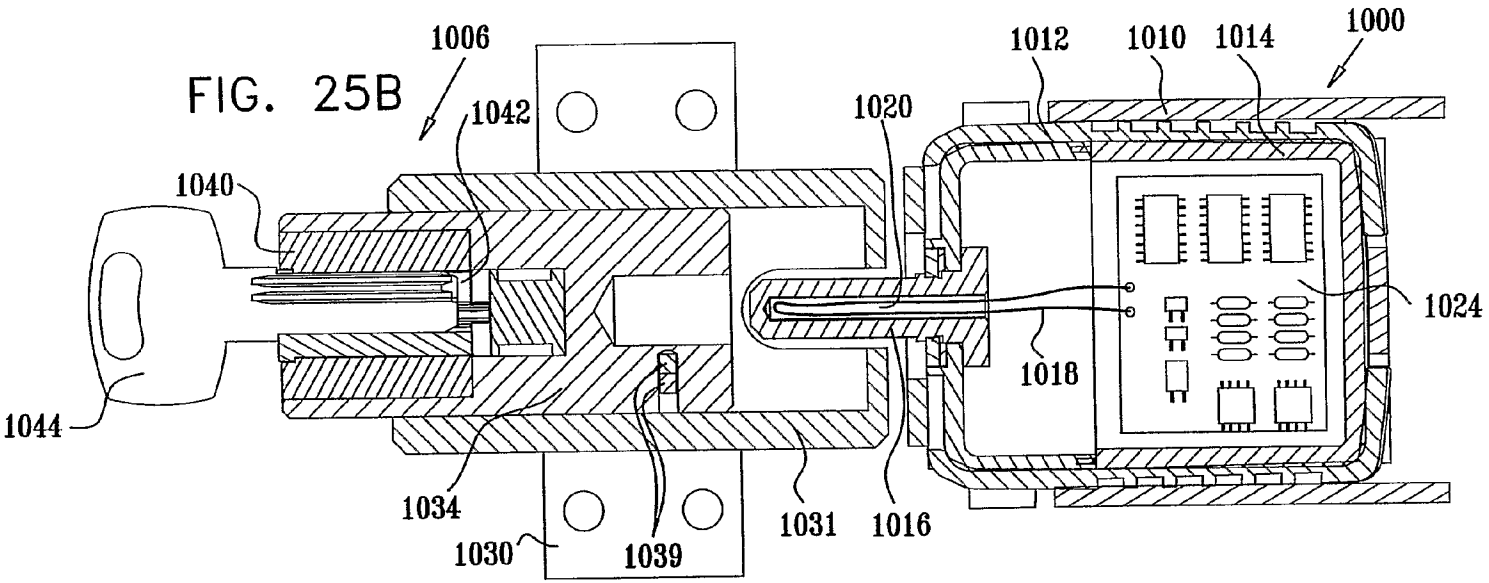

Socket assembly 1006 preferably comprises a mounting bracket 1030, onto which is fixedly mounted a sleeve 1031, which defines a longitudinal axis 1032. A socket defining element 1034 is slidably mounted in sleeve 1031 for selectable axial positioning along axis 1032 between extreme positions defined by engagement of a pin 1036, fixed to a bore 1037 formed in socket defining element 1034 and extending transversely thereto, and a slot 1038 formed in sleeve 1031. The extreme positions are respectively a pin engagement position, as seen in FIGS. 24A and 24B, and a pin disengagement position, as seen in FIGS. 25A and 25B.

Preferably, one or more magnets 1039 or other monitorable elements, such as reed switches, are disposed within a bore formed in socket defining element 1034. Magnets 1039 are operative to sense the presence of pin 1016 at a predetermined location within the socket defining element 1034, which presence can be monitored by circuitry 1024. Monitoring of displacement of conductor 1018 and/or pin 1016 with respect to magnets 1039 can provide an indication of authorized or unauthorized opening of the locking assembly, as well as of closing thereof.

Disposed within the socket defining element 1034 is a key housing barrel 1040 which is formed with a slot 1042 operative to engage a key 1044. Shifting of the socket defining element 1034 from one position to another is governed by manual operation and rotation of key 1044 within slot 1042 of barrel 1040, thus releasing pin 1016 such that socket defining element 1034 is movable axially relative to monitorable pin assembly 1000. It may be thus appreciated that by suitable manual operation of key 1044, the socket defining element 1034 may be shifted from a pin engagement position, as shown in FIGS. 24A and 24B, to a pin disengagement position, as shown in FIGS. 25A and 25B, at which position the lock assembly can be opened by relative movement of the socket assembly 1006 in a direction indicated by arrow 1060 in FIG. 25A.

Reference is now made to FIGS. 26-29B, which illustrate a monitorable locking assembly constructed and operative in accordance with another embodiment of the present invention, used to protect various types of handles, such as, for example, tanker valve opening handles and electric circuit breaking controls.

Figure 26:
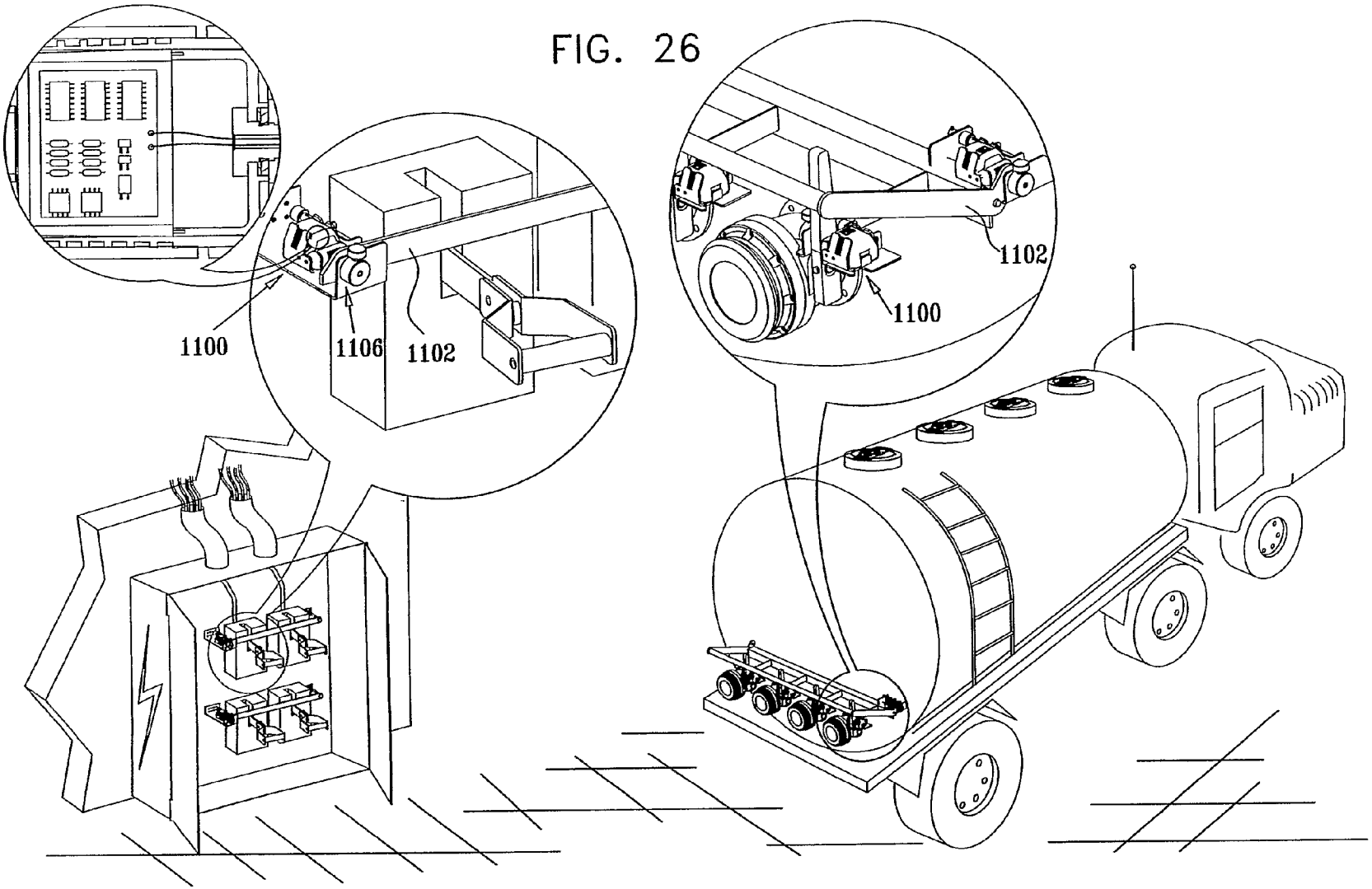
FIG. 26 is a simplified pictorial illustration of a monitorable valve locking assembly constructed and operative in accordance with a further preferred embodiment of the present invention.
Figure 27A:
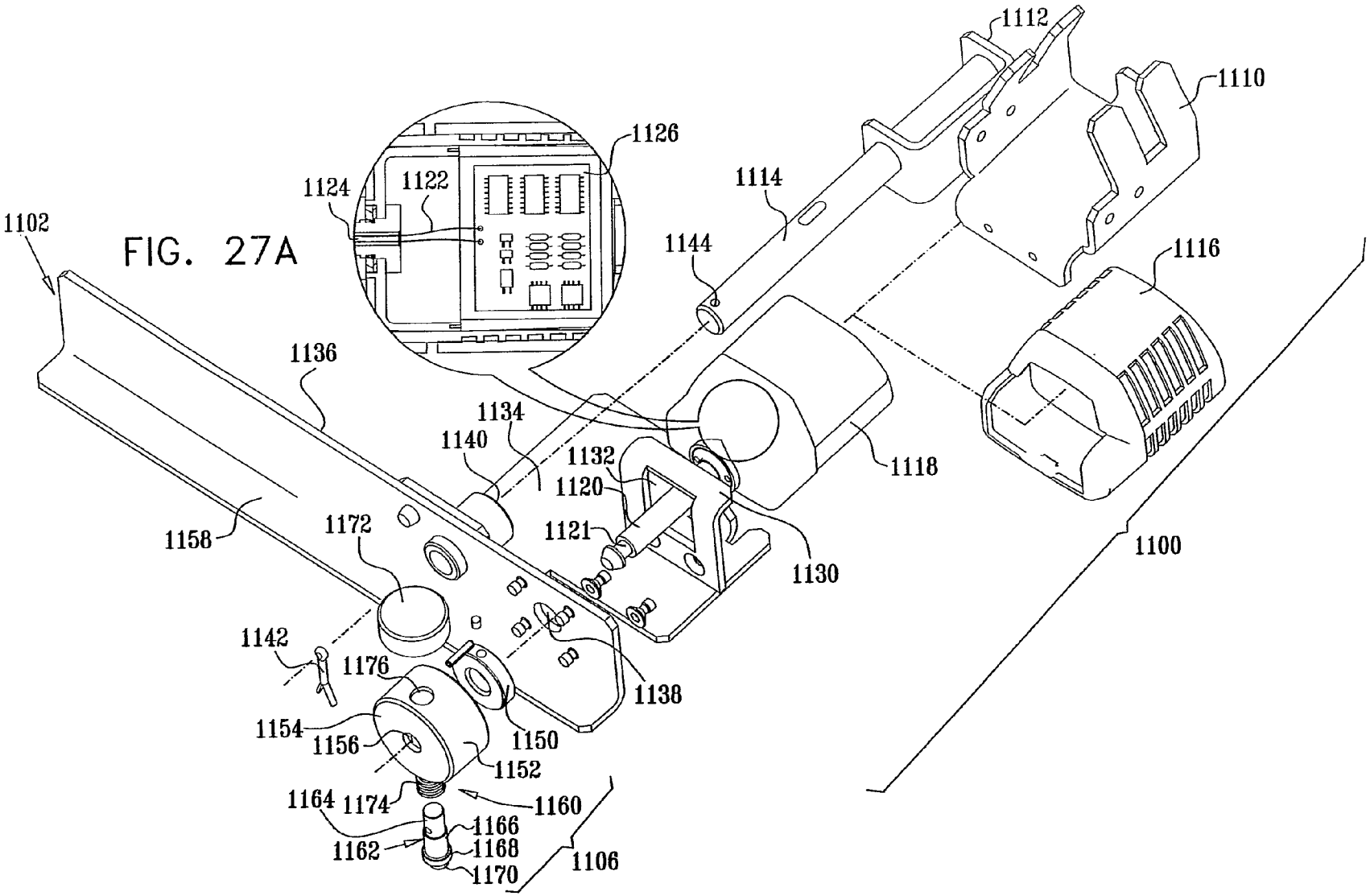
FIGS. 27A and 27B are respectively, an exploded view illustration and an assembled view pictorial illustration of the monitorable valve locking assembly of FIG. 26.
Figure 27B:
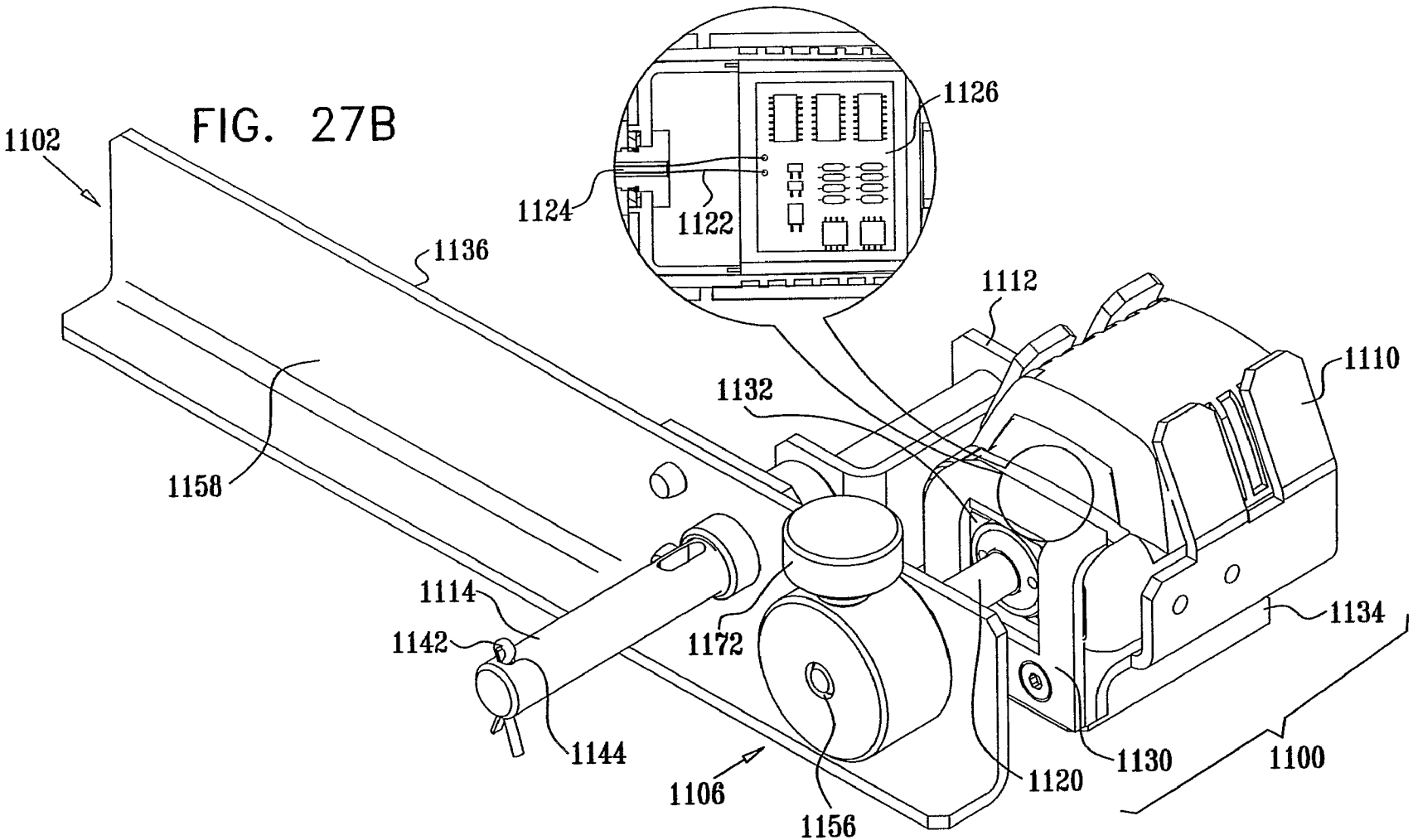

As seen in FIG. 26, the monitorable locking assembly preferably includes a monitorable selectably positionable pin assembly 1100, which is typically mounted on a first side of a handle element 1102, such as a valve opening handle, and a socket assembly 1106, which is typically mounted on a side of the handle element, which, when locked lies in generally co-planar, adjacent relationship with the first side of the handle element.

Referring now to FIGS. 27A-29B, it is seen that the monitorable selectably positionable pin assembly 1100 preferably comprises a mounting bracket 1110 which has fixed thereto a longitudinal bracket 1112 having a rod 1114 extending longitudinally therethrough. Mounting bracket 1110 supports a pin assembly enclosure 1116 in which is, in turn, disposed a pin assembly housing 1118.

Mounted on pin assembly housing 1118 is a pin 1120 which is preferably formed with a narrower neck portion 1121 and which preferably includes a first conductor 1122, preferably arranged in a loop extending in a bore 1124 disposed along pin 1120 and forming an electrical circuit whose integrity is monitorable by electrical circuitry 1126 disposed within the pin assembly housing 1118, such that cutting or otherwise breaking the pin 1120 produces an indication of tampering. Preferably, pin 1120 or socket assembly 1106 also includes a second conductor, which may or may not be arranged in a loop and define an electrical circuit and additionally or alternatively one or more magnets, reed switches or other monitorable elements, whose presence at a predetermined location can be monitored by circuitry 1126. Monitoring of displacement of conductor 1122 and/or monitorable elements can provide an indication of authorized or unauthorized opening of the locking assembly, as well as of closing thereof.

A vertical bracket element 1130, having a generally square window 1132 formed therewithin, typically has mounting bracket 1110 mounted thereonto by screws or bolts, such that pin 1120 extends through window 1132. An additional planar bracket element 1134 is typically mounted onto a first side 1136 of handle 1102, such that vertical bracket element 1130 is moveable relative to planar bracket element 1134. Handle 1102 is preferably formed with a first bore 1138 which is adapted to have pin 1120 slidably extend therethrough, and with an additional bore 1140 which is adapted to have rod 1114 slidably extend therethrough. Rod 1114 is retained inside bore 1140 by a retaining element 1142 mounted in a bore 1144 at a forward end of the rod 1114.

Socket assembly 1106 preferably comprises a circular ring 1150 which is disposed within a cylindrical portion 1152 terminating in a wall portion 1154 having a central circular hole 1156 formed therein. Typically, cylindrical portion 1152 is mounted onto a second side 1158 of handle 1102 such that a central bore of ring 1150 and circular hole 1156 are aligned with bore 1138 and pin 1120 can slidably extend therethrough.

Shifting of the pin 1120 from one position to another with respect to handle 1102 is governed by a manually operable, spring loaded retaining assembly 1160, which is partially seated within cylindrical portion 1152. Retaining assembly 1160 includes a pin 1162 having cylindrical sections 1164, 1166, 1168 and 1170, a hand-actuable button top 1172 and a spring 1174. Typically, section 1164, which lies above section 1166 has a smaller diameter than section 1166, which in turn has a smaller diameter than section 1168 which lies therebelow. Section 1170 lies below section 1168, and has a smaller diameter than section 1168. Pin 1162 engages a bore 1176 formed in cylindrical portion 1152, and is biased downward by the urging of spring 1174 on section 1168, such that in a closed orientation of the locking assembly, section 1170 of pin 1162 engages neck portion 1121 of pin 1120. Manual raising of button top 1172, eases the pressure exerted by spring 1174 on section 1168, resulting in raising of pin 1162 and disengagement of section 1170 of pin 1162 from neck portion 1121 of pin 1120.

Figure 28A:
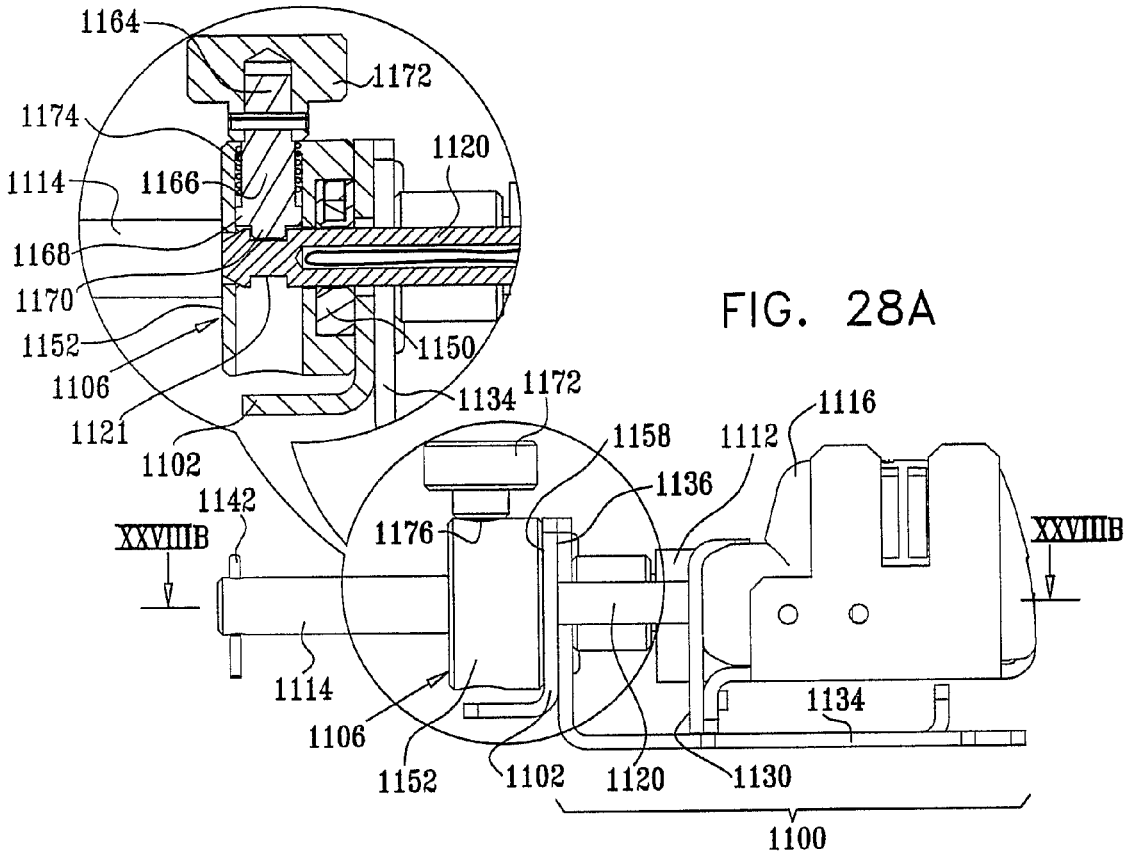
FIGS. 28A and 28B are, respectively, a side view planar illustration and a sectional illustration of the monitorable valve locking assembly of FIGS. 26-27B in a locked orientation, the sectional illustration being taken along section lines XXVIIB-XXVIIIB in FIG. 28A.
Figure 28B:
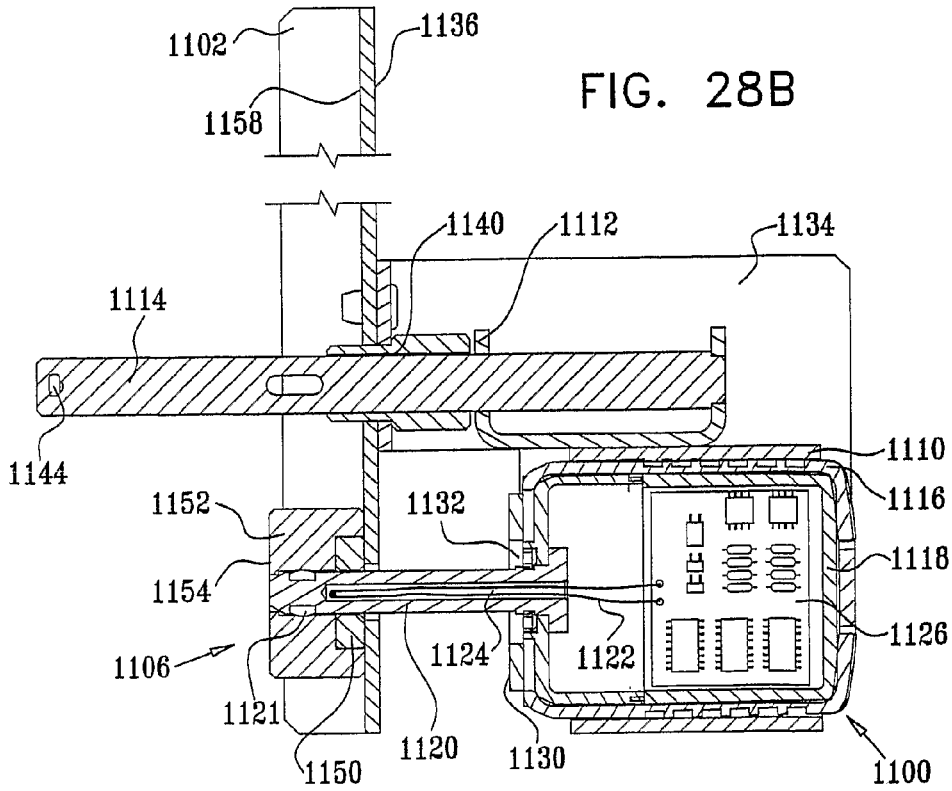
Figure 29A:
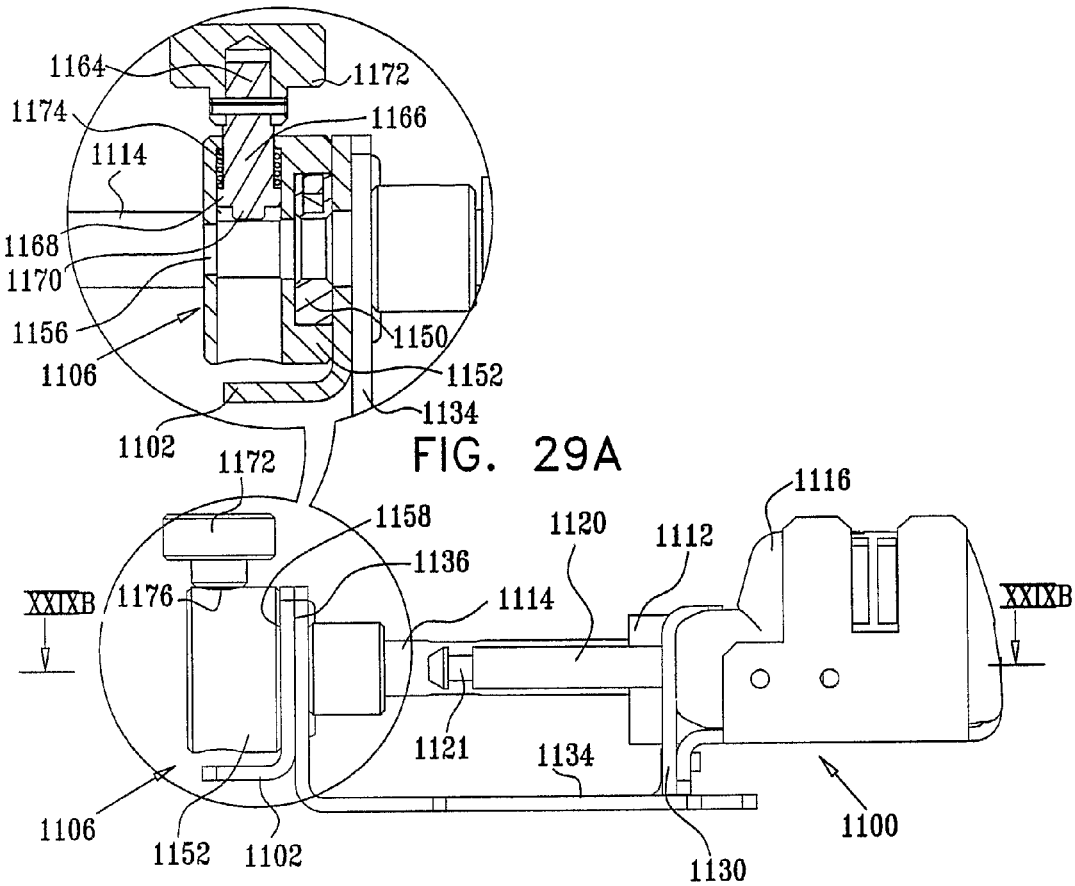
FIGS. 29A and 29B are, respectively, a side view planar illustration and a sectional illustration of the monitorable valve locking assembly of FIGS. 26-28B in an open orientation, the sectional illustration being taken along section lines XXIXB-XXIXB in FIG. 29A.
Figure 29B:
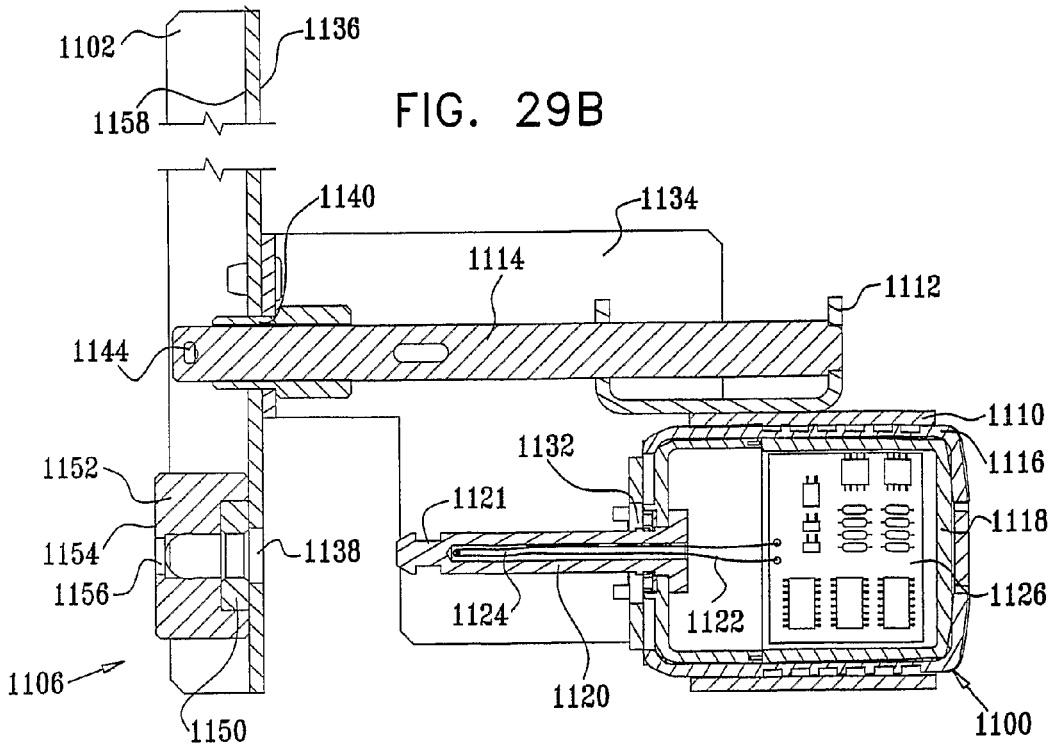

It may be thus appreciated that by suitable manual operation of retaining assembly 1160, pin 1120 and monitorable selectably positionable pin assembly 1100 may be shifted from a pin engagement position, as shown in FIGS. 28A and 28B, to a pin disengagement position, as shown in FIGS. 29A and 29B, at which position the lock assembly can be opened by relative movement of the monitorable selectably positionable pin assembly 1100.

Reference is now made to FIGS. 30-33B, which illustrate a key operated monitorable locking assembly constructed and operative in accordance with yet another embodiment of the present invention, used to control operation of various types of manually operable controls, handles and switches, such as, for example, tanker valve opening handles and electric circuit breaking controls.

Figure 30:
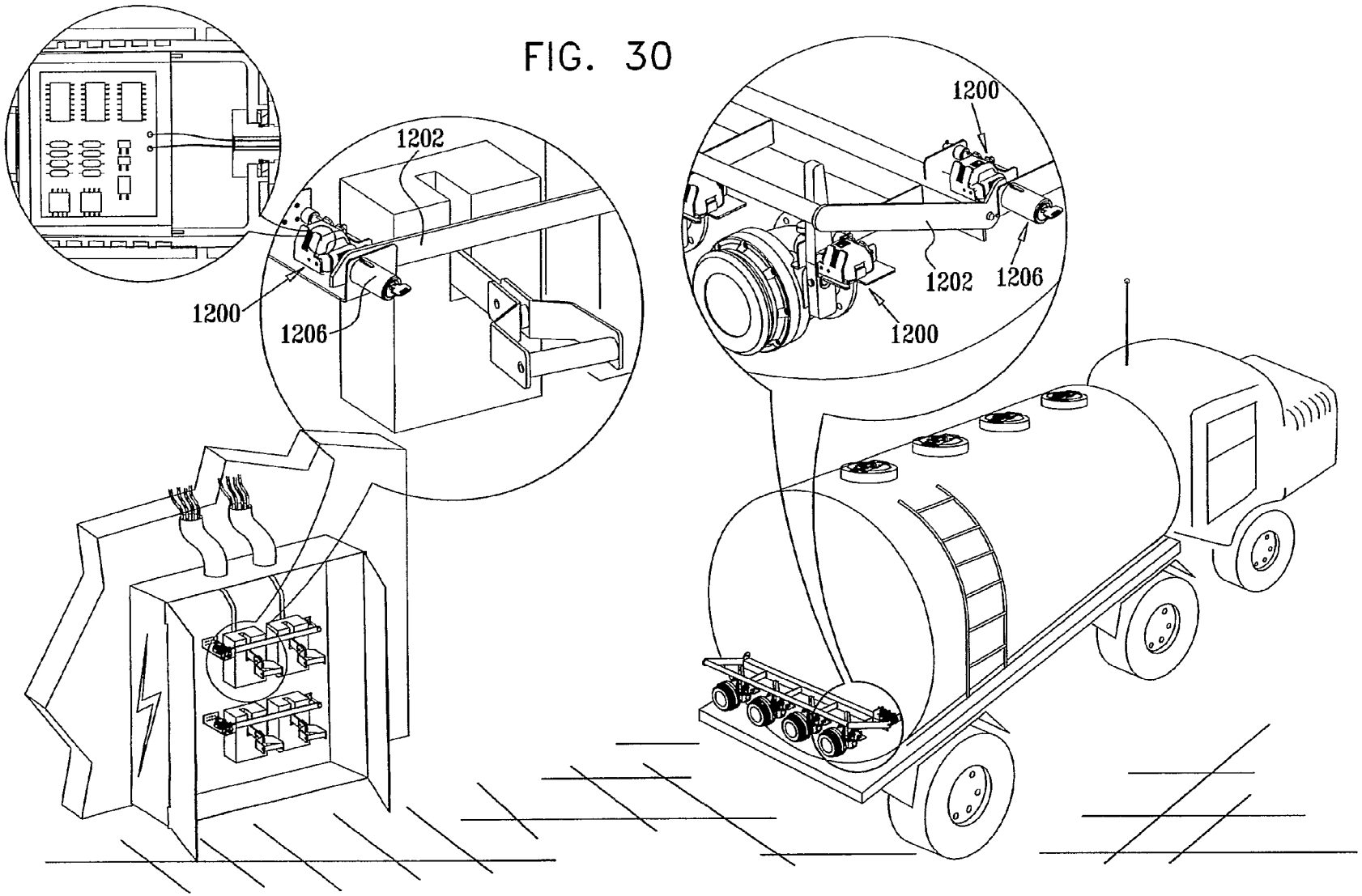
FIG. 30 is a simplified pictorial illustration of a key operated monitorable valve locking assembly constructed and operative in accordance with yet another preferred embodiment of the present invention.
Figure 31A:
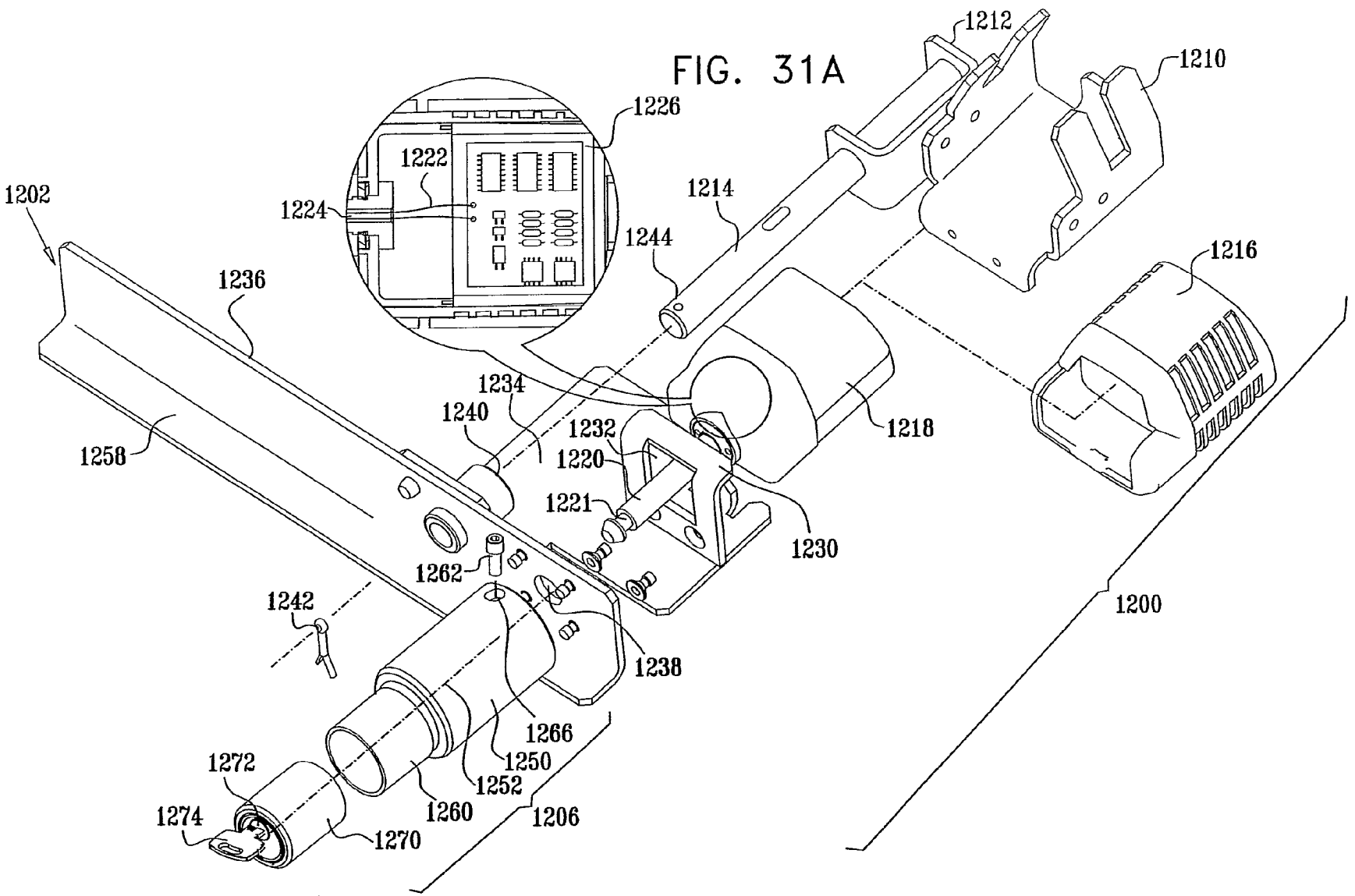
FIGS. 31A and 31B are respectively, an exploded view illustration and an assembled view pictorial illustration of the key operated monitorable valve locking assembly of FIG. 30.
Figure 31B:
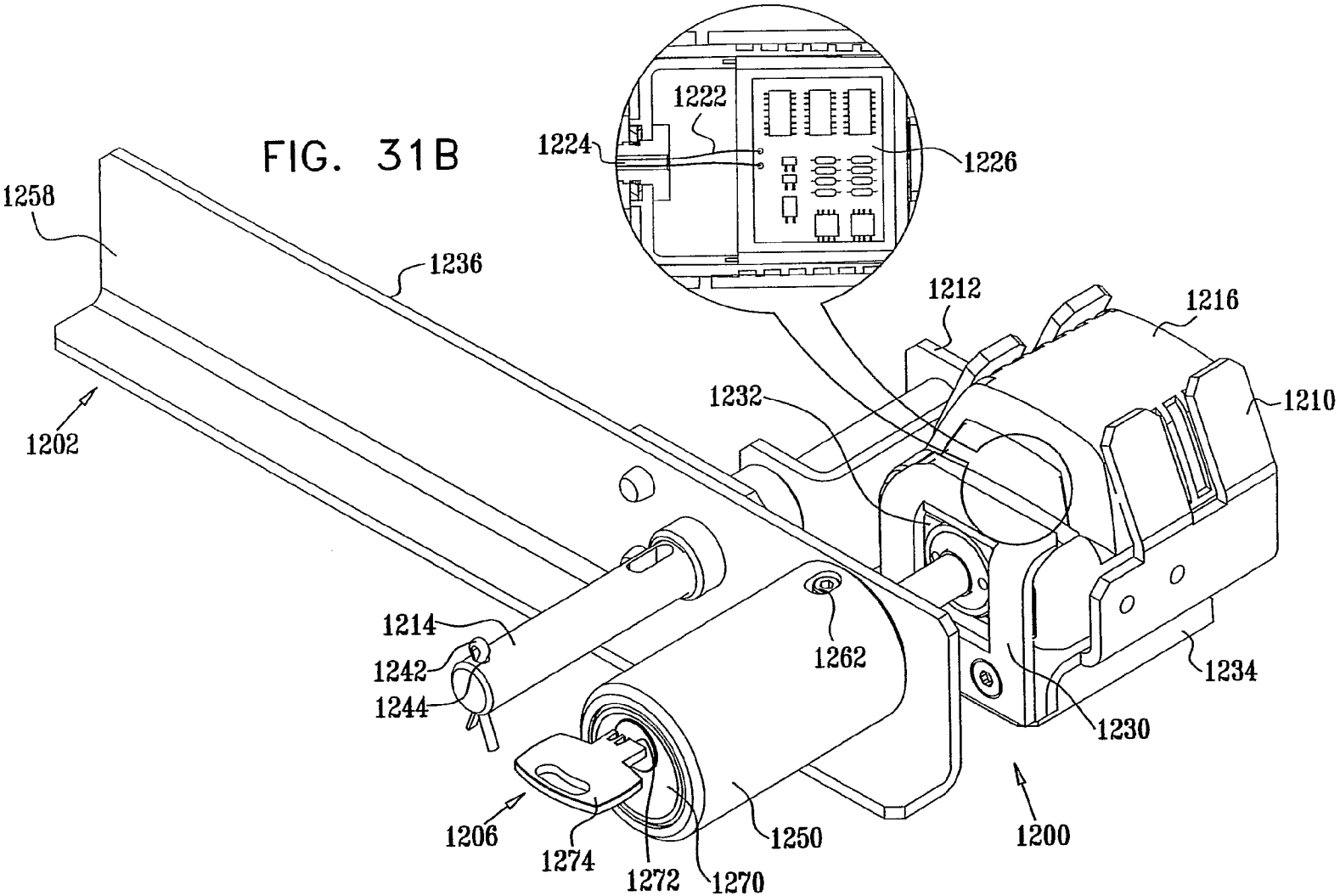

As seen in FIG. 30, the key operated monitorable locking assembly preferably includes a monitorable selectably positionable pin assembly 1200, which is typically mounted on a first side of a handle element 1202, such as a valve opening handle, and a socket assembly 1206, which is typically mounted on a side of the handle element, which, when locked lies in generally co-planar, adjacent relationship with the first side of the handle element.

Referring now to FIGS. 31A-33B, it is seen that the monitorable selectably positionable pin assembly 1200 preferably comprises a mounting bracket 1210 which has fixed thereto a longitudinal bracket 1212 having a rod 1214 extending longitudinally therethrough. Mounting bracket 1210 supports a pin assembly enclosure 1216 in which is, in turn, disposed a pin assembly housing 1218.

Mounted on pin assembly housing 1218 is a pin 1220 which is preferably formed with a narrower neck portion 1221 and which preferably includes a first conductor 1222, preferably arranged in a loop extending in a bore 1224 disposed along pin 1220 and forming an electrical circuit whose integrity is monitorable by electrical circuitry 1226 disposed within the pin assembly housing 1218, such that cutting or otherwise breaking the pin 1220 produces an indication of tampering. Preferably, pin 1220 or socket assembly 1206 also includes a second conductor, which may or may not be arranged in a loop and define an electrical circuit, and additionally or alternatively one or more magnets, reed switches or other monitorable elements, whose presence at a predetermined location can be monitored by circuitry 1226. Monitoring of displacement of conductor 1222 and/or monitorable elements can provide an indication of authorized or unauthorized opening of the locking assembly, as well as of closing thereof.

A vertical bracket element 1230, having a generally square window 1232 formed therewithin, typically has mounting bracket 1210 mounted thereonto by screws or bolts, such that pin 1220 extends through window 1232. An additional planar bracket element 1234 is typically mounted onto a first side 1236 of handle 1202, such that vertical bracket element 1230 is moveable relative to planar bracket element 1234. Handle 1202 is preferably formed with a first bore 1238, which is adapted to have pin 1220 slidably extend therethrough, and with an additional bore 1240, which is adapted to have rod 1214 slidably extend therethrough. Rod 1214 is retained inside bore 1240 by a retaining element 1242 mounted in a bore 1244 at a forward end of the rod 1214.

Socket assembly 1206 preferably comprises a sleeve 1250, which defines a longitudinal axis 1252, and is mounted onto a second side 1258 of handle 1202 by mounting elements, such as screws or bolts. A socket defining element 1260 is mounted in sleeve 1250 for engagement of pin 1220 therein. Socket defining element 1260 is retained in location within sleeve 1250 by engagement of a pin 1262, fixed to a bore 1264 formed in socket defining element 1260 and extending transversely thereto, and a bore 1266 formed in sleeve 1250.

Disposed within the socket defining element 1260 is a key housing barrel 1270 which is formed with a slot 1272 operative to engage a key 1274. Shifting of the pin 1220 relative to socket defining element 1260 is governed by manual operation and rotation of key 1274 within slot 1272 of barrel 1270, thus releasing pin 1220.

Figure 33A:
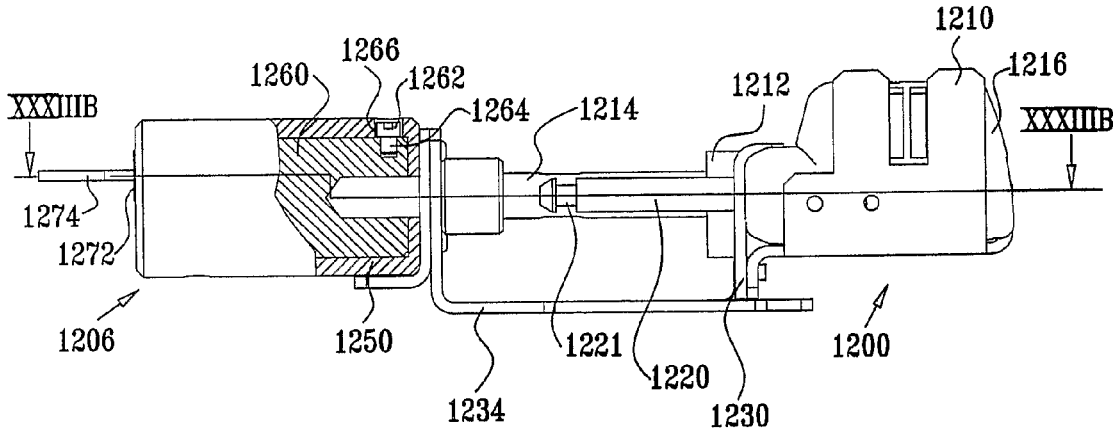
FIGS. 33A and 33B are, respectively, a side view planar illustration and a sectional illustration of the key operated monitorable valve locking assembly of FIGS. 30-31B in an open orientation, the sectional illustration being taken along section lines XXXIIIB-XXXIIIB in FIG. 33A.
Figure 33B:
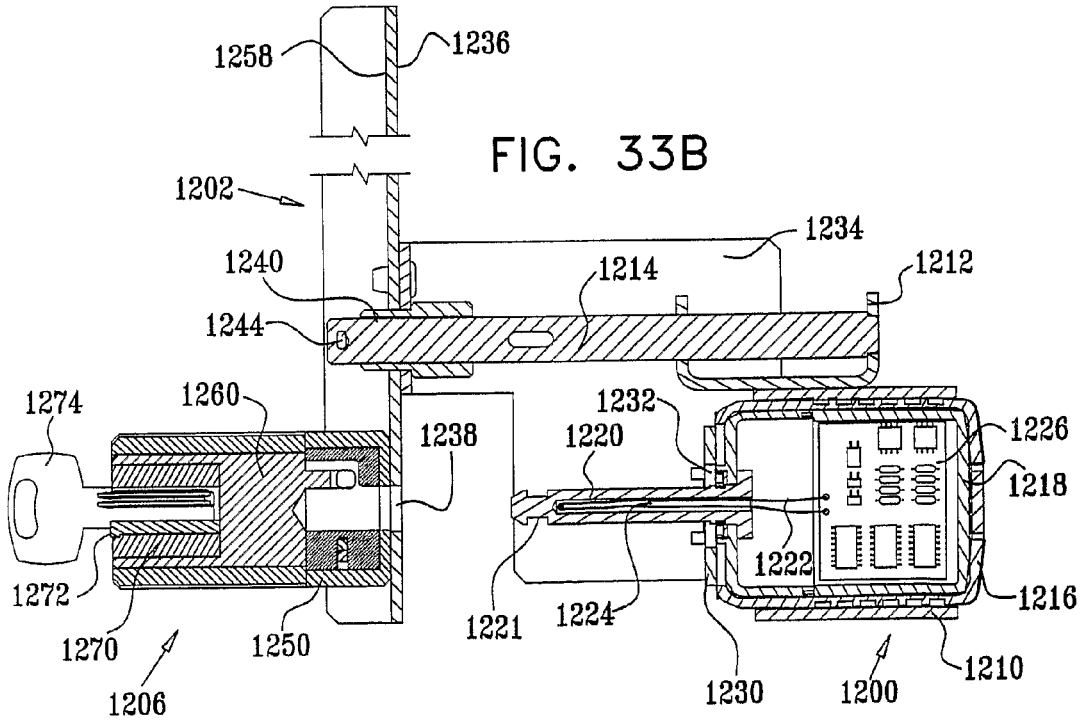

It may be thus appreciated that by suitable manual operation of key 1274, pin 1220 and monitorable selectably positionable pin assembly 1200 may be shifted from a pin engagement position, as shown in FIGS. 32A and 32B to a pin disengagement position, as shown in FIGS. 33A and 33B, at which position, the lock assembly can be opened by relative movement of the monitorable selectably positionable pin assembly 1200.

Reference is now made to FIGS. 34A, 34B, 34C, 34D, 34E and 34F which illustrate various stages in the use of the locking assemblies of FIGS. 18-33B.

Figure 34A:
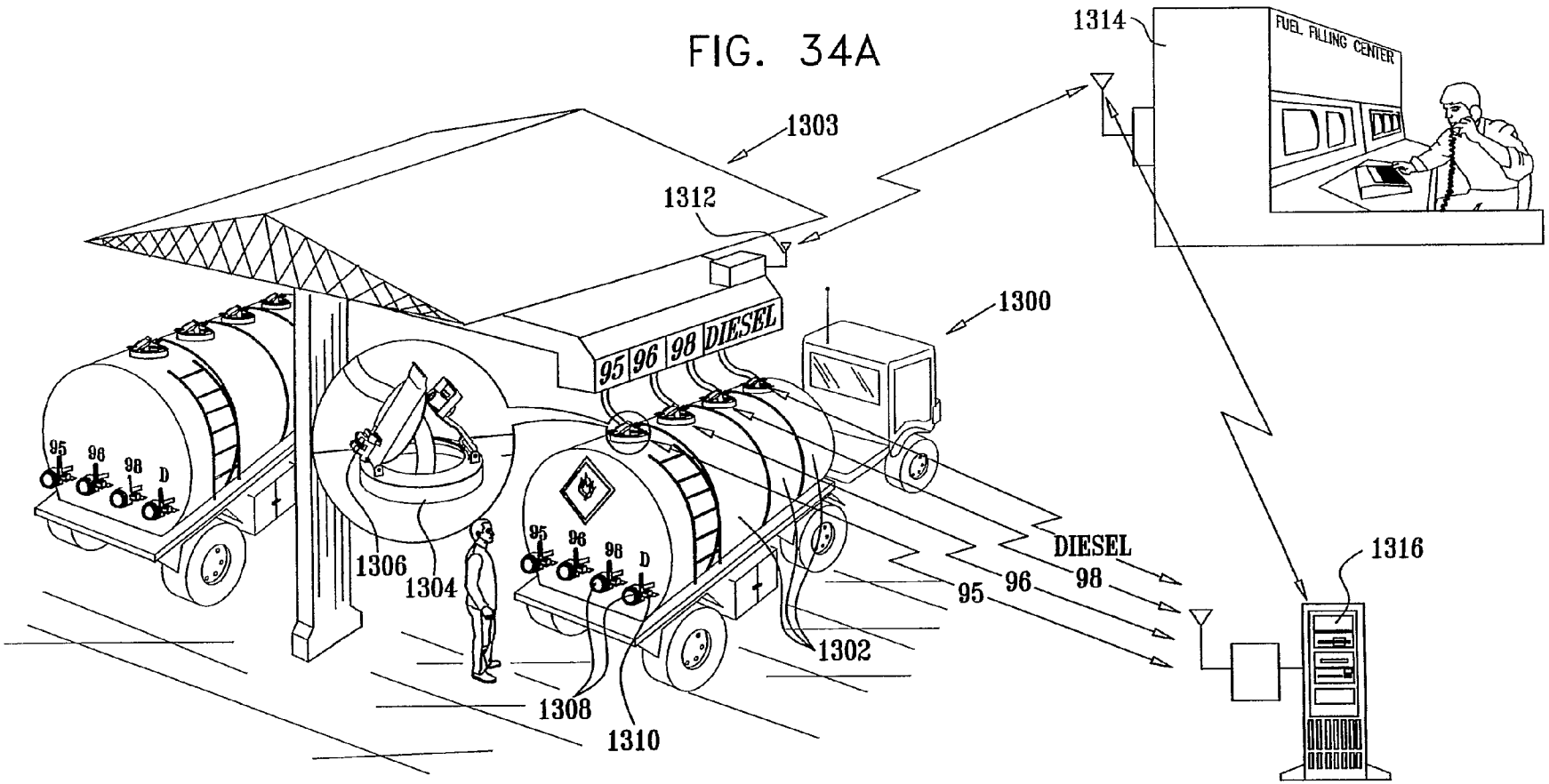
FIGS. 34A, 34B, 34C, 34D, 34E and 34F illustrate various stages in the use of the locking assemblies of FIGS. 18-33B.

FIG. 34A shows a tanker 1300, such as a tanker used for distributing fuel to gas stations, including a plurality of containers 1302, located at a fueling station 1303. Each of containers 1302 includes a hatch 1304 for filling the container 1302 having mounted thereon a monitorable locking assembly 1306, such as any of the monitorable locking assemblies of FIGS. 18-25B, and a valve 1308, for removing fuel from the container 1302, which is preferably locked by a monitorable locking assembly 1310, such as any of the monitorable locking assemblies of FIGS. 26-33B.

As seen in FIG. 34A, each of containers 1302 is filled with an appropriate type of fuel. An antenna 1312, located at station 1303, communicates the type of fuel inserted into each of the containers 1302, as well as additional information, to a remote control center 1314. Remote control center 1314 communicates the information received from antenna 1312, and optionally additional information, to each of monitorable locking assemblies 1306 via a local computer 1316.

Figure 34B:
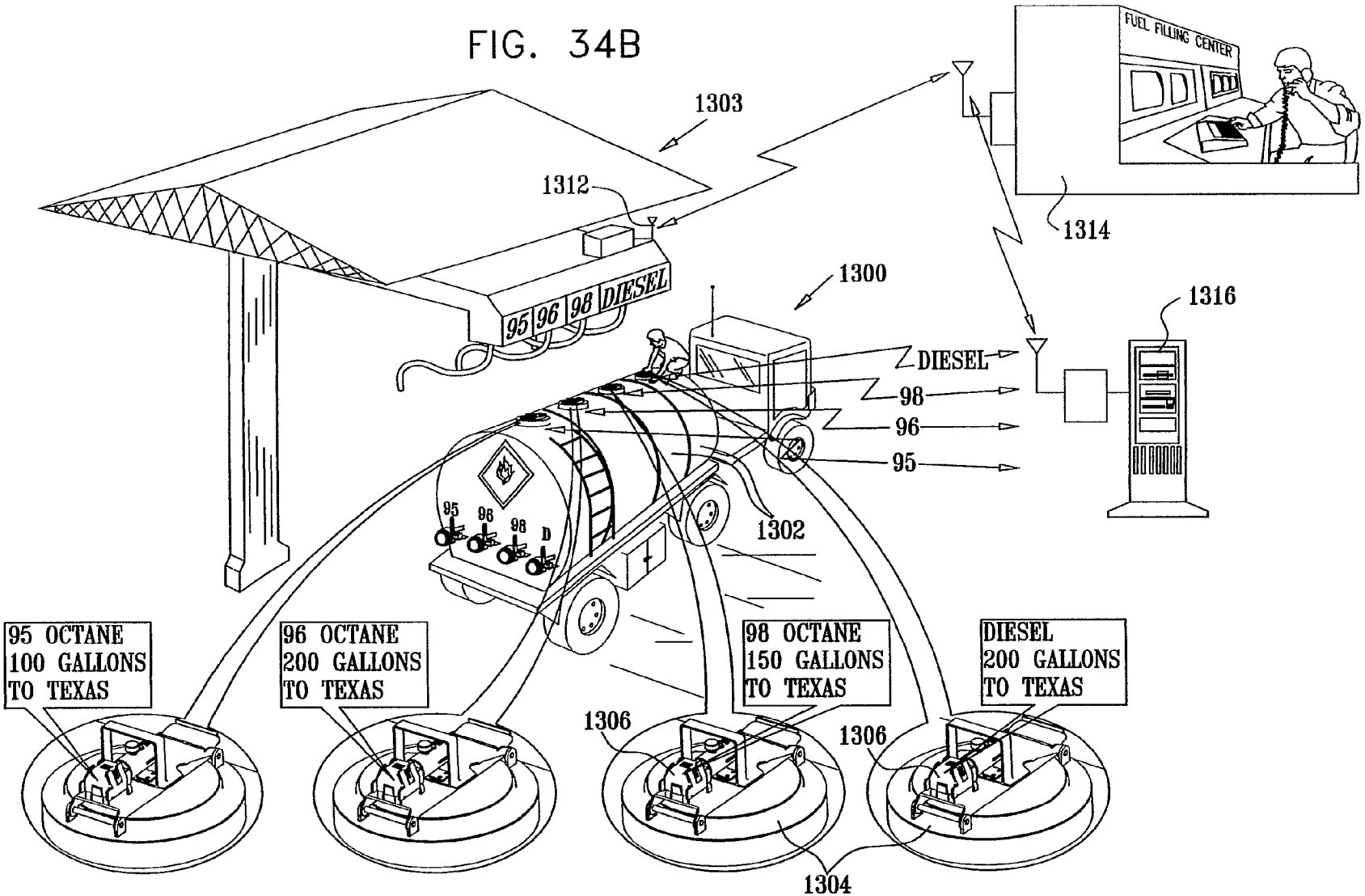

FIG. 34B shows the sealing of hatches 1304 by locking of monitorable locking assemblies 1306. As seen in FIG. 34B, each of monitorable locking assemblies 1306 has information relating to the container 1302 on which it is mounted, such as the type and quantity of fuel in the container 1302, and an associated delivery location, stored therein.

Figure 34C:
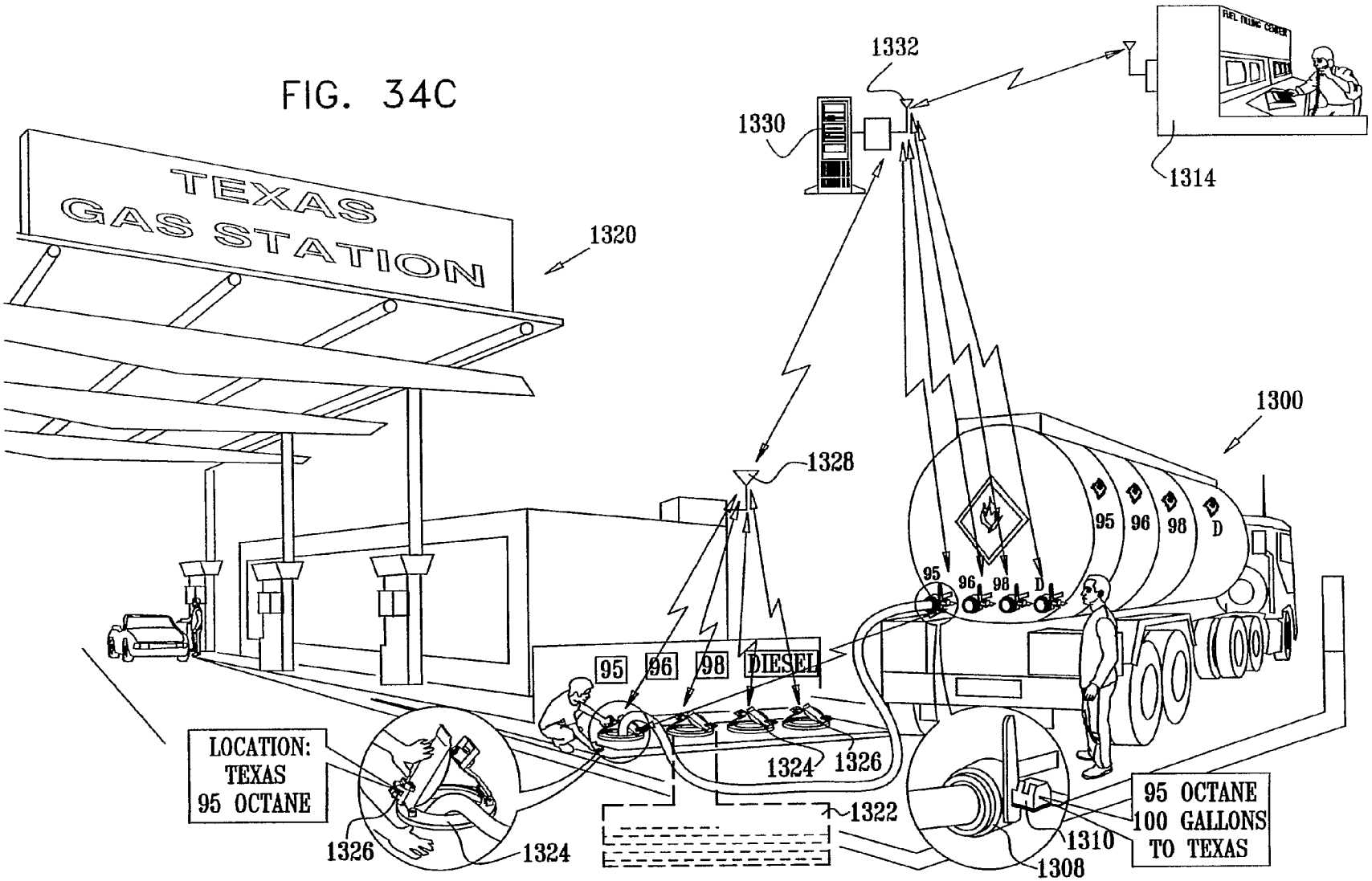

FIG. 34C illustrates correct unloading of fuel from tanker 1300 at a gas station 1320. As seen in FIG. 34C, one or more valves 1308 are opened and fuel is transferred to one or more fuel storage reservoir 1322, typically located underground within gas station 1320. Each fuel storage reservoir 1322 is closed by a hatch 1324 have a monitorable locking assembly 1326, such as any of the monitorable locking assemblies of any of FIGS. 18-25B, mounted thereon. Monitorable locking assemblies 1326 typically store information such as the location of gas station 1320 and the type of fuel to be stored in the fuel storage reservoir 1322.

As seen in FIG. 34C, locking assemblies 1310 communicate to remote control center 1314 information indicating that valves 1308 have been opened, and additional information stored in the locking assemblies 1310. Monitorable locking assemblies 1326 communicate to remote control center 1314, via a local antenna 1328, information indicating that hatches 1324 have been opened, as well as the information stored therein. At the remote control center 1314, the information received from locking assemblies 1310 is correlated with the information received from locking assemblies 1326, to ensure that a correct type of fuel in a correct amount is being transferred from container 1302 to reservoir 1322 which is located at an appropriate gas station 1320.

Alternatively, the information may be communicated to a remote computer 1330 via an antenna 1332 mounted thereon. Remote computer 1330 can then correlate the information and communicate the correlated information directly to remote control center 1314. As a further alternative, monitorable locking assembly 1310 may communicate directly with monitorable locking assembly 1326, to ensure that there is a match in fuel type and transfer location.

Figure 34D:
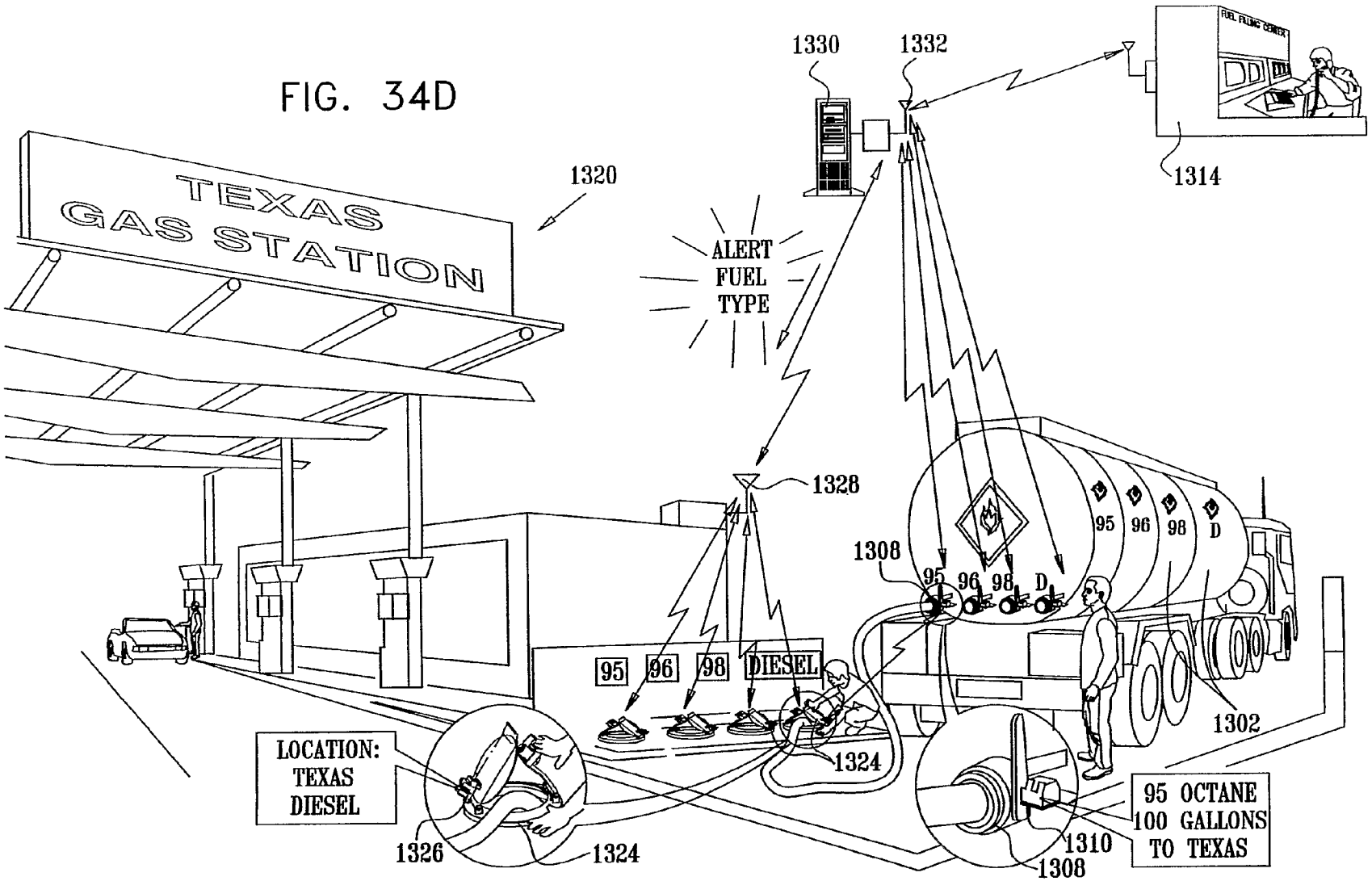

FIG. 34D illustrates incorrect unloading of fuel from tanker 1300 at gas station 1320. As seen in FIG. 34D, valve 1308, sealing a container 1302 containing a first type of fuel, is opened and the first type of fuel is transferred to a fuel storage reservoir 1322 suitable for a second type of fuel.

As seen in FIG. 34D, locking assembly 1310 communicates to remote control center 1314 information indicating that valve 1308 has been opened as well as additional information stored in the locking assembly 1310. Monitorable locking assembly 1326 communicate to remote control center 1314, via local antenna 1328, information indicating that hatch 1324 has been opened, as well as the information stored therein. At the remote control center 1314, the information received from locking assemblies 1310 and 1326 is correlated. In the case of FIG. 34D, the comparison of information received from locking assemblies 1310 and 1326 shows that the type of fuel being transferred from the container 1302 as registered by locking assembly 1310 is not correlated with the type of fuel required in reservoir 1322 as registered by locking assembly 1326. In this case, an operator at the remote control center 1314 is alerted.

Alternatively, the information from locking assemblies 1310 and 1326 may be communicated to computer 1330, via antenna 1332 mounted thereon. The information is then compared by computer 1330, and an alert indicating a discrepancy in fuel types is then communicated from computer 1330 via antenna 1332 to the operator at remote control center 1314. As a further alternative, monitorable locking assembly 1310 may communicate directly with monitorable locking assembly 1326, in which case the operator transferring the fuel from tanker 1300 to reservoir 1322 is alerted, preferably by a visual or audible alert.

Figure 34E:
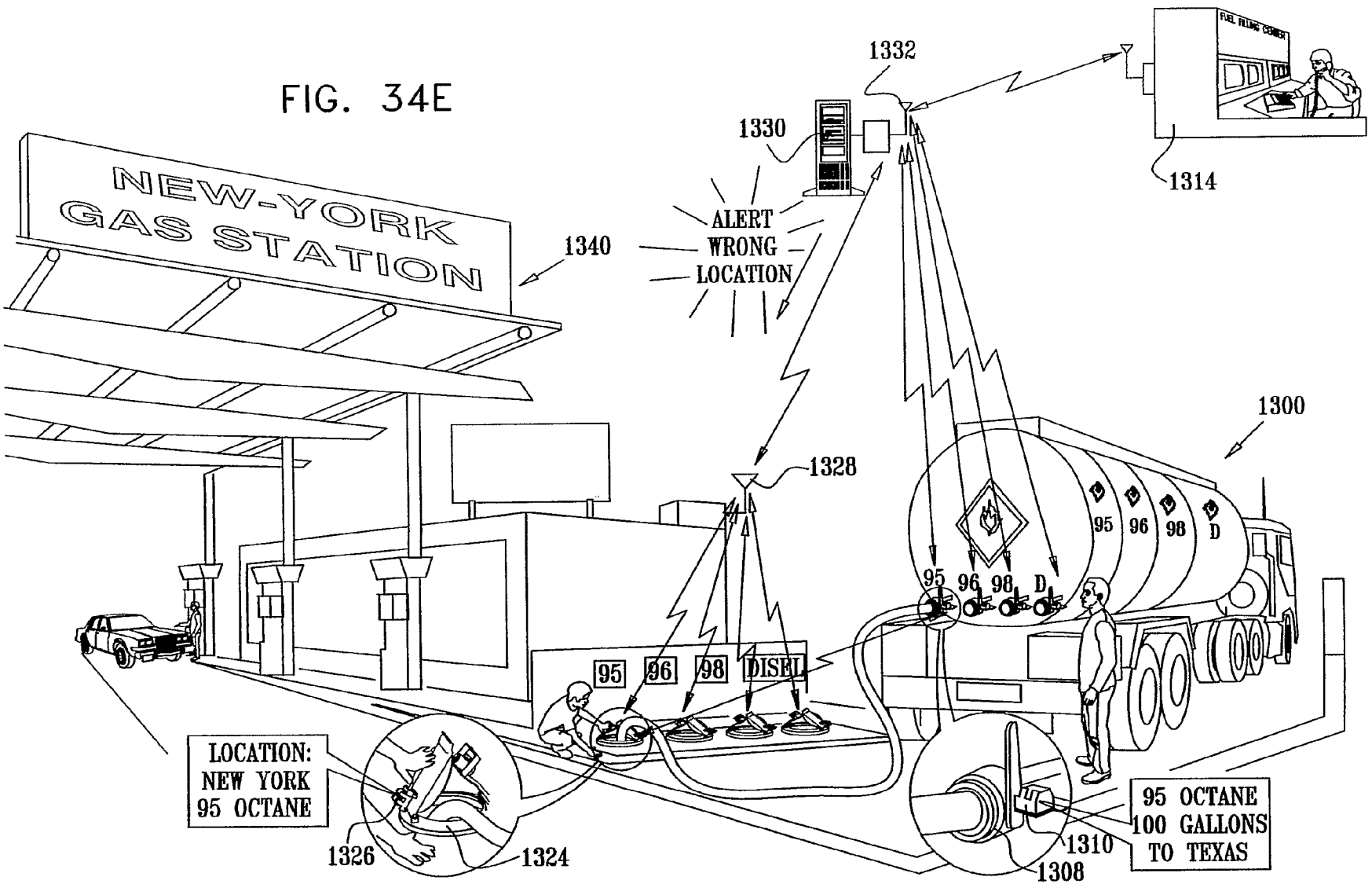

FIG. 34E illustrates a second example of incorrect unloading of fuel from tanker 1300 at a gas station 1340 located in a first location. As seen in FIG. 34E, valve 1308, sealing a container 1302 containing fuel which is to be delivered to a second location, is opened and fuel is transferred to the fuel storage reservoir 1322 in the first location.

As seen in FIG. 34E, locking assembly 1310 communicates to remote control center 1314 information indicating that valve 1308 has been opened as well as additional information stored in the locking assembly 1310. Monitorable locking assembly 1326 communicates to remote control center 1314, via local antenna 1328, information indicating that hatch 1324 has been opened, as well as the information stored therein. At the remote control center 1314, the information received from locking assemblies 1310 and 1326 is correlated. In the case of FIG. 34E, the comparison of information received from locking assemblies 1310 and 1326 shows a discrepancy in the location of gas station 1340 and the location to which the fuel in container 1302 should be transferred. In this case, an operator at the remote control center 1314 is alerted.

Alternatively, the information from locking assemblies 1310 and 1326 may be communicated to computer 1330, via antenna 1332 mounted thereon. The information is compared by computer 1330, and an alert indicating a discrepancy in locations is then communicated from computer 1330 via antenna 1332 to the operator at remote control center 1314. As a further alternative, monitorable locking assembly 1310 may communicate directly with monitorable locking assembly 1326, in which case the operator transferring the fuel from tanker 1300 to reservoir 1322 is alerted, preferably by a visual or audible alert.

Figure 34F:
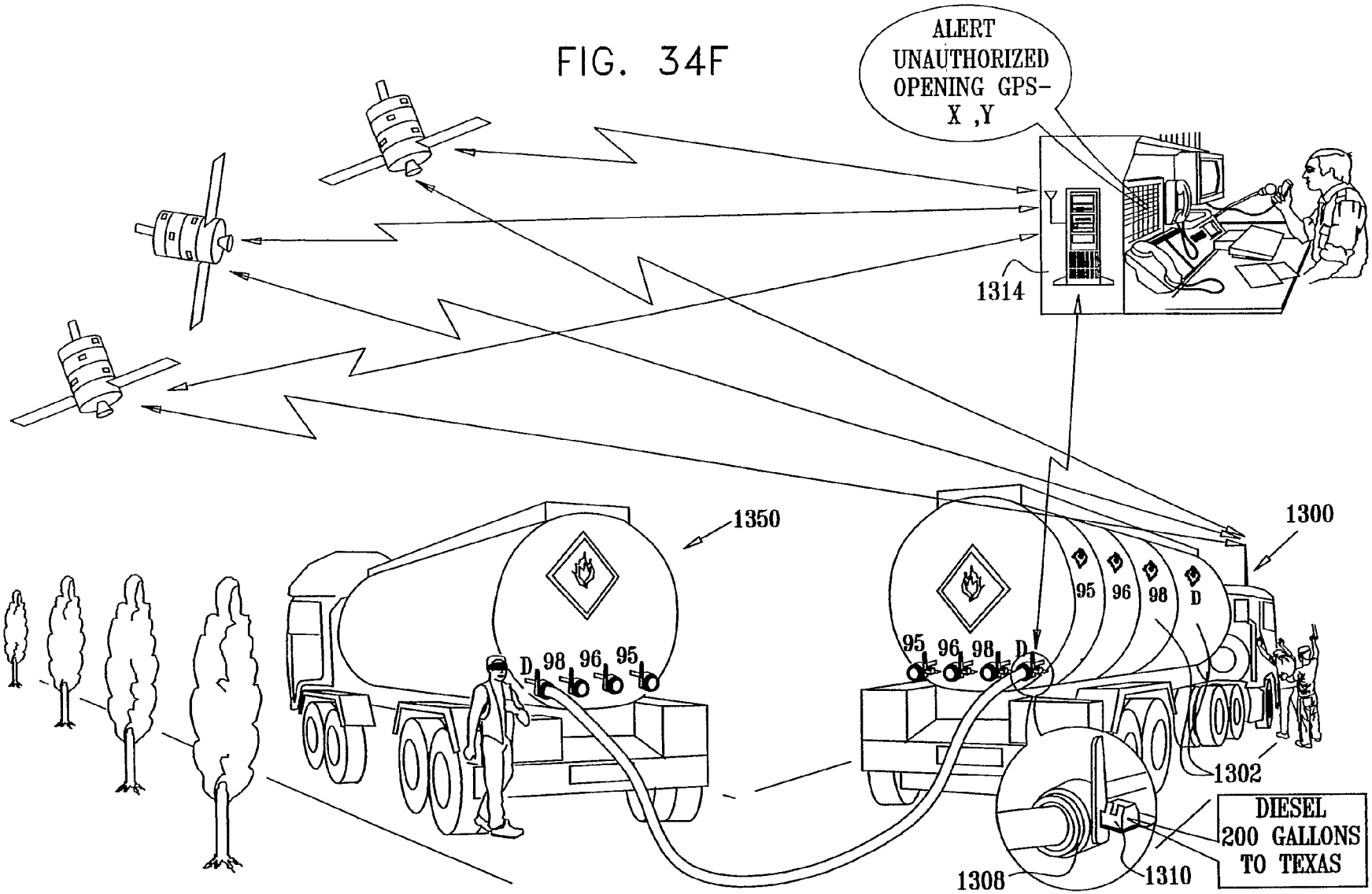

FIG. 34F illustrates unauthorized opening of one or more of valves 1308, such as in a case of theft. As seen in FIG. 34F, thieves or hijackers open one or more valves 1308 and transfer fuel from tanker 1300 into another vehicle 1350 such as a second tanker. Locking assembly 1310 communicates to remote control center 1314 information indicating that valve 1308 has been opened, as well as the GPS coordinates of the tanker, thus alerting the operator at remote control center 1314 to the unauthorized opening of the tanker portion.

Reference is now made to FIGS. 35A-35D, which illustrate a remote visual identification system constructed and operative in accordance with a preferred embodiment of the present invention. The remote visual identification system comprises a plurality of individually remotely wirelessly addressable mechanically displaceable visual indicators 1500, each of which preferably comprises a removable mounting element 1502, a visual indicator element 1504 such as a flag, and an individually addressable visual indicator element displacement assembly 1506, which is operative to selectably displace the visual indicator element 1504 from an inoperative orientation to an visually indicating orientation, such as the flag being raised.

Figure 35A:
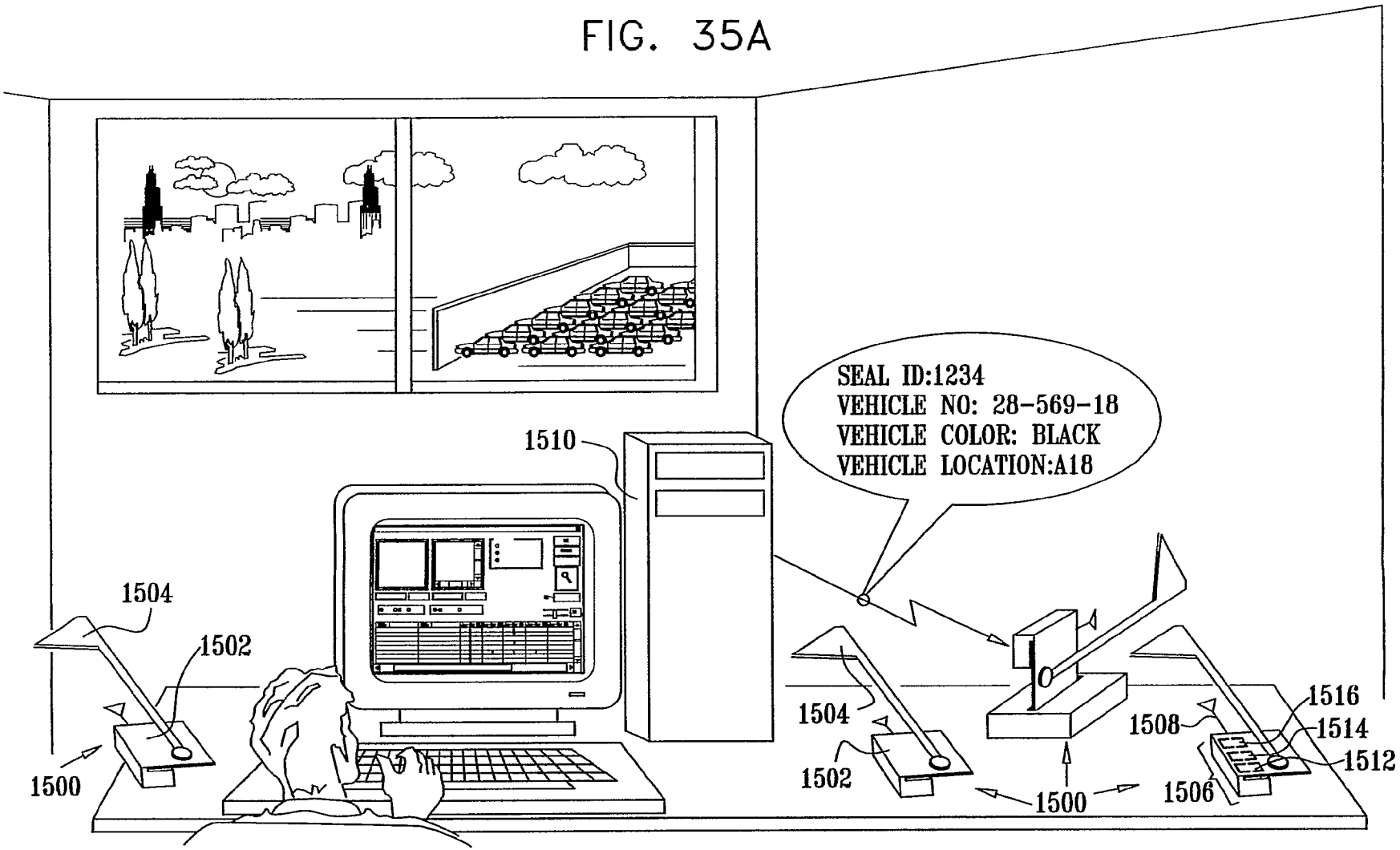
FIGS. 35A, 35B, 35C and 35D illustrate a remote visual identification system constructed and operative in accordance with a preferred embodiment of the present invention.

As seen in FIG. 35A, the individually addressable visual indicator element displacement assembly 1506 preferably includes a wireless receiver or transceiver 1508 which receives operational signals sent wirelessly from a control computer 1510. Coupled to wireless receiver or transceiver 1508 is a motor driver control circuit 1512, which, responsive to receipt of an operational signal at receiver or transceiver 1508 is operative to provide electrical power to a motor 1514 which is in turn operative, via a transmission 1516 to position the visual indicator element 1504 in an operative orientation, such as a raised orientation of a flag.

FIG. 35A shows an operator programming a plurality of individually addressable mechanically displaceable visual indicators 1500, associating the address of each with an item which it is sought to identify at a future time. In the illustrated application, the items to be identified are automobiles in a lot.

Figure 35B:
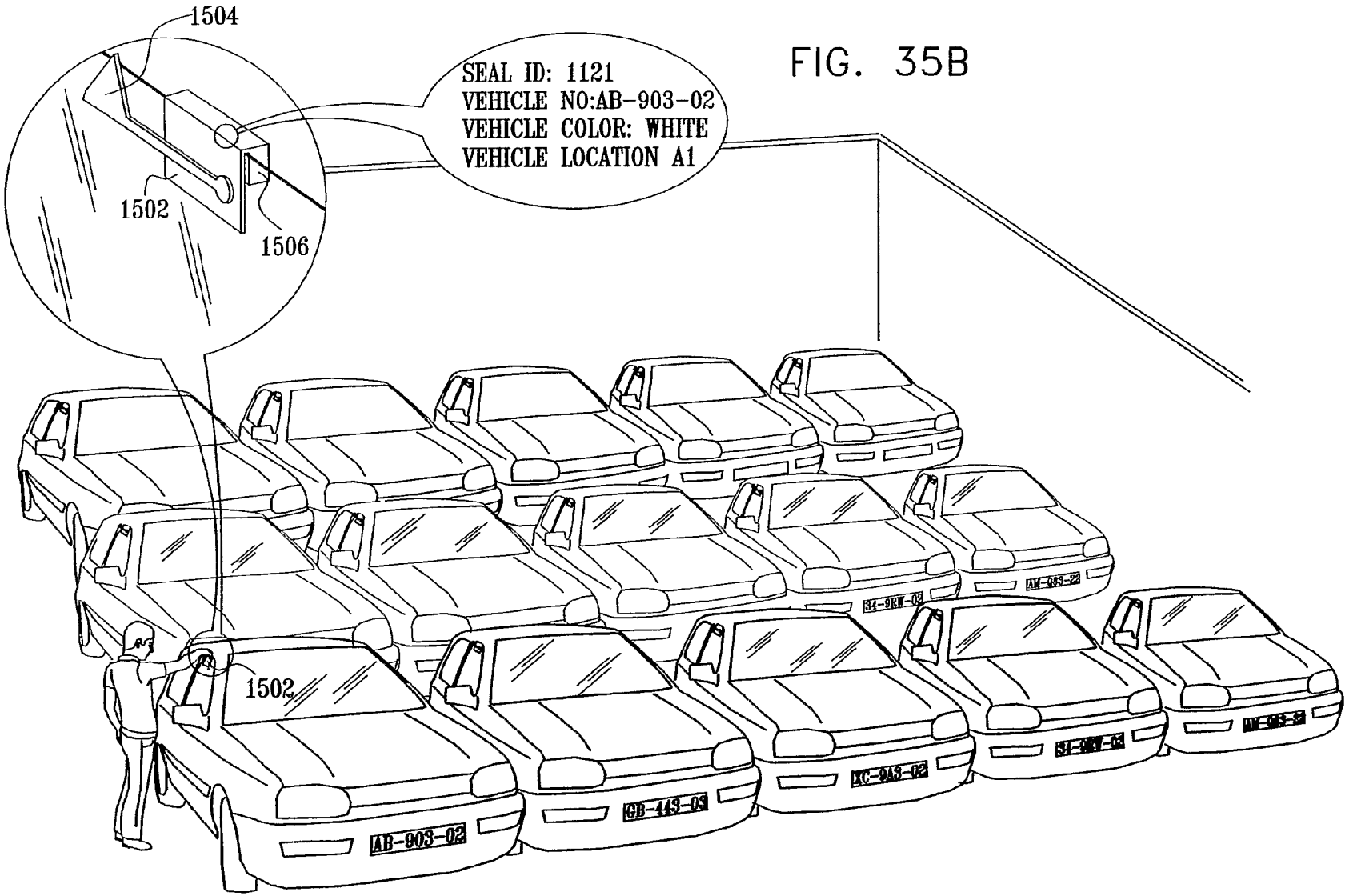
Figure 35C:
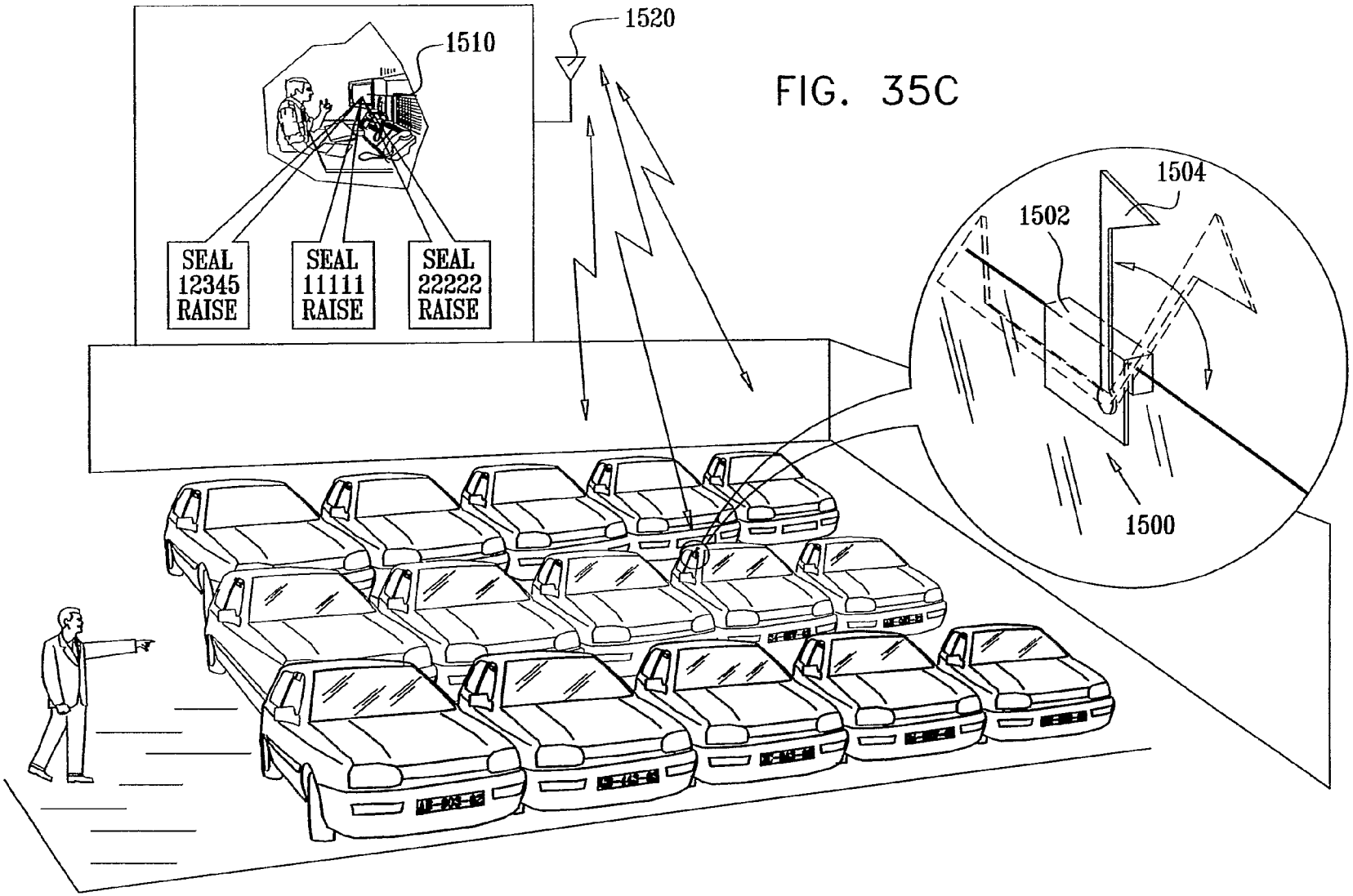

FIG. 35B shows attachment of the individually remotely wirelessly addressable mechanically displaceable visual indicators 1500 to each of a multiplicity of vehicles in a lot and FIG. 35C shows transmission of individually addressed operational signals from computer 1510 via an antenna 1520, which causes the addressed ones of the individually remotely wirelessly addressable mechanically displaceable visual indicators 1500 to assume a flag raised operative orientation, and preferably to continue waving flag 1504 until a specific condition is fulfilled, such as the door of the vehicle being opened.

Figure 35D:
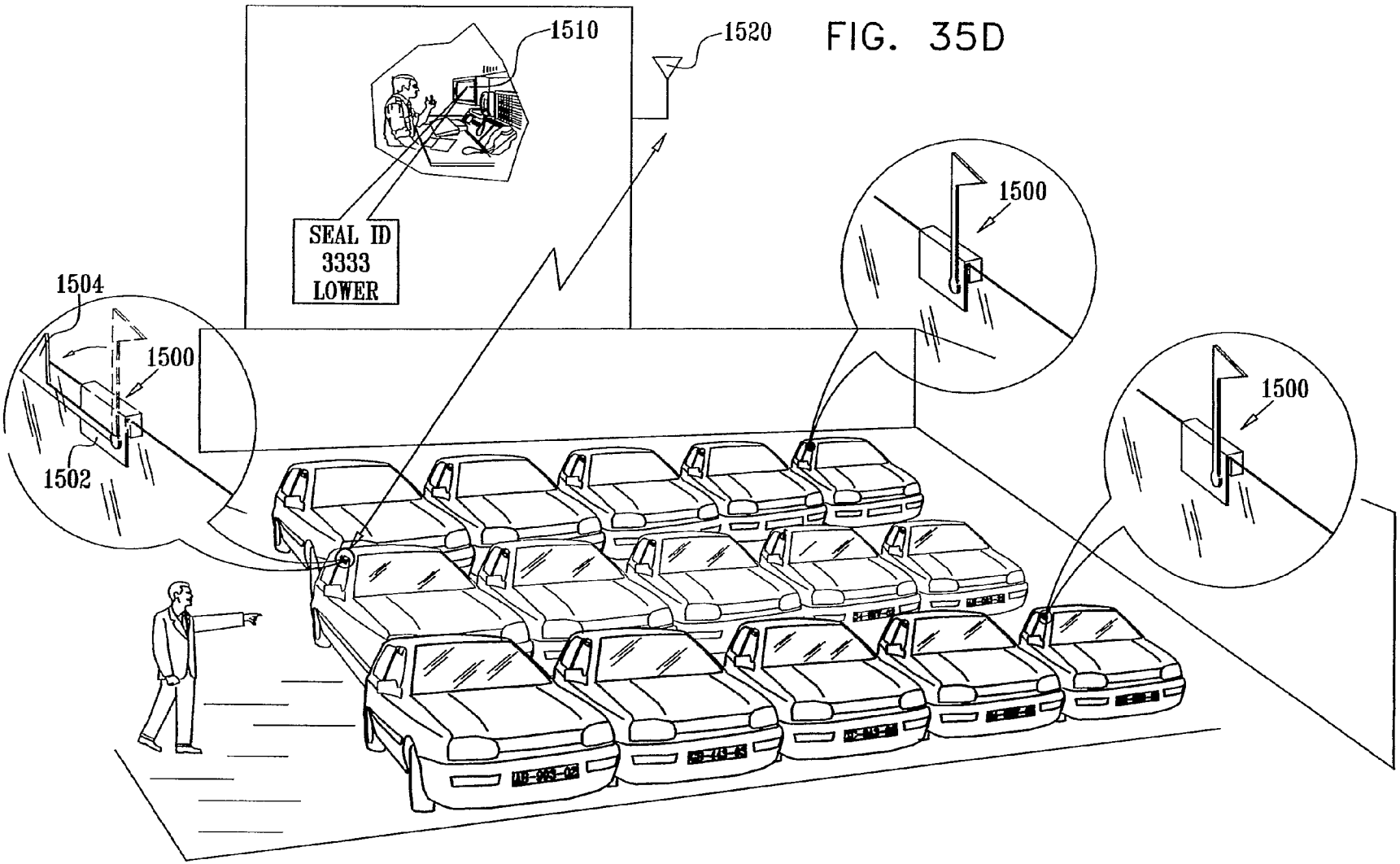

FIG. 35D shows transmission of an individually addressed operational signal from computer 1510 via antenna 1520, which causes the addressed one of the individually remotely wirelessly addressable mechanically displaceable visual indicators 1500 to assume a flag lowered operative orientation thus correcting a previously made error, and ensuring that the raised flags are mounted only on vehicles that should be indicated.

It will be appreciated by persons skilled in the art that the present invention is not limited by what has been particularly shown and described hereinabove. Rather the scope of the present invention includes both combinations and subcombinations of various features described and shown in the foregoing description as well as modifications and variations thereof which would occur to a person of ordinary skill in the art upon reading the foregoing description and which are not in the prior art.

The invention claimed is:

1. A key-operated remotely monitorable locking assembly comprising:

a key-operated lock including:

a lock body including a key operated locking assembly;

a tamper monitorable lockable assembly which is selectably locked to said lock body by operation of said key operated locking assembly; and a key insertion sensor operative to sense whether a key is operatively inserted in said key operated locking assembly; and a wireless communication circuit located in at least one of said lock body and said lockable assembly for providing a remotely monitorable indication of tampering with said lockable assembly and a remotely monitorable indication of at least one of key insertion or the absence thereof, said wireless communication circuit being operative to allow opening of said lock upon receiving a wireless authorization communication from a remote computer.

2. A key-operated remotely monitorable locking assembly according to claim 1 and wherein said wireless communication circuit is also operative for providing a remotely monitorable indication of at least one of locking and unlocking said lockable assembly to said lock body.

3. A key-operated remotely monitorable locking assembly according to claim 1 and wherein said wireless communication circuit is also operative for providing a remotely monitorable indication of at least one of presence and absence of said lockable assembly within said lock body.

4. A key operated remotely monitorable locking assembly according to claim 1 and wherein said tamper monitorable lockable assembly comprises a flexible sealing wire assembly.

5. A key operated remotely monitorable locking assembly according to claim 1 and wherein said key operated locking assembly is operated by at least one of a mechanical key, an electronic key and a combined mechanical-electronic key.

6. A key operated remotely monitorable locking assembly according to claim 1 and wherein said tamper monitorable lockable assembly includes at least one conductor disposed about a retaining element, said conductor being monitored by said wireless communication circuit.

7. A key operated remotely monitorable locking assembly according to claim 1 and also comprising at least one monitorable element disposed within said lock body and at least one detector operative to monitor the presence of said monitorable element at a predetermined location within said lock body.

8. A key operated remotely monitorable locking assembly according to claim 7 and wherein said monitorable element comprises a magnet.

9. A key operated remotely monitorable locking assembly according to claim 7 and wherein said detector comprises a reed switch.

10. A key operated remotely monitorable locking assembly according to claim 7 and wherein said detector comprises an RFID sensor.

11. A key operated remotely monitorable locking assembly according to claim 1 and wherein said tamper monitorable lockable assembly is entirely removable from said lock body.

12. A key operated remotely monitorable locking assembly according to claim 1 and wherein said tamper monitorable lockable assembly is tethered at one side thereof to said lock body.

13. A key operated remotely monitorable locking assembly according to claim 1 and wherein said wireless communication circuit is operative to provide a wireless indication if said tamper monitorable lockable assembly is unlocked from said lock body prior to receipt of wireless authorization by said wireless communication circuit.

14. A monitorable shipping container assembly comprising:

a shipping container body;

a remotely monitorable locking assembly comprising:

a key-operated lock including:

a lock body including a key operated locking assembly;

a tamper monitorable lockable assembly which is selectably locked to said lock body by operation of said key operated locking assembly; and a key insertion sensor operative to sense whether a key is operatively inserted in said key operated locking assembly and a wireless communication circuit located in at least one of said lock body and said lockable assembly for providing a remotely monitorable indication of tampering with said lockable assembly and a remotely monitorable indication of at least one of key insertion or the absence thereof;

a support on the exterior of said shipping container body for removably supporting said locking assembly onto said shipping container body; and a support sensor for sensing when said locking assembly is located on said support, wherein said wireless communication circuit is operative to allow opening of said lock upon receiving a wireless authorization communication from a remote computer and is also operative for providing a remotely monitorable indication responsive to an output of said support sensor indicating whether said locking assembly is located on said support.

15. A monitorable shipping container assembly according to claim 14 and wherein said wireless communication circuit is also operative for providing a remotely monitorable indication of at least one of locking and unlocking said lockable assembly to said lock body.

16. A monitorable shipping container assembly according to claim 14 and wherein said tamper monitorable lockable assembly comprises a flexible sealing wire assembly.

17. A monitorable shipping container assembly according to claim 14 and wherein said tamper monitorable lockable assembly comprises a shackle assembly.

18. A monitorable shipping container assembly according to claim 14 and wherein said key operated locking assembly is operated by at least one of a mechanical key, an electronic key and a combined mechanical-electronic key.

19. A monitorable shipping container assembly according to claim 14 and wherein said tamper monitorable lockable assembly includes at least one conductor disposed about a retaining element, said conductor being monitorable by said wireless communication circuit.

20. A monitorable shipping container assembly according to claim 14 and wherein said remotely monitorable locking assembly also comprises at least one monitorable element disposed within said lock body and at least one detector operative to monitor the presence of said monitorable element at a predetermined location within said lock body.

21. A monitorable shipping container assembly according to claim 20 and wherein said monitorable element comprises a magnet.

22. A monitorable shipping container assembly according to claim 20 and wherein said detector comprises a reed switch.

23. A monitorable shipping container assembly according to claim 20 and wherein said detector comprises an RFID sensor.

24. A monitorable shipping container assembly according to claim 14 and wherein said support sensor comprises a magnet sensor.

25. A monitorable shipping container assembly according to claim 14 and wherein said support sensor comprises an RFID sensor.

26. A monitorable shipping container assembly according to claim 14 and wherein said support sensor comprises a reed switch.

27. A remotely monitorable closure assembly comprising:

a key-operated closure assembly arranged for mounting on a first closure element and including:

a closure body;

a closure pin fixedly mounted onto said closure body;

a key insertion sensor operative to sense whether a key is operatively inserted in said key-operated closure assembly; and a wireless communication circuit located in said closure body for providing a remotely monitorable indication of tampering with said closure assembly and a remotely monitorable indication of at least one of key insertion or the absence thereof; and a closure pin receiver arranged for mounting on a second closure element cooperative with said first closure element, said closure pin receiver having at least a pin securing operative orientation and a pin releasing operative orientation, said wireless communication circuit being operative to allow opening of said closure body upon receiving a wireless authorization communication from a remote computer.

28. A remotely monitorable closure assembly according to claim 27 and also comprising a key-operated lock associated with said closure pin receiver and being operative for selectably locking said closure pin receiver in said pin securing operative orientation.

29. A remotely monitorable closure assembly according to claim 27 and wherein said first and second closure elements are first and second doors which may be secured in a closed mutual orientation by said closure assembly.

30. A remotely monitorable closure assembly according to claim 27 and wherein said first and second closure elements are hatch portions of a tanker which may be secured in a closed mutual orientation by said closure assembly.

31. A remotely monitorable closure assembly according to claim 27 and wherein said first and second closure elements are output valve access elements of a tanker which may be secured in a closed mutual orientation by said closure assembly.

32. A remotely monitorable closure assembly according to claim 27 and also comprising a mounting element fixed to said first closure element and wherein said closure body is mounted onto said mounting element.

33. A remotely monitorable closure assembly according to claim 27 and wherein said closure pin includes at least one conductor forming an electrical circuit, said electrical circuit being operative to provide indication of tampering with said closure assembly to said wireless communication circuit.

34. A remotely monitorable closure assembly according to claim 27 and wherein said closure pin receiver also comprises at least one monitorable element operative to provide said wireless communication circuit with sensed information for monitoring the presence of said closure pin at a predetermined location within said closure pin receiver.

35. A remotely monitorable closure assembly according claim 34 and wherein said monitorable element comprises at least one magnet.

36. A remotely monitorable closure assembly according to claim 27 and wherein said wireless communication circuit is also operative for providing a remotely monitorable indication of at least one of said pin securing operative orientation and said pin releasing operative orientation.

37. A remotely monitorable closure assembly according to claim 27 and wherein shifting of said closure pin receiver between said pin securing operative orientation and said pin releasing operative orientation is governed by a spring loaded retaining assembly.

38. A remotely monitorable closure assembly according to claim 27 and wherein shifting of said closure pin receiver between said pin securing operative orientation and said pin releasing operative orientation is governed by rotation of a mechanical key disposed within said closure pin receiver.

39. A remotely monitorable closure assembly according to claim 27 and also comprising at least one pin receiver retaining element operative to retain a movable portion of said closure pin receiver within a remainder of said closure pin receiver.

40. A remote visual identification system comprising:

a controller; and a plurality of wirelessly addressable displaceable visual indicators, each comprising:

a mounting element;

a selectably displaceable visual indicator mounted onto said mounting element;

an individually addressable visual indicator displacement assembly operative to selectably displace said visual indicator; and a wireless communicator associated with said displacement assembly and operative to receive operational signals from said controller.

41. A remote visual identification system according to claim 40 and wherein said displacement assembly comprises:

a motor control circuit;

a motor controlled by said motor controlled circuit; and a transmission controlled by said motor and being operative to position said visual indicator.

42. A remote visual identification system according to claim 40 wherein said visual indicator is selectably displaceable between an inoperative orientation and a visually indicating orientation by said motor and said transmission.

* * * * *